US009534775B2

(12) United States Patent
Wilcox et al.

(10) Patent No.: US 9,534,775 B2
(45) **Date of Patent: *Jan. 3, 2017**

(54) LED LIGHT FIXTURE

(71) Applicant: Cree, Inc., Durham, NC (US)

(72) Inventors: Kurt S. Wilcox, Libertyville, IL (US); Brian Kinnune, Racine, WI (US); Jeremy Sorenson, Oak Creek, WI (US); Corey Goldstein, Mt. Pleasant, WI (US)

(73) Assignee: Cree, Inc., Durham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/017,971

(22) Filed: Feb. 8, 2016

(65) Prior Publication Data

US 2016/0153649 A1 Jun. 2, 2016

Related U.S. Application Data

(63) Continuation-in-part of application No. 14/708,558, filed on May 11, 2015, now Pat. No. 9,261,270, which (Continued)

(51) Int. Cl.
*F21V 23/00* (2015.01)
*F21V 29/83* (2015.01)

(Continued)

(52) U.S. Cl.
CPC ..... *F21V 29/83* (2015.01); *F21K 9/20* (2016.08); *F21S 2/005* (2013.01); *F21S 8/033* (2013.01);

(Continued)

(58) Field of Classification Search
CPC ..... F21V 29/71; F21V 29/83; F21V 29/507; F21V 29/763; F21V 23/009; F21K 9/10; F21S 2/005
See application file for complete search history.

(56) References Cited

U.S. PATENT DOCUMENTS

D49,999 S 12/1916 Moritz
1,225,301 A 5/1917 Wolfe (Continued)

FOREIGN PATENT DOCUMENTS

CN ZL200420110545 12/2004
CN 1737418 A 8/2005

(Continued)

OTHER PUBLICATIONS

Excerpt from Aavid Thermalloy (www.aavidthermalloy.com). Part Specificiation. 1 page. Date: Copyright 2006.

(Continued)

*Primary Examiner* — Anabel Ton
(74) *Attorney, Agent, or Firm* — Jansson Munger McKinley & Kirby Ltd.

(57) ABSTRACT

An LED light fixture including a housing portion and a base together defining an open space therebetween permitting air/water-flow therethrough. The housing portion forms a chamber enclosing at least one driver. The base extends from the housing portion and supports at least one LED illuminator outside the chamber. The housing portion and the base may each be formed as part of a one piece with the open space along at least three sides of the base. Alternatively, the base may be a separate structure secured with respect to the housing. Such base may be a single-piece extrusion supporting a plurality of LED modules or comprise a plurality of extruded heat sinks. Each heat sink may support one or more LED modules.

18 Claims, 59 Drawing Sheets

Related U.S. Application Data is a continuation of application No. 13/834,525, filed on Mar. 15, 2013, now Pat. No. 9,039,223, which is a continuation of application No. 13/294,459, filed on Nov. 11, 2011, now Pat. No. 8,425,071, which is a continuation of application No. 12/629,986, filed on Dec. 3, 2009, now Pat. No. 8,070,306, which is a continuation of application No. 11/860,887, filed on Sep. 25, 2007, now Pat. No. 7,686,469, which is a continuation-in-part of application No. 11/541,908, filed on Sep. 30, 2006, now abandoned, application No. 15/017,971, which is a continuation-in-part of application No. 14/708,422, filed on May 11, 2015, now Pat. No. 9,255,705, which is a continuation of application No. 14/246,776, filed on Apr. 7, 2014, now Pat. No. 9,028,087, which is a continuation-in-part of application No. 13/764,743, filed on Feb. 11, 2013, now Pat. No. 9,243,794, and a continuation-in-part of application No. 13/764,736, filed on Feb. 11, 2013, now Pat. No. 9,222,632, and a continuation-in-part of application No. 13/764,746, filed on Feb. 11, 2013, now Pat. No. 9,212,812, said application No. 13/764,743 is a continuation-in-part of application No. 29/444,511, filed on Jan. 31, 2013, now Pat. No. Des. 718,482, said application No. 13/764,736 is a continuation-in-part of application No. 29/444,511, filed on Jan. 31, 2013, now Pat. No. Des. 718,482, said application No. 14/246,776 is a continuation-in-part of application No. 13/839,922, filed on Mar. 15, 2013, said application No. 15/017,971 is a continuation-in-part of application No. 14/719,359, filed on May 22, 2015, now Pat. No. 9,261,271, which is a continuation of application No. 14/087,971, filed on Nov. 22, 2013, now Pat. No. 9,039,241, which is a continuation of application No. 13/680,481, filed on Nov. 19, 2012, now Pat. No. 8,622,584, which is a continuation of application No. 13/333,198, filed on Dec. 21, 2011, now Pat. No. 8,313,222, which is a continuation of application No. 12/418,364, filed on Apr. 3, 2009, now Pat. No. 8,092,049.

(60) Provisional application No. 61/624,211, filed on Apr. 13, 2012, provisional application No. 61/042,690, filed on Apr. 4, 2008.

(51) Int. Cl.

| | |
|---|---|
| ***F21V 29/02*** | (2006.01) |
| ***F21S 2/00*** | (2016.01) |
| ***F21S 8/00*** | (2006.01) |
| ***F21V 19/00*** | (2006.01) |
| ***F21V 21/30*** | (2006.01) |
| ***F21V 23/02*** | (2006.01) |
| ***F21V 27/00*** | (2006.01) |
| ***F21V 31/03*** | (2006.01) |
| ***F21S 9/02*** | (2006.01) |
| ***F21V 19/04*** | (2006.01) |
| ***F21S 8/08*** | (2006.01) |
| ***F21V 29/70*** | (2015.01) |
| ***F21V 29/71*** | (2015.01) |
| ***F21V 29/75*** | (2015.01) |
| ***F21V 29/76*** | (2015.01) |
| ***F21V 29/507*** | (2015.01) |
| ***F21V 29/74*** | (2015.01) |
| ***F21V 15/01*** | (2006.01) |
| *F21V 21/005* | (2006.01) |
| *F21W 131/10* | (2006.01) |
| *F21W 131/103* | (2006.01) |
| *F21K 99/00* | (2016.01) |
| *F21W 131/40* | (2006.01) |
| *F21Y 101/00* | (2016.01) |

(52) U.S. Cl.

CPC ..... *F21S 8/086* (2013.01); *F21S 9/022* (2013.01); *F21V 15/013* (2013.01); *F21V 19/003* (2013.01); *F21V 19/045* (2013.01); *F21V 21/30* (2013.01); *F21V 23/009* (2013.01); *F21V 23/02* (2013.01); *F21V 27/00* (2013.01); *F21V 29/02* (2013.01); *F21V 29/507* (2015.01); *F21V 29/70* (2015.01); *F21V 29/71* (2015.01); *F21V 29/74* (2015.01); *F21V 29/75* (2015.01); *F21V 29/763* (2015.01); *F21V 31/03* (2013.01); *F21K 9/00* (2013.01); *F21V 21/005* (2013.01); *F21W 2131/10* (2013.01); *F21W 2131/103* (2013.01); *F21W 2131/40* (2013.01); *F21Y 2101/00* (2013.01); *F21Y 2105/10* (2016.08); *F21Y 2115/10* (2016.08); *Y10S 362/80* (2013.01)

(56) References Cited

U.S. PATENT DOCUMENTS

| | | | |
|---|---|---|---|
| 2,254,790 | A | 9/1941 | Benton |
| 2,345,393 | A | 3/1944 | Heyermans |
| D155,488 | S | 5/1949 | Crockett |
| D162,639 | S | 3/1951 | Fiori |
| 2,612,600 | A | 9/1952 | Yonkers |
| D173,139 | S | 10/1954 | Black |
| 2,772,382 | A | 11/1956 | Escoffery |
| 2,886,699 | A | 5/1959 | Harling |
| 2,974,219 | A | 3/1961 | Husby |
| 3,071,683 | A | 1/1963 | Queale |
| 3,184,199 | A | 5/1965 | Clark et al. |
| 3,233,094 | A | 2/1966 | Foulds |
| 3,478,200 | A | 11/1969 | Hewson |
| 3,489,384 | A | 1/1970 | Perbal |
| 3,652,047 | A | 3/1972 | Starr |
| 3,660,651 | A | 5/1972 | Miles, Jr. |
| 3,685,858 | A | 8/1972 | Wandler |
| 3,800,177 | A | 3/1974 | Russ |
| 3,819,929 | A | 6/1974 | Newman |
| 3,860,829 | A | 1/1975 | Fabbri |
| 3,889,147 | A | 6/1975 | Groves |
| D246,203 | S | 10/1977 | Harris |
| 4,071,749 | A | 1/1978 | Balogh |
| 4,156,891 | A | 5/1979 | Roche |
| 4,167,033 | A | 9/1979 | Fletcher |
| 4,187,711 | A | 2/1980 | Lavochkin et al. |
| 4,203,488 | A | 5/1980 | Johnson et al. |
| 4,228,489 | A | 10/1980 | Martin |
| 4,235,285 | A | 11/1980 | Johnson et al. |
| 4,254,453 | A | 3/1981 | Mouyard et al. |
| 4,264,946 | A | 4/1981 | Faux et al. |
| 4,317,164 | A | 2/1982 | Karaktin |
| 4,332,363 | A | 6/1982 | Ware |
| D266,080 | S | 9/1982 | Asanuma |
| D266,081 | S | 9/1982 | Asanuma |
| D266,082 | S | 9/1982 | Asanuma |
| 4,398,239 | A | 8/1983 | de Vos |
| 4,410,933 | A | 10/1983 | Blake |
| 4,426,676 | A | 1/1984 | Taylor |
| 4,460,945 | A | 7/1984 | Chan et al. |
| D275,749 | S | 10/1984 | McCarthy |
| 4,494,177 | A | 1/1985 | Matthews |
| 4,508,163 | A | 4/1985 | McCarthy |
| 4,543,007 | A | 9/1985 | Quiogue |
| 4,551,793 | A | 11/1985 | Mellema |
| 4,552,206 | A | 11/1985 | Johnson et al. |
| D285,194 | S | 8/1986 | McCarthy |
| 4,679,118 | A | 7/1987 | Johnson et al. |

(56) References Cited

U.S. PATENT DOCUMENTS

| | | | |
|---|---|---|---|
| 4,729,073 | A | 3/1988 | Klaus |
| 4,729,076 | A | 3/1988 | Masami et al. |
| D296,778 | S | 7/1988 | McCarthy |
| 4,787,019 | A | 11/1988 | Van Den Broeke et al. |
| 4,793,581 | A | 12/1988 | Bilson et al. |
| 4,875,057 | A | 10/1989 | Hediger et al. |
| 4,899,210 | A | 2/1990 | Lorenzetti et al. |
| 4,931,917 | A | 6/1990 | Scherf et al. |
| 5,004,953 | A | 4/1991 | McDonald |
| D319,702 | S | 9/1991 | Kane |
| 5,069,538 | A | 12/1991 | Shust |
| 5,119,174 | A | 6/1992 | Chen |
| 5,136,493 | A | 8/1992 | Straus et al. |
| 5,172,755 | A | 12/1992 | Samarov |
| 5,226,723 | A | 7/1993 | Chen |
| D338,449 | S | 8/1993 | Sahyoun |
| 5,258,898 | A | 11/1993 | Thornton |
| 5,274,250 | A | 12/1993 | Miyake et al. |
| 5,285,350 | A | 2/1994 | Villaume |
| 5,303,124 | A | 4/1994 | Wrobel |
| 5,304,735 | A | 4/1994 | Earl et al. |
| 5,357,414 | A | 10/1994 | Dane |
| D354,558 | S | 1/1995 | Marvin |
| 5,381,041 | A | 1/1995 | Harmon |
| 5,381,305 | A | 1/1995 | Harmon et al. |
| 5,384,940 | A | 1/1995 | Soule et al. |
| D355,722 | S | 2/1995 | Roos |
| 5,398,177 | A | 3/1995 | Harwood et al. |
| 5,436,798 | A | 7/1995 | Wieland, Jr. |
| D361,317 | S | 8/1995 | Harmon et al. |
| D361,986 | S | 9/1995 | Harmon |
| 5,474,482 | A | 12/1995 | Davidson |
| 5,494,098 | A | 2/1996 | Morosas |
| 5,517,395 | A | 5/1996 | Weissman |
| 5,562,146 | A | 10/1996 | Harmon et al. |
| 5,576,933 | A | 11/1996 | Campanella et al. |
| D376,349 | S | 12/1996 | Campanella et al. |
| 5,581,442 | A | 12/1996 | Morosas |
| 5,586,004 | A | 12/1996 | Green et al. |
| 5,593,225 | A | 1/1997 | Safyan |
| 5,611,393 | A | 3/1997 | Vasconcelos et al. |
| 5,617,131 | A | 4/1997 | Murano et al. |
| 5,623,551 | A | 4/1997 | East et al. |
| 5,633,564 | A | 5/1997 | Edwards et al. |
| 5,660,461 | A | 8/1997 | Ignatius et al. |
| D384,040 | S | 9/1997 | Frerichs et al. |
| 5,676,455 | A | 10/1997 | Johnson et al. |
| 5,711,890 | A | 1/1998 | Hawkins et al. |
| D390,539 | S | 2/1998 | Campanella |
| D394,043 | S | 5/1998 | Campanella et al. |
| 5,771,155 | A | 6/1998 | Cook |
| 5,782,555 | A | 7/1998 | Hochstein |
| D397,468 | S | 8/1998 | Zeller |
| 5,796,154 | A | 8/1998 | Sano et al. |
| 5,800,053 | A | 9/1998 | Shen |
| 5,833,358 | A | 11/1998 | Patik |
| 5,857,767 | A | 1/1999 | Hochstein |
| D407,381 | S | 3/1999 | Campanella |
| 5,894,882 | A | 4/1999 | Kikuchi et al. |
| 5,896,288 | A | 4/1999 | Lecheler et al. |
| 5,909,062 | A | 6/1999 | Krietzman |
| 5,936,353 | A | 8/1999 | Triner et al. |
| 5,984,494 | A | 11/1999 | Chapman et al. |
| 5,988,829 | A | 11/1999 | Holder |
| 6,011,299 | A | 1/2000 | Brench |
| 6,045,232 | A | 4/2000 | Buckmaster |
| 6,045,239 | A | 4/2000 | Waldmann et al. |
| 6,045,240 | A | 4/2000 | Hochstein |
| 6,056,254 | A | 5/2000 | Albright et al. |
| 6,155,701 | A | 12/2000 | Leen |
| D442,313 | S | 5/2001 | Wojkowiak |
| D442,565 | S | 5/2001 | Chou et al. |
| D442,566 | S | 5/2001 | Chou et al. |
| 6,227,684 | B1 | 5/2001 | Wijbenga et al. |
| 6,229,160 | B1 | 5/2001 | Krames et al. |
| D445,922 | S | 7/2001 | Yasuoka |
| 6,255,786 | B1 | 7/2001 | Yen |
| 6,274,924 | B1 | 8/2001 | Carey et al. |
| D449,126 | S | 10/2001 | Zeller |
| D450,306 | S | 11/2001 | Lin et al. |
| 6,323,063 | B2 | 11/2001 | Krames et al. |
| 6,325,524 | B1 | 12/2001 | Weber et al. |
| 6,329,593 | B1 | 12/2001 | Yang |
| 6,357,895 | B1 | 3/2002 | Kierulf |
| 6,375,340 | B1 | 4/2002 | Biebl et al. |
| 6,401,806 | B1 | 6/2002 | Lee et al. |
| 6,414,343 | B1 | 7/2002 | Kondo et al. |
| 6,428,189 | B1 | 8/2002 | Hochstein |
| 6,449,151 | B1 | 9/2002 | Chen |
| 6,457,837 | B1 | 10/2002 | Steffensmeier |
| 6,467,928 | B2 | 10/2002 | Crelin |
| D465,462 | S | 11/2002 | Hsieh |
| 6,481,874 | B2 | 11/2002 | Petroski |
| 6,486,499 | B1 | 11/2002 | Krames et al. |
| 6,498,355 | B1 | 12/2002 | Harrah et al. |
| 6,501,103 | B1 | 12/2002 | Jory et al. |
| 6,502,956 | B1 | 1/2003 | Wu |
| 6,502,967 | B2 | 1/2003 | Mullen |
| D470,965 | S | 2/2003 | Landefeld |
| 6,517,218 | B2 | 2/2003 | Hochstein |
| 6,521,914 | B2 | 2/2003 | Krames et al. |
| 6,522,263 | B2 | 2/2003 | Jones |
| 6,527,422 | B1 | 3/2003 | Hutchison |
| 6,529,375 | B2 | 3/2003 | Miyahara et al. |
| 6,547,249 | B2 | 4/2003 | Collins, III et al. |
| 6,554,451 | B1 | 4/2003 | Keuper |
| 6,558,021 | B2 | 5/2003 | Wu et al. |
| 6,565,238 | B1 | 5/2003 | Pyrtle |
| 6,570,190 | B2 | 5/2003 | Krames et al. |
| 6,578,986 | B2 | 6/2003 | Swaris et al. |
| 6,612,717 | B2 | 9/2003 | Yen |
| 6,614,103 | B1 | 9/2003 | Durocher et al. |
| D481,017 | S | 10/2003 | Hsia et al. |
| 6,630,736 | B1 | 10/2003 | Ignaut |
| 6,635,911 | B2 | 10/2003 | Maruyama |
| 6,635,941 | B2 | 10/2003 | Suda |
| D482,481 | S | 11/2003 | Landefeld |
| 6,641,284 | B2 | 11/2003 | Stopa et al. |
| 6,648,496 | B1 | 11/2003 | Elghoroury et al. |
| 6,657,862 | B2 | 12/2003 | Crocker et al. |
| 6,666,567 | B1 | 12/2003 | Feldman et al. |
| 6,676,279 | B1 | 1/2004 | Hubbell et al. |
| 6,682,204 | B2 | 1/2004 | Mullally |
| 6,688,380 | B2 | 2/2004 | Lavochkin et al. |
| D488,248 | S | 4/2004 | Toyoaki |
| 6,720,566 | B2 | 4/2004 | Blandford |
| 6,726,521 | B2 | 4/2004 | Peterson |
| 6,730,940 | B1 | 5/2004 | Steranka et al. |
| D493,151 | S | 7/2004 | Lee |
| D494,549 | S | 8/2004 | Lee |
| 6,784,351 | B2 | 8/2004 | Hauptmann et al. |
| 6,784,357 | B1 | 8/2004 | Wang |
| 6,814,473 | B2 | 11/2004 | Chen |
| 6,815,724 | B2 | 11/2004 | Dry |
| 6,834,981 | B2 | 12/2004 | Nagai et al. |
| 6,837,605 | B2 | 1/2005 | Reill |
| 6,841,931 | B2 | 1/2005 | Takahashi et al. |
| 6,851,531 | B2 | 2/2005 | Sasse |
| 6,851,831 | B2 | 2/2005 | Karlicek |
| 6,857,767 | B2 | 2/2005 | Matsui et al. |
| 6,860,620 | B2 | 3/2005 | Kuan et al. |
| 6,864,513 | B2 | 3/2005 | Lin et al. |
| 6,871,993 | B2 | 3/2005 | Hecht |
| 6,876,008 | B2 | 4/2005 | Bhat |
| 6,885,035 | B2 | 4/2005 | Bhat et al. |
| D505,220 | S | 5/2005 | Stekelenburg |
| 6,893,941 | B2 | 5/2005 | Suda |
| 6,914,261 | B2 | 7/2005 | Ho |
| RE38,767 | E | 8/2005 | Wedell et al. |
| 6,932,495 | B2 | 8/2005 | Sloan et al. |
| 6,934,153 | B2 | 8/2005 | Lee et al. |
| 6,935,410 | B2 | 8/2005 | Lee et al. |
| 6,942,361 | B1 | 9/2005 | Kishimura |
| 6,945,683 | B2 | 9/2005 | Gross |

(56) References Cited

U.S. PATENT DOCUMENTS 6,957,905 B1 10/2005 Pritchard et al.
6,958,914 B2 10/2005 Hoss
6,959,996 B2 11/2005 Ip
6,969,946 B2 11/2005 Steranka et al.
6,972,439 B1 12/2005 Kim et al.
6,999,318 B2 2/2006 Newby
7,008,080 B2 3/2006 Bachl et al.
7,009,213 B2 3/2006 Camras et al.
7,019,334 B2 3/2006 Yatsuda et al.
7,036,961 B2 5/2006 Defouw et al.
7,045,965 B2 5/2006 Li et al.
7,055,987 B2 6/2006 Staufert
7,056,116 B2 6/2006 Scott et al.
7,063,451 B2 6/2006 Shen
7,078,258 B2 7/2006 Sakoh et al.
7,080,932 B2 7/2006 Keuper
7,081,645 B2 7/2006 Chen et al.
D526,972 S 8/2006 Egawa et al.
7,090,370 B2 8/2006 Clark et al.
7,102,185 B2 9/2006 Nichols
7,114,830 B2 10/2006 Robertson et al.
7,141,825 B2 11/2006 Horio et al.
7,153,004 B2 12/2006 Galli
7,165,870 B2 1/2007 McKenney
D536,816 S 2/2007 Mier-Langner et al.
D536,817 S 2/2007 Mier-Langner et al.
7,176,070 B2 2/2007 Lee et al.
7,178,941 B2 2/2007 Roberge et al.
7,182,480 B2 2/2007 Kan
D537,972 S 3/2007 Mier-Langner et al.
D537,973 S 3/2007 Mier-Langner et al.
D538,459 S 3/2007 Rose et al.
D538,961 S 3/2007 Mier-Langner et al.
D539,460 S 3/2007 Mier-Langner et al.
D539,956 S 4/2007 Rose et al.
7,199,529 B2 4/2007 Vernon-Dier
D543,657 S 5/2007 Lehman
7,214,952 B2 5/2007 Klipstein
7,234,844 B2 6/2007 Bolta et al.
7,237,936 B1 7/2007 Gibson
7,244,042 B1 7/2007 Bieberdorf
D550,885 S 9/2007 Crosby
D551,379 S 9/2007 Maxik
7,267,459 B2 9/2007 Matheson
7,269,009 B2 9/2007 Ryu et al.
7,273,987 B2 9/2007 Becker et al.
7,278,761 B2 10/2007 Kuan
7,281,818 B2 10/2007 You et al.
7,288,796 B2 10/2007 Dry
7,303,301 B2 * 12/2007 Koren et al. ..... 362/101
7,322,735 B1 1/2008 Caldani
D563,013 S 2/2008 Levine
7,329,030 B1 2/2008 Wang
7,329,033 B2 2/2008 Glovatsky et al.
D563,580 S 3/2008 Prazoff
D563,582 S 3/2008 Levine
D564,117 S 3/2008 Lippert
7,348,604 B2 3/2008 Matheson
D570,535 S 6/2008 Kinnune
D571,032 S 6/2008 Chen
D573,741 S 7/2008 Lou
D573,743 S 7/2008 Yan
D576,330 S 9/2008 Ruud
D577,455 S 9/2008 Zheng
D577,847 S 9/2008 Ruud
7,434,959 B1 10/2008 Wang
7,434,964 B1 10/2008 Zheng et al.
D580,082 S 11/2008 Zemar
D581,080 S 11/2008 Mier-Langner
7,461,952 B2 12/2008 Trenchardl et al.
7,488,090 B1 2/2009 Bucher et al.
7,488,093 B1 2/2009 Huang
7,503,669 B2 3/2009 Rizkin et al.
7,513,639 B2 4/2009 Wang
7,530,711 B2 5/2009 Bang
7,534,009 B2 5/2009 Trojanowski et al.
7,543,953 B2 6/2009 Chapman
7,549,774 B2 6/2009 Tsai
7,566,147 B2 7/2009 Wilcox et al.
7,569,802 B1 8/2009 Mullins
7,572,027 B2 8/2009 Zampini, II et al.
7,575,354 B2 8/2009 Woodward
D599,494 S 9/2009 Levine
D600,400 S 9/2009 Friedman
7,591,567 B2 9/2009 Wilcox et al.
D603,077 S 10/2009 Kinnune
7,637,624 B2 12/2009 Chin
7,637,630 B2 12/2009 Wilcox et al.
7,637,633 B2 12/2009 Wong
D608,927 S 1/2010 Hsu
7,651,245 B2 1/2010 Thomas
7,654,691 B2 2/2010 Liu et al.
7,665,699 B2 2/2010 Oddsen, Jr. et al.
7,665,862 B2 2/2010 Villard
D612,527 S 3/2010 Espiau
7,679,096 B1 3/2010 Ruffin
7,686,469 B2 * 3/2010 Ruud ..... F21S 2/005 362/101
7,703,939 B2 4/2010 Wilcox et al.
7,744,236 B2 * 6/2010 Hsu et al. ..... 362/101
7,744,247 B2 6/2010 Zhang et al.
D619,291 S 7/2010 Thevenot
7,758,211 B2 7/2010 Zheng et al.
D621,988 S 8/2010 Zheng
7,771,087 B2 8/2010 Wilcox et al.
7,794,116 B2 9/2010 Shuai et al.
D626,264 S 10/2010 Liu
7,828,465 B2 11/2010 Roberge et al.
D630,790 S 1/2011 Josefowicz
D634,873 S 3/2011 Guercio
D634,874 S 3/2011 Yamada
D636,514 S 4/2011 Ruud
D636,920 S 4/2011 Boissevain
D638,566 S 5/2011 Goelz
7,938,558 B2 5/2011 Wilcox et al.
7,952,262 B2 5/2011 Wilcox et al.
D641,908 S 7/2011 McKee
7,976,199 B2 7/2011 Berns et al.
D645,601 S 9/2011 Bacon
8,021,026 B2 9/2011 Liu et al.
D649,694 S 11/2011 Kong
8,057,078 B1 11/2011 Ko
8,061,869 B2 11/2011 Lo
8,067,778 B2 11/2011 Bae et al.
8,070,306 B2 * 12/2011 Ruud ..... F21S 2/005 362/101
8,092,042 B2 1/2012 Wilcox
8,092,049 B2 * 1/2012 Kinnune ..... F21V 15/015 362/218
8,104,933 B2 1/2012 Liu et al.
D660,496 S 5/2012 Alkdag
8,267,541 B2 9/2012 Watanabe
D668,370 S 10/2012 Guercio
8,313,221 B2 11/2012 Hsu
8,313,222 B2 * 11/2012 Kinnune ..... F21V 15/015 362/218
8,353,606 B2 1/2013 Jeong
8,382,387 B1 2/2013 Sandovall
D678,579 S 3/2013 Lee
8,393,764 B2 3/2013 Yao
D681,250 S 4/2013 Ruffalo et al.
8,425,071 B2 4/2013 Ruud et al.
8,425,086 B2 4/2013 Chen et al.
D681,869 S 5/2013 Goelz
8,545,065 B2 10/2013 Kim
D694,452 S 11/2013 Goelz
8,622,584 B2 * 1/2014 Kinnune ..... F21V 15/015 362/218
8,925,884 B2 1/2015 Schultz
9,028,087 B2 * 5/2015 Wilcox ..... F21V 15/011 362/101
9,039,223 B2 * 5/2015 Rudd ..... F21S 2/005 362/101
9,039,241 B2 * 5/2015 Kinnune ..... 362/218

(56) References Cited

U.S. PATENT DOCUMENTS

| | | | | |
|---|---|---|---|---|
| 9,222,632 | B2 * | 12/2015 | Kinnune | F21S 8/086 |
| 9,243,794 | B2 * | 1/2016 | Wilcox | F21V 29/2293 |
| 9,255,705 | B2 * | 2/2016 | Wilcox | F21V 15/013 |
| 9,261,270 | B2 * | 2/2016 | Ruud | F21S 2/005 |
| 9,261,271 | B2 * | 2/2016 | Kinnune | F21V 15/013 |
| 2002/0070386 | A1 | 6/2002 | Krames et al. | |
| 2002/0131275 | A1 | 9/2002 | Yamamoto | |
| 2002/0171087 | A1 | 11/2002 | Krames et al. | |
| 2003/0048608 | A1 | 3/2003 | Crocker et al. | |
| 2003/0189829 | A1 | 10/2003 | Shimizu et al. | |
| 2004/0036629 | A1 | 2/2004 | Jones et al. | |
| 2004/0052077 | A1 | 3/2004 | Shih | |
| 2004/0095773 | A1 | 5/2004 | Gaskins | |
| 2004/0156209 | A1 | 8/2004 | Ishida | |
| 2004/0161338 | A1 | 8/2004 | Hsieh | |
| 2004/0174651 | A1 | 9/2004 | Aisenbrey | |
| 2004/0175189 | A1 | 9/2004 | Weber-Rabsilber et al. | |
| 2004/0212291 | A1 | 10/2004 | Keuper | |
| 2004/0213016 | A1 | 10/2004 | Rice | |
| 2004/0222516 | A1 | 11/2004 | Lin et al. | |
| 2004/0251469 | A1 | 12/2004 | Yatsuda et al. | |
| 2004/0257006 | A1 | 12/2004 | Beeman et al. | |
| 2004/0257808 | A1 | 12/2004 | Bjornson et al. | |
| 2004/0264195 | A1 | 12/2004 | Chang et al. | |
| 2005/0023545 | A1 | 2/2005 | Camras et al. | |
| 2005/0052378 | A1 | 3/2005 | Hacker | |
| 2005/0057939 | A1 | 3/2005 | Mizuyoshi | |
| 2005/0068765 | A1 | 3/2005 | Ertze Encinas et al. | |
| 2005/0072558 | A1 | 4/2005 | Whitney et al. | |
| 2005/0128752 | A1 | 6/2005 | Ewington et al. | |
| 2005/0135093 | A1 | 6/2005 | Alexanderson et al. | |
| 2005/0174762 | A1 | 8/2005 | Fogerlie | |
| 2005/0190562 | A1 | 9/2005 | Keuper et al. | |
| 2005/0213328 | A1 | 9/2005 | Matheson | |
| 2005/0224826 | A1 | 10/2005 | Keuper et al. | |
| 2005/0258446 | A1 | 11/2005 | Raos et al. | |
| 2005/0265035 | A1 | 12/2005 | Braa | |
| 2005/0274959 | A1 | 12/2005 | Kim et al. | |
| 2005/0281033 | A1 | 12/2005 | Coushaine et al. | |
| 2006/0018099 | A1 | 1/2006 | Chen | |
| 2006/0056169 | A1 | 3/2006 | Lodhie et al. | |
| 2006/0061967 | A1 | 3/2006 | Kim et al. | |
| 2006/0097385 | A1 | 5/2006 | Negley | |
| 2006/0105482 | A1 | 5/2006 | Alferink et al. | |
| 2006/0131757 | A1 | 6/2006 | Yu et al. | |
| 2006/0138645 | A1 | 6/2006 | Ng et al. | |
| 2006/0138951 | A1 | 6/2006 | Tain et al. | |
| 2006/0141851 | A1 | 6/2006 | Matsui et al. | |
| 2006/0146531 | A1 | 7/2006 | Reo et al. | |
| 2006/0158080 | A1 | 7/2006 | Nakano et al. | |
| 2006/0169878 | A1 | 8/2006 | Kasano et al. | |
| 2006/0175626 | A1 | 8/2006 | Wall, Jr. | |
| 2006/0176686 | A1 | 8/2006 | McVicker | |
| 2006/0181878 | A1 | 8/2006 | Burkholder | |
| 2006/0187671 | A1 | 8/2006 | Coushaine et al. | |
| 2006/0193139 | A1 | 8/2006 | Sun et al. | |
| 2006/0250803 | A1 | 11/2006 | Chen | |
| 2007/0019415 | A1 | 1/2007 | Leblanc et al. | |
| 2007/0070625 | A1 | 3/2007 | Bang | |
| 2007/0086196 | A1 | 4/2007 | Wong | |
| 2007/0097684 | A1 | 5/2007 | Obara et al. | |
| 2007/0098334 | A1 | 5/2007 | Chen | |
| 2007/0115666 | A1 | 5/2007 | Thomas et al. | |
| 2007/0159827 | A1 | 7/2007 | Huang | |
| 2007/0258214 | A1 | 11/2007 | Shen | |
| 2008/0002399 | A1 | 1/2008 | Villard et al. | |
| 2008/0019129 | A1 | 1/2008 | Wang | |
| 2008/0037239 | A1 | 2/2008 | Thomas et al. | |
| 2008/0043473 | A1 | 2/2008 | Matsui | |
| 2008/0043479 | A1 | 2/2008 | Wang | |
| 2008/0055908 | A1 | 3/2008 | Wu et al. | |
| 2008/0068799 | A1 | 3/2008 | Chan | |
| 2008/0080162 | A1 | 4/2008 | Wilcox et al. | |
| 2008/0080188 | A1 | 4/2008 | Wang | |
| 2008/0080189 | A1 | 4/2008 | Wang | |
| 2008/0080196 | A1 | 4/2008 | Ruud et al. | |
| 2008/0089071 | A1 | 4/2008 | Wang | |
| 2008/0212324 | A1 | 9/2008 | Lin | |
| 2009/0034257 | A1 | 2/2009 | Liu | |
| 2009/0034261 | A1 | 2/2009 | Grove | |
| 2009/0180281 | A1 | 7/2009 | Ahland, III et al. | |
| 2009/0244895 | A1 | 10/2009 | Chen | |
| 2009/0251898 | A1 | 10/2009 | Kinnune et al. | |
| 2009/0268477 | A1 | 10/2009 | Zheng et al. | |
| 2009/0296403 | A1 | 12/2009 | Zhang et al. | |
| 2010/0026158 | A1 | 2/2010 | Wu | |
| 2010/0039013 | A1 | 2/2010 | Tsai | |
| 2010/0046223 | A1 | 2/2010 | Li et al. | |
| 2010/0080004 | A1 | 4/2010 | Zhang | |
| 2010/0097815 | A1 | 4/2010 | Song | |
| 2010/0149809 | A1 | 6/2010 | Ruud et al. | |
| 2010/0195323 | A1 | 8/2010 | Schaefer et al. | |
| 2010/0238671 | A1 | 9/2010 | Catone et al. | |
| 2010/0296287 | A1 | 11/2010 | Huang | |
| 2010/0314985 | A1 | 12/2010 | Premysler | |
| 2011/0004157 | A1 | 1/2011 | Dewaele | |
| 2011/0013397 | A1 | 1/2011 | Catone et al. | |
| 2011/0089830 | A1 | 4/2011 | Pickard et al. | |
| 2011/0095690 | A1 | 4/2011 | Sagal | |
| 2011/0188233 | A1 | 8/2011 | Josefowicz et al. | |
| 2011/0222284 | A1 | 9/2011 | Kong et al. | |
| 2011/0299280 | A1 | 12/2011 | Maeers | |
| 2011/0310603 | A1 | 12/2011 | Simons | |
| 2012/0025711 | A1 | 2/2012 | Best et al. | |
| 2012/0057351 | A1 | 3/2012 | Wilcox et al. | |
| 2012/0099317 | A1 | 4/2012 | Liu | |
| 2012/0099319 | A1 | 4/2012 | Liu | |
| 2012/0113634 | A1 | 5/2012 | Wong | |
| 2012/0162987 | A1 | 6/2012 | Liu | |
| 2012/0281404 | A1 | 11/2012 | Wilcox et al. | |
| 2012/0307496 | A1 | 12/2012 | Phillips, III et al. | |
| 2013/0083522 | A1 | 4/2013 | Bowers | |
| 2013/0250574 | A1 | 9/2013 | Moriyama | |
| 2013/0301274 | A1 | 11/2013 | Anderson | |
| 2013/0322068 | A1 | 12/2013 | Clark | |
| 2013/0322070 | A1 | 12/2013 | Clark | |
| 2014/0049961 | A1 | 2/2014 | Wilcox et al. | |
| 2015/0267908 | A1 | 9/2015 | Smith | |

FOREIGN PATENT DOCUMENTS

| | | | |
|---|---|---|---|
| CN | 101093073 | A | 12/2007 |
| CN | 101101102 | A | 1/2008 |
| CN | 101101103 | A | 1/2008 |
| CN | 101101104 | A | 1/2008 |
| CN | 101101106 | A | 1/2008 |
| CN | 101101107 | A | 1/2008 |
| CN | 101105268 | A | 1/2008 |
| CN | 101105278 | A | 1/2008 |
| DE | 9417326 | U1 | 2/1995 |
| DE | 10110835 | A1 | 3/2001 |
| DE | 202006015981 | U1 | 10/2006 |
| DE | 2020006010949 | U1 | 10/2006 |
| EP | 1431653 | A2 | 6/2004 |
| EP | 1760393 | A1 | 3/2007 |
| EP | 1906081 | A1 | 4/2008 |
| FR | 2818786 | A1 | 6/2002 |
| GB | 2201042 | A | 8/1988 |
| JP | 59229844 | A | 12/1984 |
| JP | 10268800 | A | 10/1998 |
| JP | 2000183406 | A | 6/2000 |
| JP | 2005109228 | | 4/2005 |
| JP | 2007134190 | | 5/2007 |
| NL | 1026514 | | 6/2004 |
| WO | WO9833007 | A1 | 7/1998 |
| WO | WO9957945 | A1 | 11/1999 |
| WO | WO0125683 | A1 | 12/2001 |
| WO | WO0216826 | A1 | 2/2002 |
| WO | WO03089841 | A1 | 10/2003 |
| WO | WO2004079256 | A1 | 9/2004 |
| WO | WO2006049086 | A1 | 5/2006 |

(56) References Cited

FOREIGN PATENT DOCUMENTS

| | | |
|---|---|---|
| WO | WO2006060905 A1 | 6/2006 |
| WO | WO2007000037 A1 | 1/2007 |

OTHER PUBLICATIONS

Kramer Lighting, Sturtevant, WI. Excerpts from Kramer Lighting brochure. Quartz Cylinder Downlight specification. Copyright 2010.
Kramer Lighting, Sturtevant, WI. Excerpts from Kramer Lighting brochure. Metal Halide Cylinder Downlightt specification. Copyright 2010.
Affineon Lighting, Coral Springs, FL. Excerpts from Affineon Lighting. DL Downlight specification. Copyright 2009.
Affineon Lighting, Coral Springs, FL. Excerpts from Affineon Lighting. DLM Mini Downlight specification. Copyright 2008.
Philips Lumec, Roadstar Series brochure. Date: 2009. 26 pages. Philips Group, Lumec Head Office, 640 Cure-Boivin Boulevard, Boisbriand, Quebec, Canada J7G 2A7.
Philips Lumec, Roadstar Luminaire brochure. 43 pages.
Philips Roadway Lighting. Product Brochure. Date: Copyright 2010. 12 pages.
Light News. Date: Nov. 2010. 8 pages. Electron AG, Bereich Lichttechnik, Riedhofstrasse 11, CH-8804 Au ZH.
Tarricone, Paul. "Coming Soon to Broadway." www.jesna.org. Date: Feb. 2005.
Excerpt from www.ledsmagazine.com. "LED design wins New York city streetlight competition." Date: Dec. 2004.
"Professional Lighting Design." No. 40. Date: Nov./Dec. 2005.
The Lighting Journal. "LED Street Lighting." Date: Jul./Aug. 2006.
Excerpt from enLux Lighting. www.enluxled.com. "enLux 6K Series LED Outdoor Area Light." Date: undated.
Excerpt from enLux Lighting. www.enluxled.com. "enLux 6K Series LED Theatrical Area Light." Date: undated.
Excerpt from enLux Lighting. www.enluxled.com. "enLux 1K LED Light Bar Module." Date: undated.
Alpha One GmbH. "Falcon flood-LED." Date: undated.
Alpha One GmbH. "Savi Architectural LED Lighting" technical specification. Date: undated.
Excerpt from Supervision International website. www.svision.com. "SaVi SHO." Date: Copyright 2006.
Excerpt from Supervision International website. www.svision.com. "SaVi SHO" technical specification. Date: undated.
Leotek brochure. "LED Outdoor Luminaire & Light Fixtures." Date: undated.
In Reexamination of U.S. Pat. No. 8,070,306, PTO Action. Date: May 7, 2012.
In Reexamination of U.S. Pat. No. 8,070,306, response and supporting documents to May 7, 2012 PTO Action. Date: Jul. 9, 2012.
Images from Cooper Lighting's Motion for Leave. Date: 2004.
Images from Cooper Lighting's Motion for Leave. Date: 2005.
Images from Cooper Lighting's Motion for Leave. Date: 2006.
Future Lighting Solutions brochure. "The 6 Steps to LED Lighting Success." 6 pages. Date: undated.
Excerpt from Aavid Thermalloy (www.aavidthermalloy.com). "LED Light Sources." 1 page. Date: Copyright 2006.
Aavid Thermal Technologies, Inc. article. "How to Select a Heat Sink." 5 pages. Date: undated.
Excerpt from Mouser Electronics (www.mouser.com). Product List. 1 page. Date: Aug. 16, 2006.
Excerpt from Lumileds Future Electronics (www.lumiledsfuture.com). "Thermal Solutions." 1 page. Date: Jul. 14, 2006.
Excerpt from National Northeast Corporation brochure. "Miscellaneous Shape Heat Sinks." 2 pages. Date: undated.
Excerpt from Aavid Thermalloy (www.aavidthermalloy.com). Part Specification. 3 pages. Date: Copyright 2006.
Excerpt from Therma-Flo brochure. 8 pages. Date: Copyright 2002.
Excerpt from Aavid Thermalloy (www.aavidthermalloy.com). "Product Offerings." 2 pages. Date: Copyright 2006.
Excerpt from ThermaFlo (www.thermaflow.com). "Bonded Fin Heat Sinks." 1 page. Date: Aug. 24, 2006.
Excerpt from ThermaFlo (www.thermaflow.com). "Folded Fin Heat Sinks." 2 pages. Date: Aug. 24, 2006.
Excerpt from ThermaFlo (www.thermaflow.com). "High Power Heat Sinks." 2 pages. Date: Aug. 24, 2006.
National Northwest Corporation brochure. "Flat Back Shape Heat Sinks III." 12 pages. Date: undated.
Excerpt from Wakefield Thermal Solutions (www.wakefield.com). "Thermal Extrusions." 1 page. Date: Aug. 16, 2006.
Wakefield Thermal Solutions brochure. "Quality Aluminum Extrusion and Fabrication." 4 pages. Date: undated.
Stanley Electric co., Ltd. "Stanley LED for Street Light Brochure." 8 pages. date: Aug. 2006.

* cited by examiner

FIG. 59
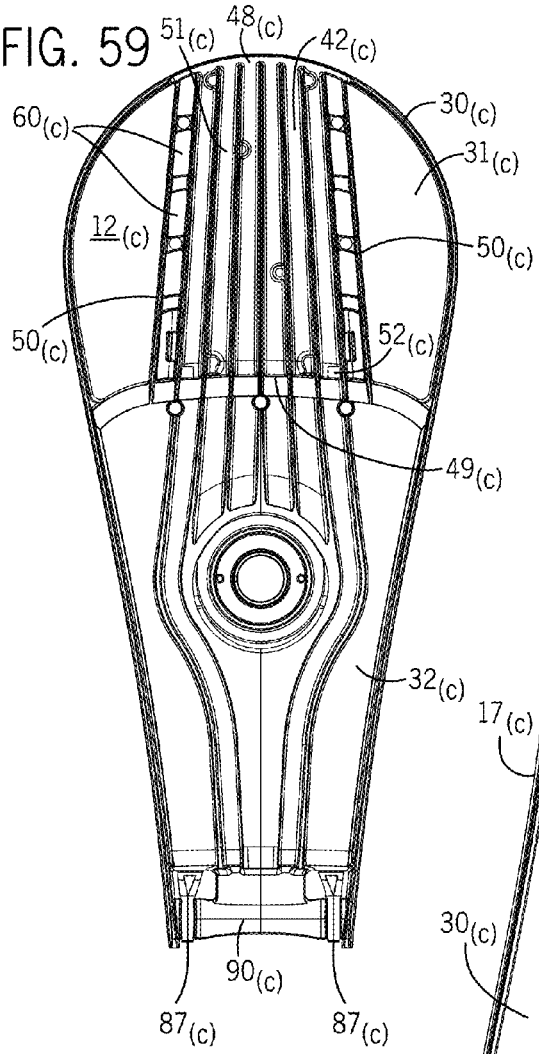
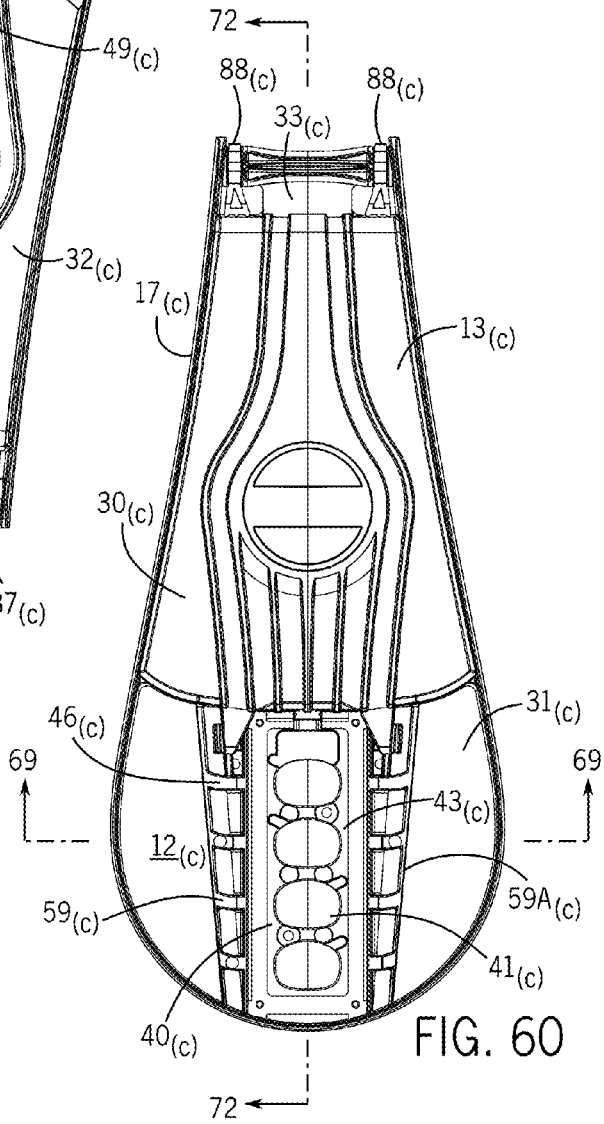
FIG. 60

LED LIGHT FIXTURE

RELATED APPLICATION

This application is a continuation-in-part of patent application Ser. No. 14/708,558, filed May 11, 2015, now U.S. Pat. No. 9,261,270, issued Feb. 16, 2016, which is a continuation of patent application Ser. No. 13/834,525, filed Mar. 15, 2013, now U.S. Pat. No. 9,039,223, issued May 26, 2015, which is a continuation of patent application Ser. No. 13/294,459, filed Nov. 11, 2011, now U.S. Pat. No. 8,425,071, issued Apr. 23, 2013, which is a continuation of patent application Ser. No. 12/629,986, filed Dec. 3, 2009, now U.S. Pat. No. 8,070,306, issued Dec. 6, 2011, which is a continuation of patent application Ser. No. 11/860,887, filed Sep. 25, 2007, now U.S. Pat. No. 7,686,469, issued Mar. 30, 2010, which is a continuation-in-part of now abandoned patent application Ser. No. 11/541,908, filed Sep. 30, 2006. This application is also a continuation-in-part of patent application Ser. No. 14/708,422, filed May 11, 2015, now U.S. Pat. No. 9,255,705, issued Feb. 9, 2016, which is a continuation of patent application Ser. No. 14/246,776, filed on Apr. 7, 2014, now U.S. Pat. No. 9,028,087, issued May 12, 2015, which is a continuation-in-part of patent application Ser. Nos. 13/764,743, 13/764,736 and 13/764,746, each filed Feb. 11, 2013, now respective U.S. Pat. No. 9,243,794, issued Jan. 26, 2016, U.S. Pat. No. 9,222,632, issued Dec. 29, 2015, and U.S. Pat. No. 9,212,812, issued Dec. 15, 2015. Patent application Ser. Nos. 13/764,743 and 13/764,736 are each a continuation-in-part of patent application Ser. No. 29/444,511, filed Jan. 31, 2013, now Patent No. D718,482, issued Nov. 25, 2014. And, patent application Ser. No. 14/246,776 is also a continuation-in-part of patent application Ser. No. 13/839,922, filed Mar. 15, 2013, which is based on U.S. Provisional Application Ser. No. 61/624,211, filed Apr. 13, 2012. This application is also a continuation-in-part of patent application Ser. No. 14/719,359, filed May 22, 2015, now U.S. Pat. No. 9,261,271, issued Feb. 16, 2016, which is a continuation of patent application Ser. No. 14/087,971, filed Nov. 22, 2013, now U.S. Pat. No. 9,039,241, issued May 26, 2015, which in turn is a continuation of patent application Ser. No. 13/680,481, filed Nov. 19, 2012, now U.S. Pat. No. 8,622,584, issued Jan. 7, 2014, which in turn is a continuation of patent application Ser. No. 13/333,198, filed Dec. 21, 2011, now U.S. Pat. No. 8,313,222, issued Nov. 20, 2012, which in turn is a continuation of patent application Ser. No. 12/418,364, filed Apr. 3, 2009, now U.S. Pat. No. 8,092,049, issued Jan. 10, 2012, which in turn is based in part on U.S. Provisional Application Ser. No. 61/042,690, filed Apr. 4, 2008.

The contents of each of application Ser. Nos. 14/708,558, 14/708,422, 14/719,359, 14/246,776, 14/087,971, 13/764,743, 13/834,525, 13/294,459, 12/629,986, 11/860,887, 11/541,908, 13/764,736, 13/764,746, 13/839,922, 61/624,211, 13/680,481, 13/333,198, 12/418,364, 29/444,511 and 61/042,690 are incorporated herein by reference in their entirety.

FIELD OF THE INVENTION

This invention relates to light fixtures and, more particularly, to light fixtures using light-emitting diodes (LEDs).

BACKGROUND OF THE INVENTION

In recent years, the use of light-emitting diodes (LEDs) in the development of light fixtures for various common lighting purposes has increased, and this trend has accelerated as advances have been made in the field. Indeed, lighting applications which previously had typically been served by fixtures using what are known as high-intensity discharge (HID) lamps are now being served by LED light fixtures. Such lighting applications include, among a good many others, roadway lighting, factory lighting, parking lot lighting, and commercial building lighting.

High-luminance light fixtures using LED modules as a light source present particularly challenging problems. One particularly challenging problem for high-luminance LED light fixtures relates to heat dissipation. It is of importance for various reasons, one of which relates to extending the useful life of the lighting products. Achieving improvements without expensive additional structure is much desired.

In summary, finding ways to significantly improve the dissipation of heat to the atmosphere from LED light fixtures would be much desired, particularly in a fixture that is easy and inexpensive to manufacture.

SUMMARY OF THE INVENTION

The present invention relates to improved LED light fixtures. In certain embodiments, the inventive LED light fixture includes a housing portion and a base extending from the housing portion. The housing portion forms a chamber enclosing at least one driver. The base supports at least one LED illuminator outside the chamber. The housing portion and the base define an open space therebetween permitting air/water-flow therethrough.

In certain embodiments, the housing portion and the base are each formed as part of a one piece comprising at least one frame member supporting the base with respect to the housing portion. In some of such embodiments, the one piece includes forward and rearward regions.

In some examples, the rearward region includes the chamber and a rearmost portion adapted for securement to a support member. The base may be within the forward region which defines the open space along at least three sides of the base.

The at least one LED illuminator is in thermal contact with an illuminator-supporting region of the base. In particular embodiments, the at least one LED illuminator has an optical member disposed over at least one LED emitter.

The optical member may be configured for directing emitter light predominantly forward. In some of such embodiments, a rearward shield member extends downwardly at the rearward side of the base. The rearward shield member may extend lower than a lowermost outer-surface portion of the optical member to block rearward illumination therefrom.

In certain embodiments, the base may be a separate structure secured with respect to the housing. The open space may be along at least three sides of the base.

Some examples of the base include a pair of extruded side portions each forming a channel along the base. In certain of such embodiments, the side portions and the base are of a single-piece extrusion secured with respect to the housing. In certain examples of such embodiments, the single-piece extrusion has an illuminator-supporting region.

In some embodiments, the at least one LED illuminator comprises a plurality of LED modules. In certain embodiments, the plurality of LED modules are in thermal contact with the illuminator-supporting region of the single-piece extrusion.

The LED-array modules may be substantially rectangular having predetermined module-lengths. The illuminator-supporting region may have a length which is selected from one module-length and a multiple thereof. In some of such embodiments, at least one of the plurality of modules has a module-length different than the module-length of at least another of the plurality of modules.

Some examples of the base include a plurality of extruded heat sinks. In certain of such examples, the at least one LED illuminator has a plurality of LED modules each in thermal contact with a respective one of the extruded heat sinks. Sometimes, each heat sink supports one of the LED modules such that the number of the modules equals to the number of the heat sinks.

Some embodiments include at least one wall extending within the open space and open for air/water-flow along at least two sides thereof. The at least one wall sometimes extends within the open space substantially along the base. In some examples, the at least one wall divides the open space into an illuminator-adjacent flow region and a chamber-adjacent flow region.

The term "ambient fluid" as used herein means air and/or water around and coming into contact with the light fixture.

The term "projected," as used with respect to various portion and areas of the fixture, refers to such portions and areas of the fixture in plan views.

As used herein in referring to portions of the devices of this invention, the terms "upward," "upwardly," "upper," "downward," "downwardly," "lower," "upper," "top," "bottom" and other like terms assume that the light fixture is in its usual position of use.

In descriptions of this invention, including in the claims below, the terms "comprising," "including" and "having" (each in their various forms) and the term "with" are each to be understood as being open-ended, rather than limiting, terms.

BRIEF DESCRIPTION OF THE DRAWINGS

FIG. 16 shows a version of such LED light fixture including LED-array modules with ten LEDs thereon.

FIG. 18 shows a version of such LED light fixture including LED-array modules with twenty LEDs thereon.

FIG. 59 is a top plan view of the LED light fixture of FIG. 57.

FIG. 60 is a bottom plan view of the LED light fixture of FIG. 57.

FIGS. 94A-96A are bottom plan views of yet other alternative embodiments of the invention.

DETAILED DESCRIPTION OF EXEMPLARY EMBODIMENTS

Figure 1:
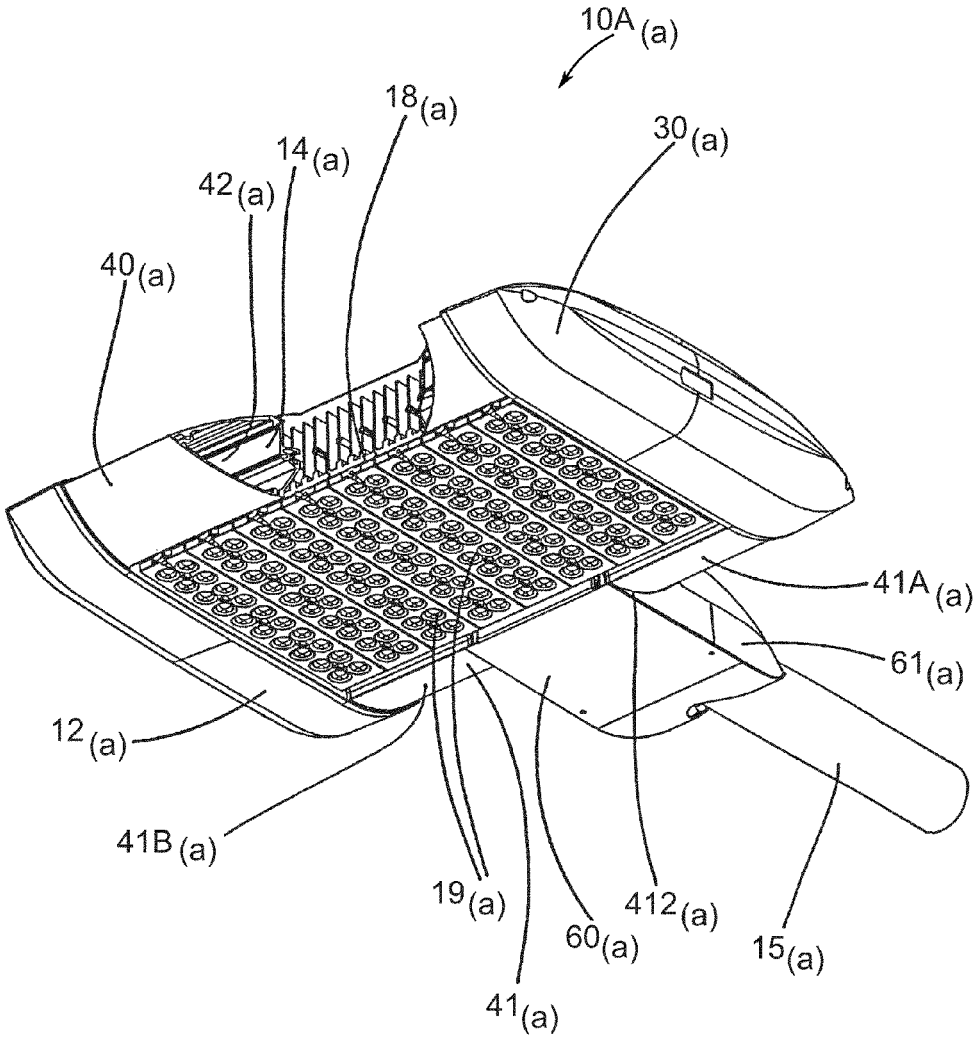
FIG. 1 is a perspective view of a preferred LED lighting fixture in accordance with this invention, including a cut-away portion showing an LED assembly.

The figures illustrate exemplary embodiments of LED light fixtures in accordance with this invention.

FIGS. 1-15 illustrate exemplary LED lighting fixtures 10A$_{(a)}$-10D$_{(a)}$ in accordance with this invention. Common or similar parts are given the same numbers in the drawings of both embodiments, and the lighting fixtures are often referred to by the numeral 10$_{(a)}$, without the A or D lettering used in the drawings, and in the singular for convenience.

Lighting fixture 10$_{(a)}$ includes a housing 12$_{(a)}$ that forms a substantially air/water-tight chamber 14$_{(a)}$, at least one electronic LED driver 16$_{(a)}$ enclosed within chamber 14$_{(a)}$ and an LED assembly 18$_{(a)}$ secured with respect to housing 12$_{(a)}$ adjacent thereto in non-air/water-tight condition. LED assembly 18$_{(a)}$ has a plurality of LED-array modules 19$_{(a)}$ each secured to an LED heat sink 20$_{(a)}$.

Figure 7:
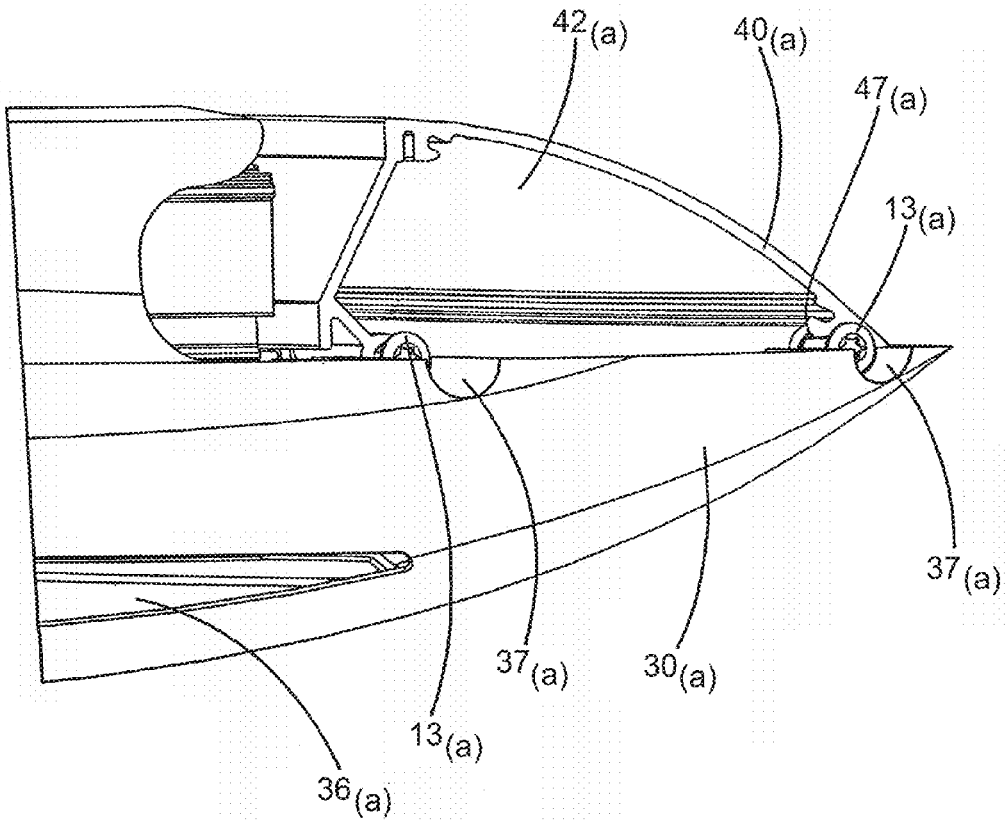
FIG. 7 is another fragmentary perspective view showing the frame structure partially cut away to illustrate its being bolted together with the border structure.
Figure 8:
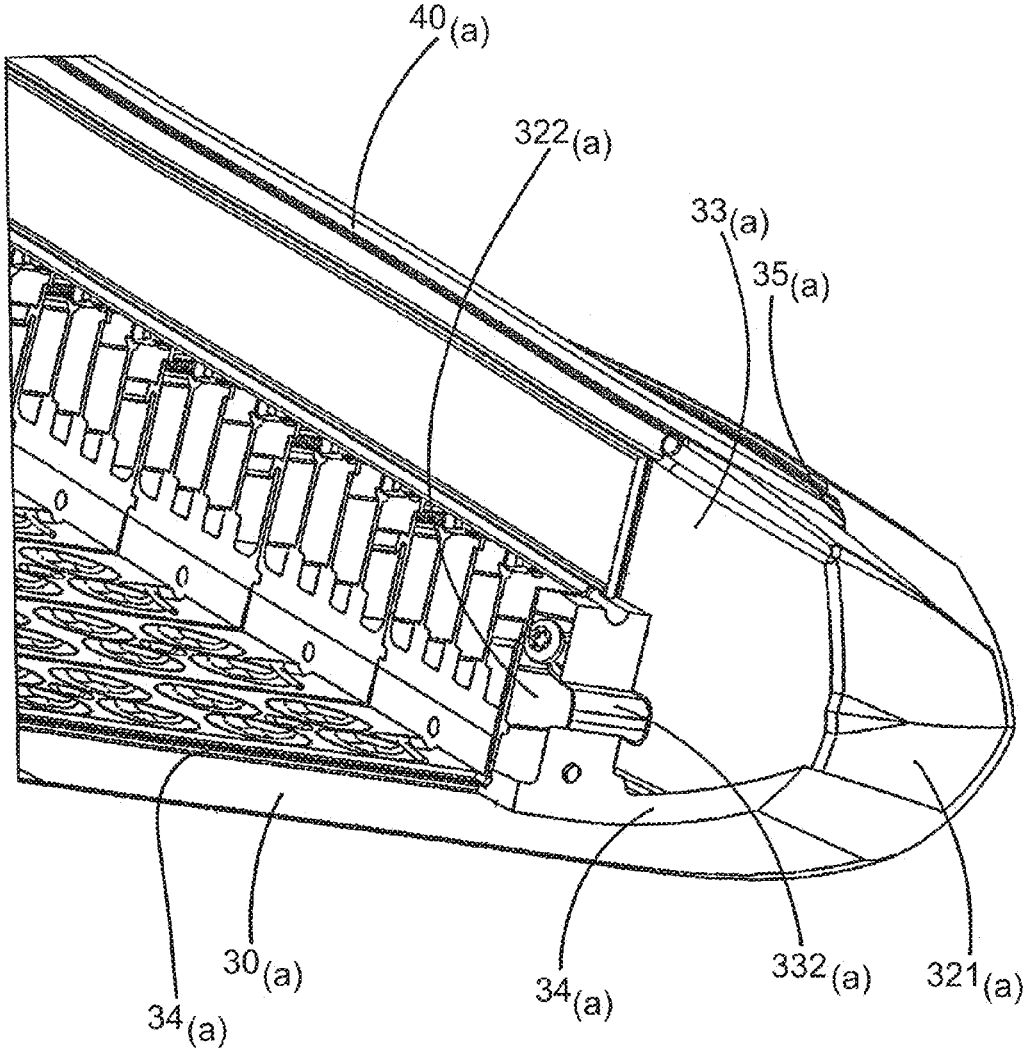
FIG. 8 is another fragmentary perspective view showing the border structure partially cut-away to illustrate its engagement with the frame structure.

As seen in FIGS. 1-4, 7 and 8, housing 12$_{(a)}$ includes a frame structure 30$_{(a)}$ forming a frame-portion 32$_{(a)}$ of chamber 14$_{(a)}$ with an opening edge 34$_{(a)}$ thereabout and a border structure 40$_{(a)}$ (sometimes referred to as a nose structure 40$_{(a)}$) secured to frame structure 30$_{(a)}$ and forming a border-portion 42$_{(a)}$ (sometimes referred to as nose-portion 42$_{(a)}$) of chamber 14$_{(a)}$. As best seen in FIG. 8, opening edge 34$_{(a)}$ of frame-portion 30$_{(a)}$ of chamber 14$_{(a)}$ includes a groove 35$_{(a)}$ configured for mating air/water-tight engagement with border structure 40$_{(a)}$. Border structure 40$_{(a)}$ is an extrusion, preferably of aluminum. FIG. 5 shows electronic LED drivers 16$_{(a)}$ enclosed in frame-portion 32$_{(a)}$ of chamber 14$_{(a)}$.

Figure 6:
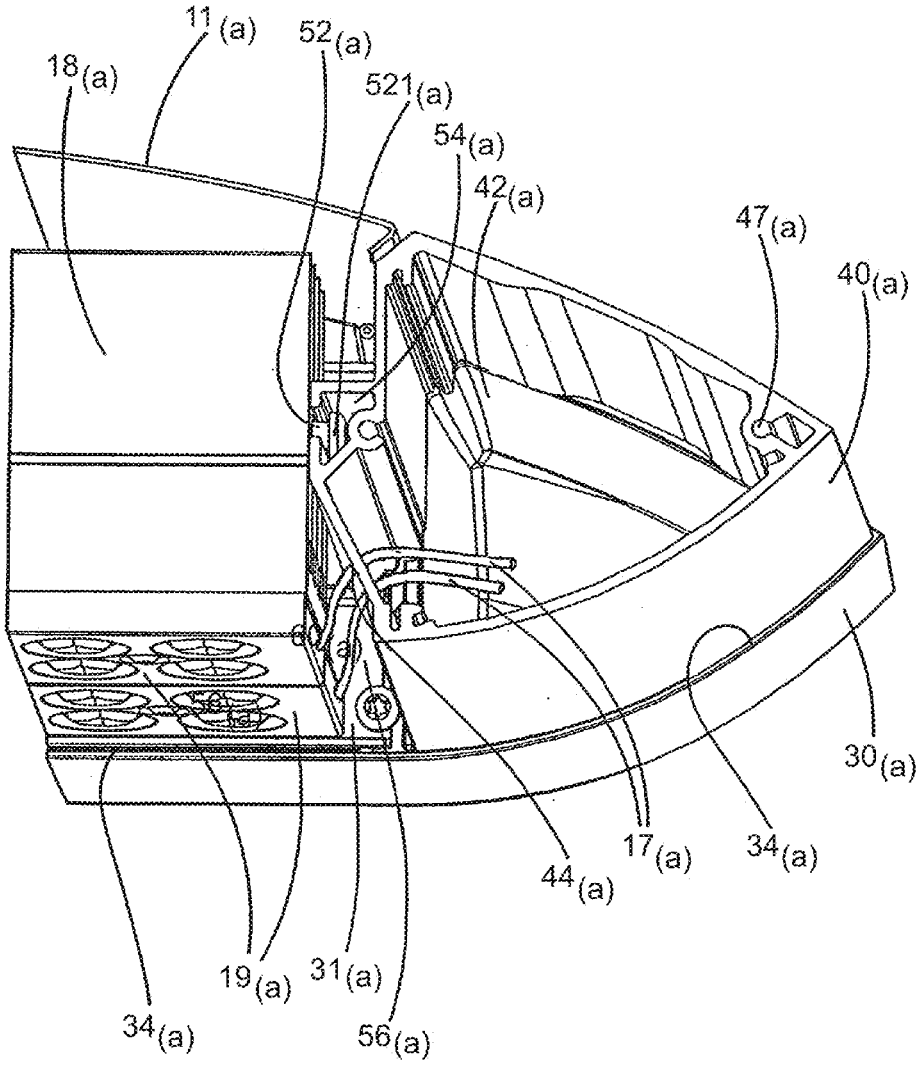
FIG. 6 is a fragmentary view of the right portion of FIG. 4.

As best seen in FIG. 6, border structure 40$_{(a)}$ includes substantially air/water-tight wire-accesses 44$_{(a)}$ for passage of wires 17$_{(a)}$ between LED assembly 18$_{(a)}$ and water/air-tight chamber 14$_{(a)}$.

FIGS. 2, 3, 5 and 7 show that frame structure 30$_{(a)}$ includes a vent 36$_{(a)}$ permitting air flow to and from LED assembly 18$_{(a)}$. Vent 36$_{(a)}$ facilitates cooling of LED assembly 18$_{(a)}$.

As best illustrated in FIGS. 6 and 7, border structure 40$_{(a)}$ has bolt-receiving border-hole 47$_{(a)}$ therethrough which is isolated from border-portion 42$_{(a)}$ of chamber 14$_{(a)}$. And, frame structure 30$_{(a)}$ has bolt-receiving frame-holes 37$_{(a)}$ therethrough which are isolated from frame-portion 32$_{(a)}$ of chamber 14$_{(a)}$; frame-hole 37$_{(a)}$ is aligned with a respective border-hole 47$_{(a)}$. A bolt 13$_{(a)}$ passes through aligned pair of bolt-receiving holes 37$_{(a)}$ and 47$_{(a)}$ such that border structure 40$_{(a)}$ and frame structure 30$_{(a)}$ are bolted together while maintaining the air/water-tight condition of chamber 14$_{(a)}$.

Figure 3:
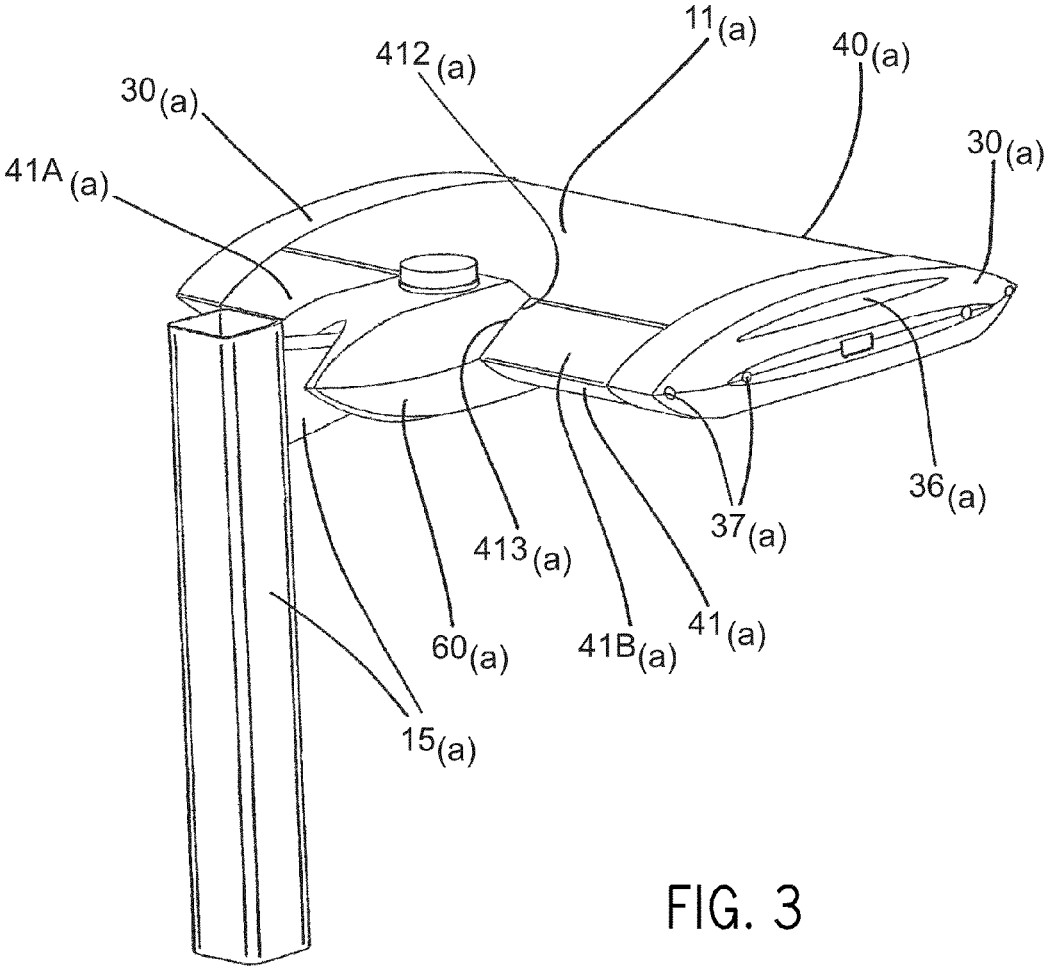
FIG. 3 is a perspective view of another LED lighting fixture including a pole-mounting assembly on a pole of square cross-section.

FIGS. 1 and 3 best illustrate certain highly preferred embodiments of this invention in which housing 12$_{(a)}$ is a perimetrical structure which includes a pair of opposed frame structures 30$_{(a)}$ and a pair of opposed nose structures 40$_{(a)}$, making perimetrical structure 12$_{(a)}$ of lighting fixture 10A$_{(a)}$ substantially rectangular. FIGS. 1, 4-8 and 11 illustrate aspects of inventive LED lighting fixture 10A$_{(a)}$.

Figure 10:
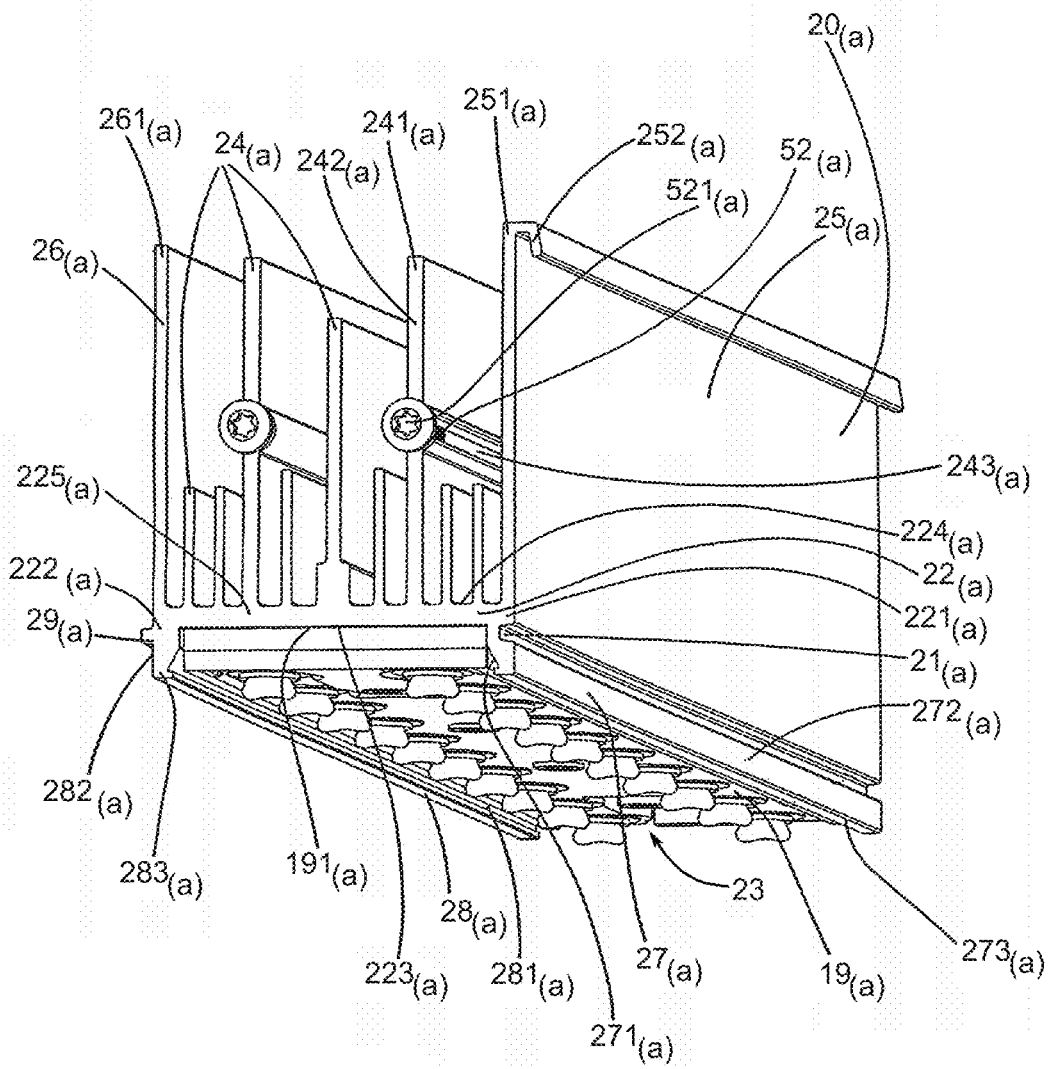
FIG. 10 is a perspective view of one LED-array module LED and its related LED heat sink of the LED assembly of the illustrated LED lighting fixtures.
Figure 11:
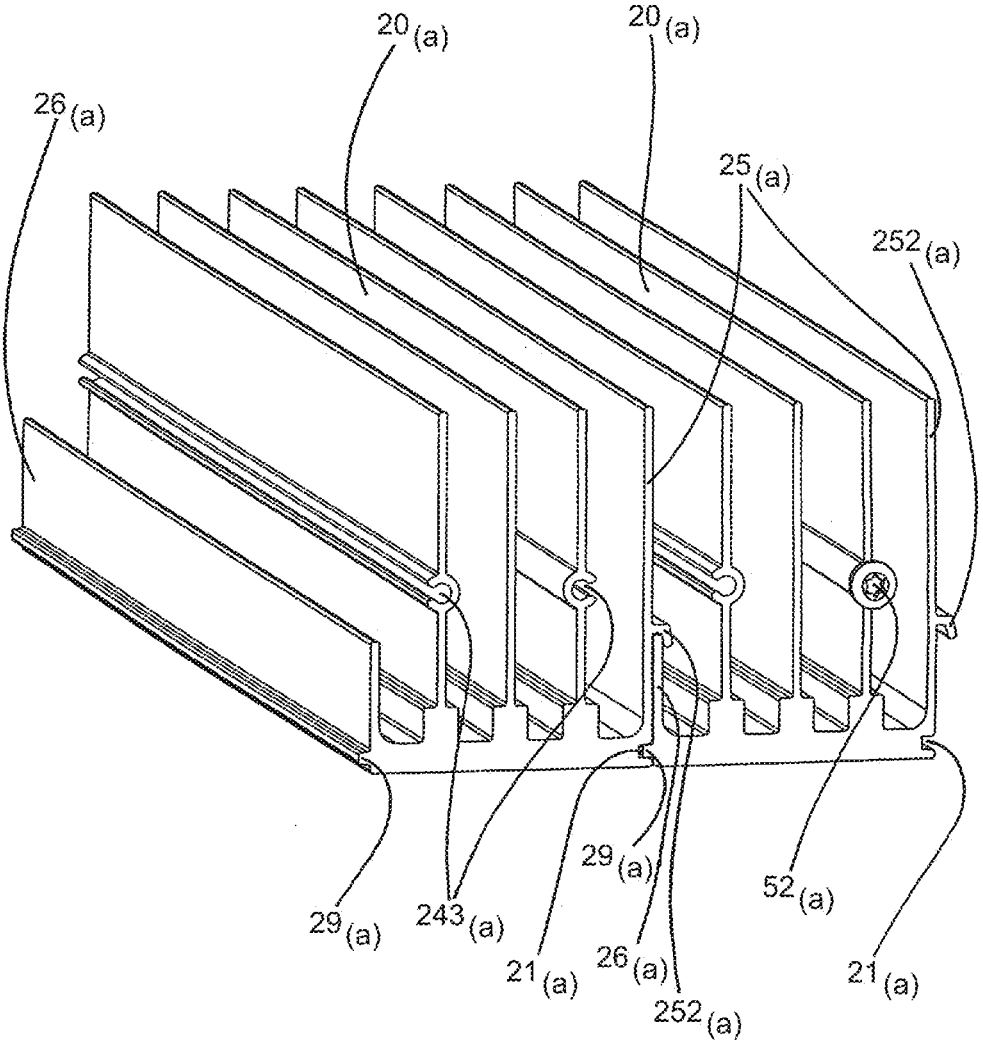
FIG. 11 is a perspective view of two interconnected LED heat sinks of the LED assembly of the illustrated LED lighting fixtures.

In LED lighting fixtures illustrated in FIGS. 1-15, LED assembly 18$_{(a)}$ includes a plurality of LED-array modules 19$_{(a)}$ each separately mounted on its corresponding LED heat sink 20$_{(a)}$, such LED heat sinks 20$_{(a)}$ being interconnected to hold LED-array modules 19$_{(a)}$ in fixed relative positions. Each heat sink 20$_{(a)}$ includes: a base 22$_{(a)}$ with a back base-surface 223$_{(a)}$, an opposite base-surface 224$_{(a)}$, two base-ends 225$_{(a)}$ and first and second base-sides 221$_{(a)}$ and 222$_{(a)}$; a plurality of inner-fins 24$_{(a)}$ protruding from opposite base-surface 224$_{(a)}$; first and second side-fins 25$_{(a)}$ and 26$_{(a)}$ protruding from opposite base-surface 224$_{(a)}$ and terminating at distal fin-edges 251$_{(a)}$ and 261$_{(a)}$, first side-fin 25$_{(a)}$ including a flange hook 252$_{(a)}$ positioned to engage distal fin-edge 261$_{(a)}$ of second side-fin 26$_{(a)}$ of adjacent heat sink 20$_{(a)}$; and first and second lateral supports 27$_{(a)}$ and 28$_{(a)}$ protruding from back base-surface 223$_{(a)}$, lateral supports 27$_{(a)}$ and 28$_{(a)}$ each having inner portions 271$_{(a)}$ and 281$_{(a)}$, respectively, and outer portion 272$_{(a)}$ and 282$_{(a)}$, respectively. Inner portions 271$_{(a)}$ and 281$_{(a)}$ of first and second lateral supports 27$_{(a)}$ and 28$_{(a)}$ have first and second opposed support-ledges 273$_{(a)}$ and 283$_{(a)}$, respectively, that form a heat-sink-passageway 23$_{(a)}$ which slidably supports an LED-array module 19$_{(a)}$ against back base-surface 223$_{(a)}$. First and second supports 27$_{(a)}$ and 28$_{(a)}$ of each heat sink 20$_{(a)}$ are in substantially planar alignment with first and second side-fins 25$_{(a)}$ and 26$_{(a)}$, respectively. As seen in FIGS. 10 and 11, the flange hook is at 251$_{(a)}$ distal fin-edge of first side-fin 25$_{(a)}$.

Each heat sink 20$_{(a)}$ is a metal (preferably aluminum) extrusion with back base-surface 223$_{(a)}$ of heat sink 20$_{(a)}$ being substantially flat to facilitate heat transfer from LED-array module 19$_{(a)}$, which itself has a flat surface 191$_{(a)}$ against back-base surface 223$_{(a)}$. Each heat sink 20$_{(a)}$ also includes a lateral recess 21$_{(a)}$ at first base-side 221$_{(a)}$ and a lateral protrusion 29$_{(a)}$ at second base-side 222$_{(a)}$, recesses 21$_{(a)}$ and protrusions 29$_{(a)}$ being positioned and configured for mating engagement of protrusion 29$_{(a)}$ of one heat sink 20$_{(a)}$ with recess 21$_{(a)}$ of adjacent heat sink 20$_{(a)}$.

As best seen in FIGS. 1, 4, 5, 6, 10 and 11, first and second side-fins 25$_{(a)}$ and 26$_{(a)}$ are each a continuous wall extending along first and second base-sides 221$_{(a)}$ and 222$_{(a)}$, respectively. Inner-fins 24$_{(a)}$ are also each a continuous wall extending along base 22$_{(a)}$. Inner-fins 24$_{(a)}$ are substantially parallel to side-fins 25$_{(a)}$ and 26$_{(a)}$.

Figure 4:
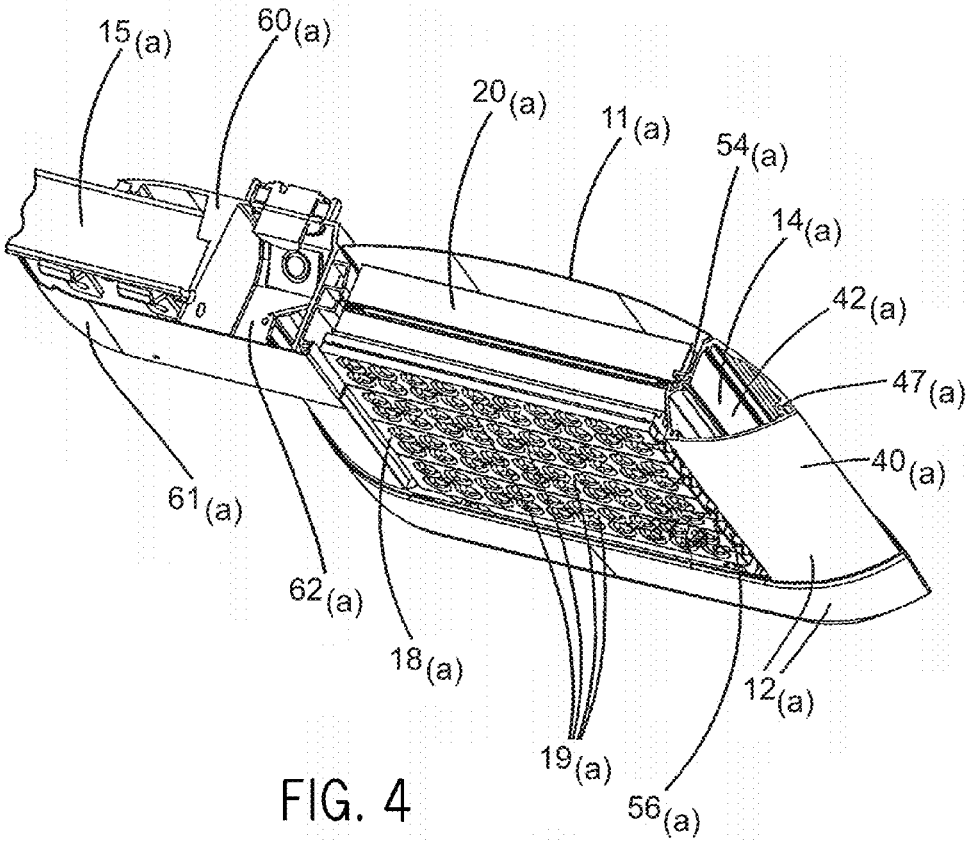
FIG. 4 is a side perspective view of the LED lighting of FIG. 1 broken away at a middle portion to show interior structure.
Figure 5:
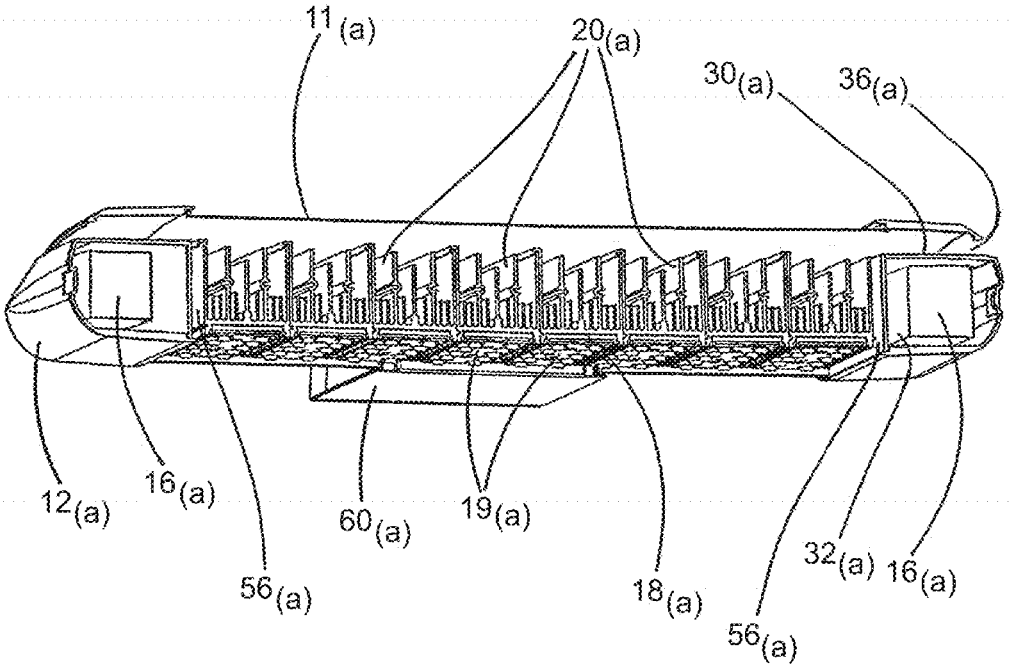
FIG. 5 is a front perspective view of the LED lighting of FIG. 1 broken away at a middle portion to show interior structure.

FIGS. 4 and 6 show an interlock of housing 12$_{(a)}$ to LED assembly 18$_{(a)}$. As best seen in FIGS. 10 and 11, in each heat sink 20$_{(a)}$ inner-fins 24$_{(a)}$ include two middle-fins 241$_{(a)}$ each of which includes a fin-end 242$_{(a)}$ forming a mounting hole 243$_{(a)}$. A coupler 52$_{(a)}$ in the form of a screw is engaged in mounting hole 243$_{(a)}$, and extends from heat sink 20$_{(a)}$ to terminate in a coupler-head 521$_{(a)}$. Housing 12$_{(a)}$ has a slotted cavity 54$_{(a)}$ which extends along, and is integrally formed with, each of border structures 40$_{(a)}$ forms the interlock by receiving and engaging coupler-heads 521$_{(a)}$ therein.

Figure 2:
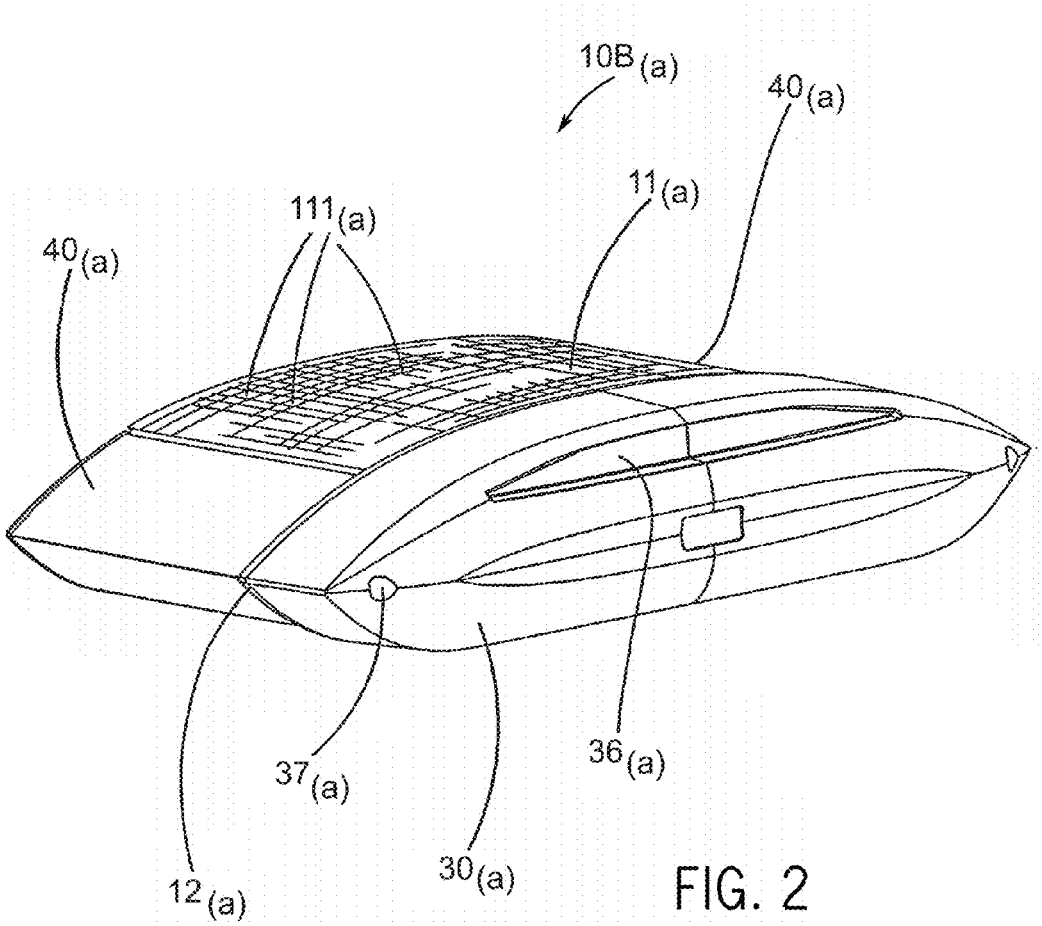
FIG. 2 is a perspective view of the LED lighting fixture configured for wall mounting.

FIG. 2 illustrates a version of the invention which is LED lighting fixture 10B$_{(a)}$. In lighting fixture 10B$_{(a)}$, perimetrical structure 12$_{(a)}$ includes a pair of nose structures 40$_{(a)}$ configured for wall mounting and one frame structure 30$_{(a)}$ in substantially perpendicular relationship to each of the two nose structures 40$_{(a)}$.

The substantially rectangular lighting fixture 10A$_{(a)}$ which is best illustrated in FIGS. 1, 3 and 4, perimetrical structure 12$_{(a)}$ includes a pair of opposed frame structures 30$_{(a)}$ and a pair of opposed first nose structure 40$_{(a)}$ and second nose structure 41$_{(a)}$. The second nose structure 41$_{(a)}$ has two spaced sub-portions 41A$_{(a)}$ and 41B$_{(a)}$ with a gap 412$_{(a)}$ therebetween. Sub-portions 41A$_{(a)}$ and 41B$_{(a)}$ each include all of the nose-portion elements. Gap 412$_{(a)}$ accommodates a pole-mounting assembly $60_{(a)}$, one embodiment of which is shown in FIGS. 1, 3, 4 and 12, that is secured to LED assembly $18_{(a)}$ between nose sub-portions $41A_{(a)}$ and $41B_{(a)}$.

Pole-mounting assembly $60_{(a)}$ includes a pole-attachment portion $61_{(a)}$ that receives and secures a pole $15_{(a)}$ and a substantially air/water-tight section $62_{(a)}$ that encloses electrical connections and has wire-apertures $64_{(a)}$. Each wire-aperture $64_{(a)}$ communicates with the nose-portion $42_{(a)}$ chamber of a respective one of nose-structure sub-portions $41A_{(a)}$ and $41B_{(a)}$. Nose-structure sub-portions $41A_{(a)}$ and $41B_{(a)}$ are in air/water-tight engagement with air/water-tight section $62_{(a)}$ of pole-mounting assembly $60_{(a)}$. Air/water-tight section $62_{(a)}$ includes grooves $621_{(a)}$ on its opposite sides $622_{(a)}$; grooves $621_{(a)}$ are configured for mating engagement with end edges $413_{(a)}$ of nose-structure sub-portions $41A_{(a)}$ and $41B_{(a)}$.

Figure 12:
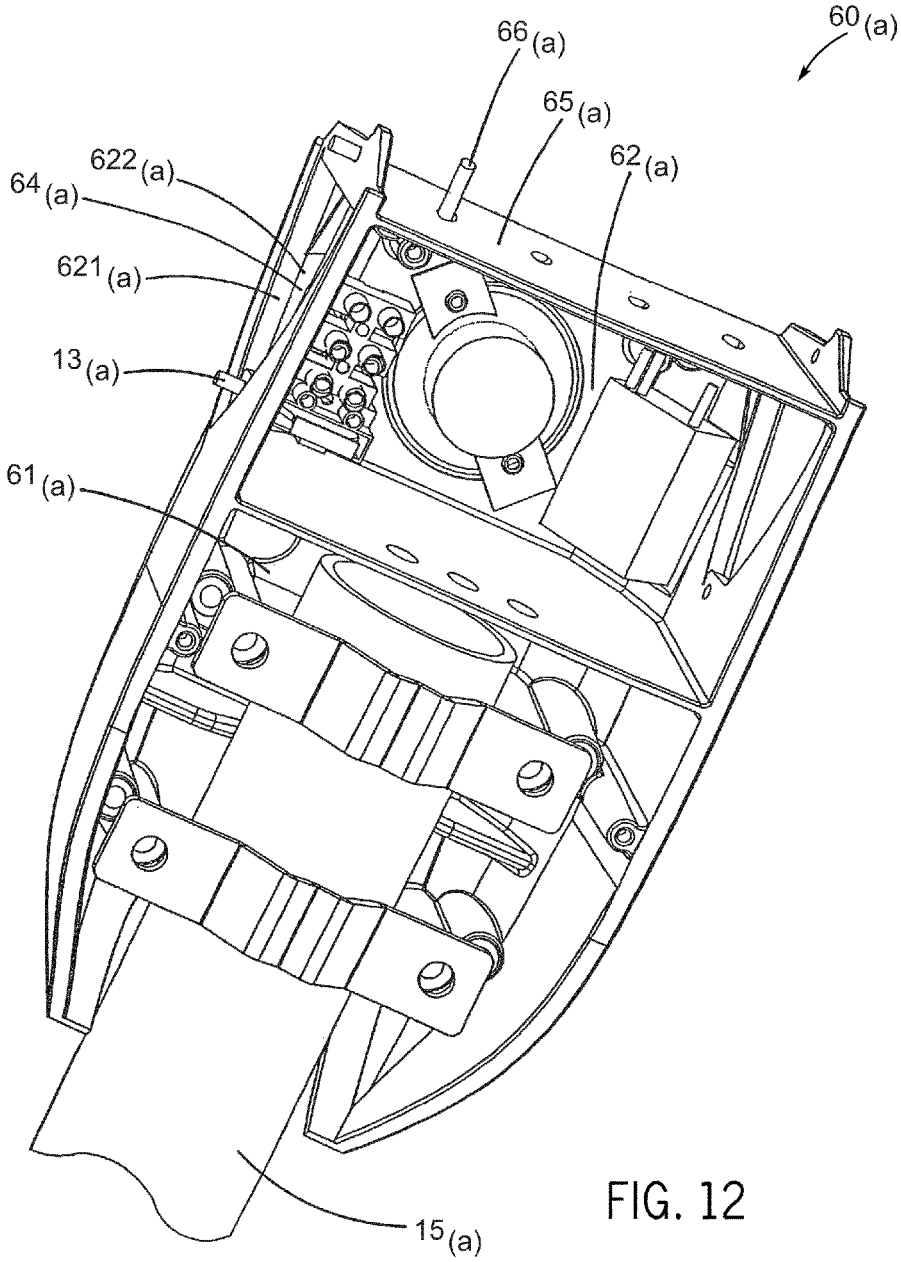
FIG. 12 is a fragmentary perspective view from below of the pole-mounting assembly engaged with a pole-attachment portion, with the cover of the pole-mounting assembly removed to show internal parts.

As best seen in FIG. 12, pole-mounting assembly $60_{(a)}$ has a mounting plate $65_{(a)}$ abutting LED assembly $18_{(a)}$, and fastener/couplers $66_{(a)}$ extend from mounting plate $65_{(a)}$ into engagement with mounting hole $243_{(a)}$ of middle-fins $241_{(a)}$.

Figure 9:
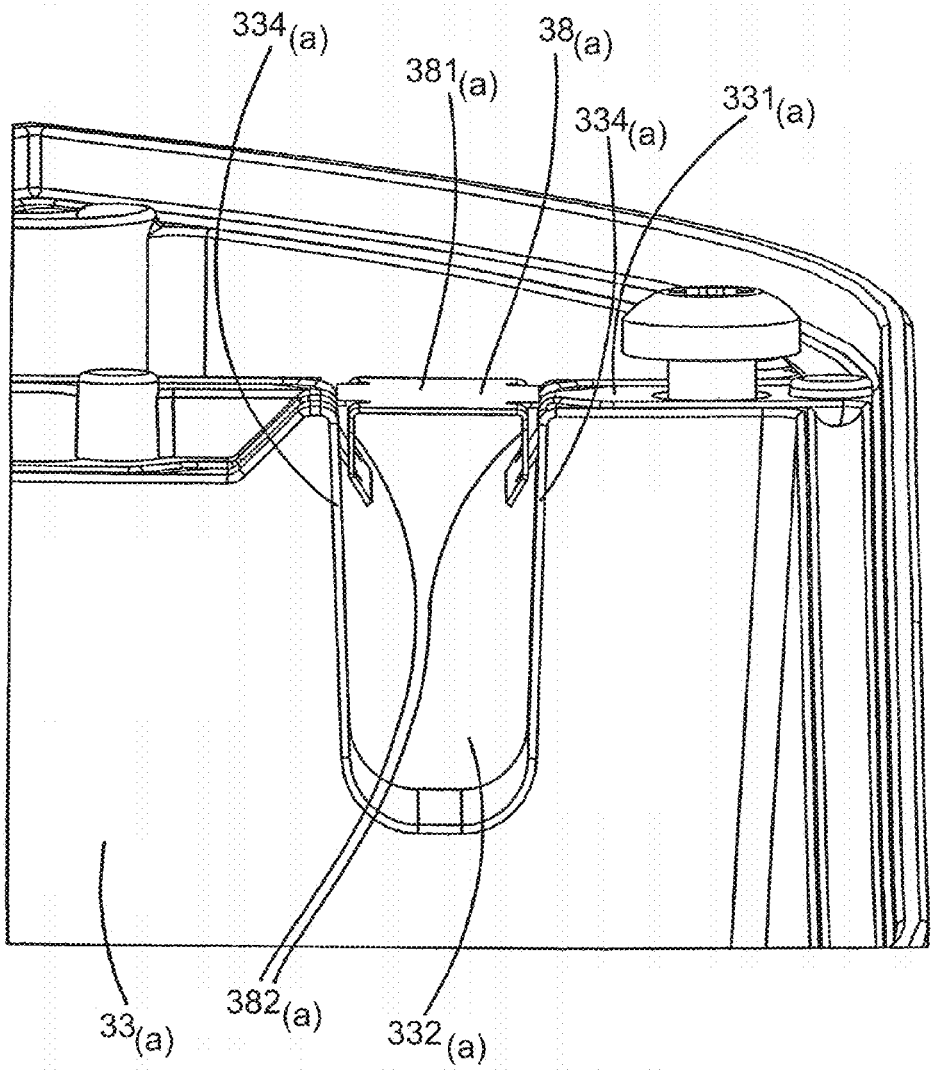
FIG. 9 is a greatly enlarged fragmentary perspective view showing a portion of the chamber-divider wall, the notch therein and the notch-bridge thereover.

FIGS. 8 and 9 show that frame-portion $32_{(a)}$ of chamber $14_{(a)}$ has a chamber-divider $33_{(a)}$ across chamber $32_{(a)}$ that divides frame-portion $32_{(a)}$ of chamber $14_{(a)}$ into an end part $321_{(a)}$ and a main part $322_{(a)}$, which encloses electronic LED driver(s) $16_{(a)}$. Chamber-divider $33_{(a)}$ has a divider-edge $331_{(a)}$. Chamber-divider $33_{(a)}$ includes a substantially air/water-tight wire-passage therethrough in the form of a notch $332_{(a)}$ having spaced notch-wall ends $334_{(a)}$ that terminate at divider-edge $331_{(a)}$. A notch-bridge $38_{(a)}$ spans notch $332_{(a)}$ to maintain the air/water-tight condition of chamber $32_{(a)}$. Notch-bridge $38_{(a)}$ includes a bridge-portion $381_{(a)}$ and a pair of gripping-portions $382_{(a)}$ which are configured for spring-grip attachment to notch-wall ends $334_{(a)}$. A removable cover-plate $31_{(a)}$ seals main part $322_{(a)}$ of frame-portion $32_{(a)}$ of chamber $14_{(a)}$ in substantially air/water-tight condition.

FIGS. 2-6 show that inventive LED lighting fixtures $10_{(a)}$ include a protective cover $11_{(a)}$ that extends over LED assembly $18_{(a)}$ and is secured with respect to housing $12_{(a)}$. Protective cover $11_{(a)}$ has perforations $111_{(a)}$ to permit air and water flow therethrough for access to and from LED assembly $18_{(a)}$.

As best seen in FIGS. 5 and 6, LED lighting fixture $10_{(a)}$ has a venting gap $56_{(a)}$ between housing $12_{(a)}$ and LED assembly $18_{(a)}$, to permit air and water flow from heat sink $20_{(a)}$. Venting gap $56_{(a)}$ is formed by the interlock of housing $12_{(a)}$ to LED assembly $18_{(a)}$ or is a space along outer side-fins of the LED assembly.

Figure 13:
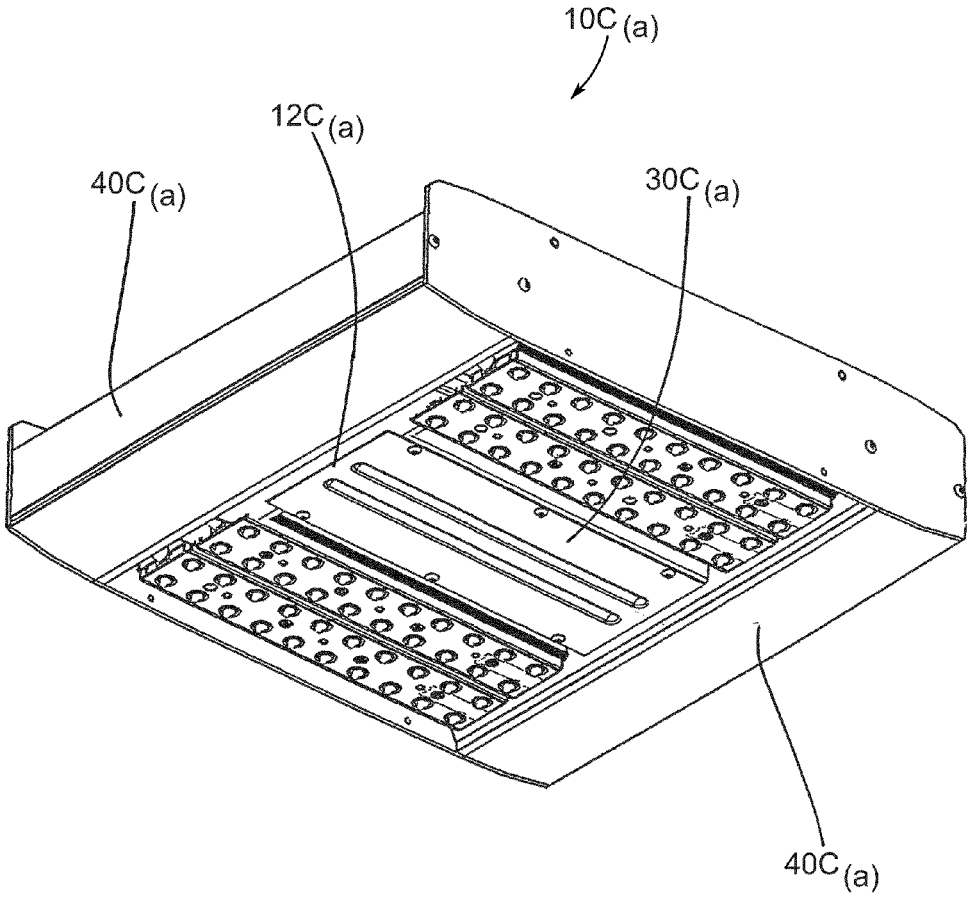
FIG. 13 is a perspective view of the LED lighting fixture of the type having the housing being a substantially H-shaped structure.

FIG. 13 shows an embodiment of the inventive lighting fixture $10C_{(a)}$ in which frame structure $30C_{(a)}$ is a sole frame structure, and housing $12C_{(a)}$ is a substantially H-shaped structure with sole frame structure $30C_{(a)}$ secured between mid-length positions of the pair of opposed border structures $40C_{(a)}$.

Figure 14:
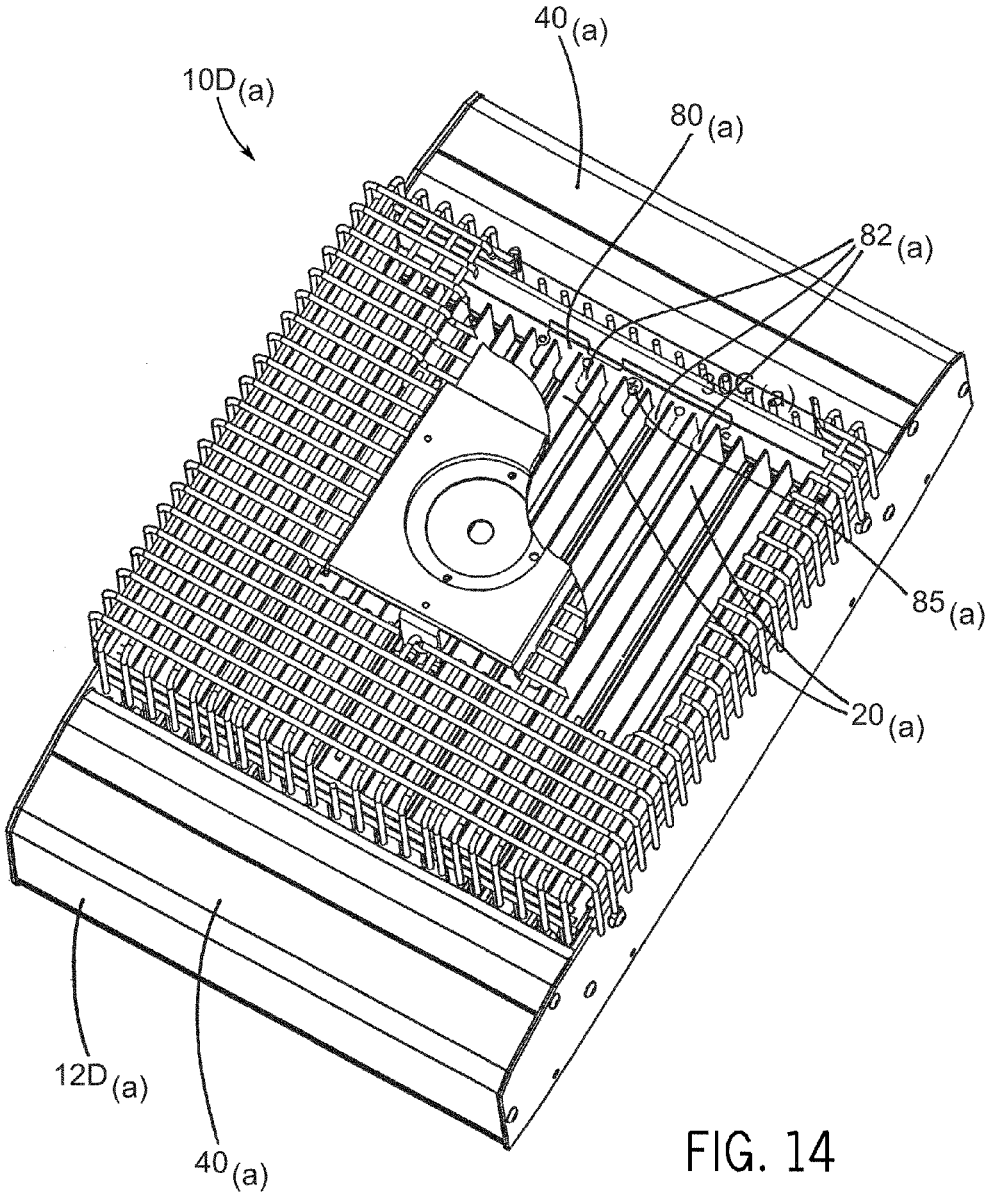
FIG. 14 is a top perspective view of another embodiment of the LED lighting fixture including a restraining bracket seen through a cut-away in the protective cover.

FIG. 14 shows another embodiment of the inventive LED lighting fixture $10D_{(a)}$ with housing $12D_{(a)}$ formed by a pair of opposed border structures $40_{(a)}$ and LED assembly $18_{(a)}$ secured between border structures $40_{(a)}$. Lighting fixture $10D_{(a)}$, as shown on FIG. 14, includes a restraining-bracket $80_{(a)}$ secured to housing $12D_{(a)}$ by screws $85_{(a)}$ through screw-holes $87_{(a)}$. Bracket $80_{(a)}$ has a plurality of projections $82_{(a)}$ each of which extends between adjacent fins of two of heat sinks $20_{(a)}$.

Figure 15:
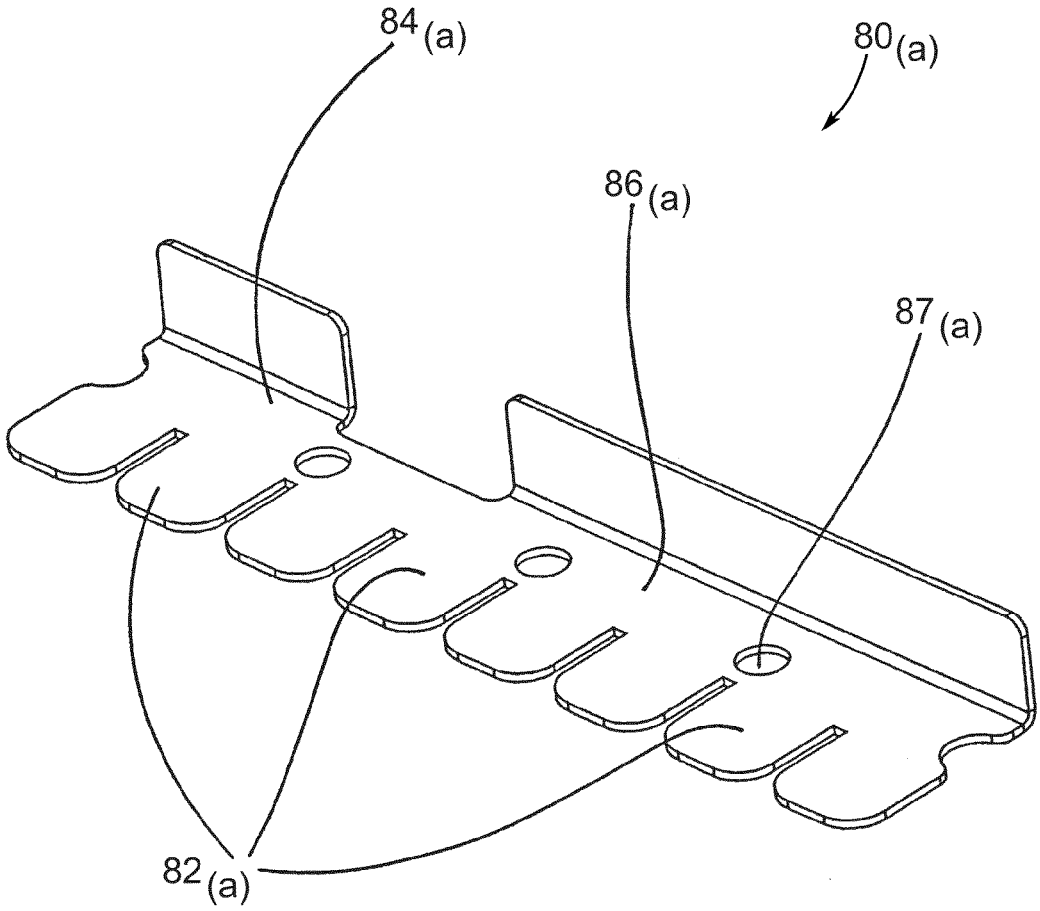
FIG. 15 is a perspective view of the restraining bracket of FIG. 14.

Restraining bracket $80_{(a)}$, best shown on FIG. 15, is a comb-like structure with an elongated body $84_{(a)}$ including a spine-portion $86_{(a)}$ from which the plurality of projections $82_{(a)}$ extend. Restraining-bracket $80_{(a)}$ is configured and dimensioned for elongated body $84_{(a)}$ to be fixedly secured to housing $12_{(a)}$ and for projections $82_{(a)}$ to snugly fit in spaces between adjacent heat-sink fins.

FIGS. 16-56 illustrate preferred embodiments of the LED light fixture $100A_{(b)}$-$100E_{(b)}$ in accordance with this invention. Common or similar parts are given same numbers in the drawings of all embodiments, and the floodlight fixtures are often referred to by the numeral $100_{(b)}$, without the A or E lettering used in the drawings, and in the singular for convenience.

Floodlight fixture $100_{(b)}$ includes a housing $10_{(b)}$ that has a first end-portion $11_{(b)}$ and a second end-portion $12_{(b)}$ and a single-piece extrusion $20_{(b)}$ that has first and second ends $201_{(b)}$ and $202_{(b)}$, respectively, with first and second end-portions $11_{(b)}$ and $12_{(b)}$ secured with respect to first and second ends $201_{(b)}$ and $202_{(b)}$, respectively. Single-piece extrusion $20_{(b)}$ includes a substantially planar base $22_{(b)}$ extending between first and second ends $201_{(b)}$ and $202_{(b)}$. Base $22_{(b)}$ has an LED-adjacent surface $220_{(b)}$ and an opposite surface $221_{(b)}$. Single-piece extrusion $20_{(b)}$ further has a heat-dissipating section $24_{(b)}$ having heat-dissipating surfaces $241_{(b)}$ extending from opposite surface $221_{(b)}$. Light fixture $100_{(b)}$ further includes an LED arrangement $30_{(b)}$ mounted to LED-adjacent surface $220_{(b)}$ in non-water/air-tight condition with respect to housing $10_{(b)}$. (See FIGS. 16, 18, 22, 27-46) In these embodiments, second end portion $12_{(b)}$ forms an endcap $120_{(b)}$.

Figure 22:
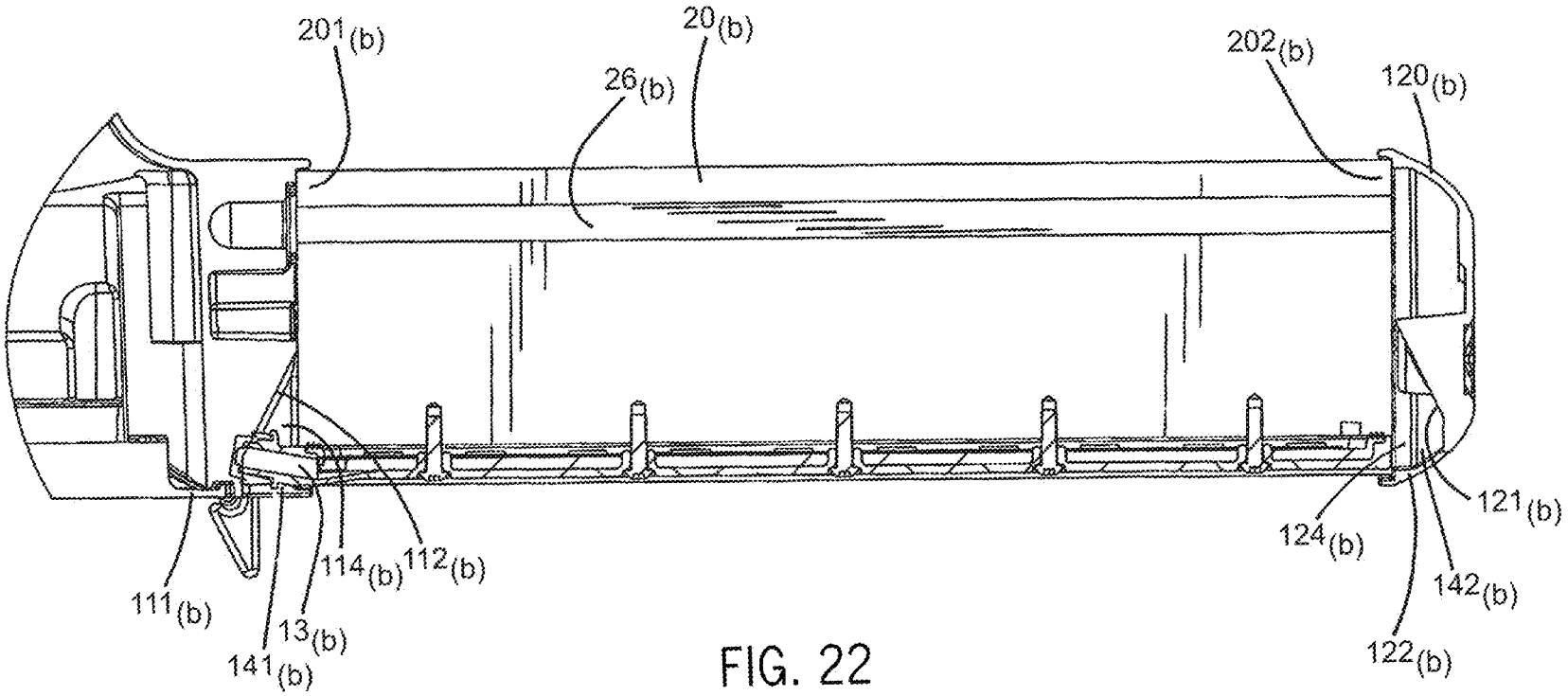
FIG. 22 is a fragmentary lengthwise cross-sectional view of the LED light fixture of FIG. 16 taken along lines 22-22 shown in FIG. 19.
Figure 23:
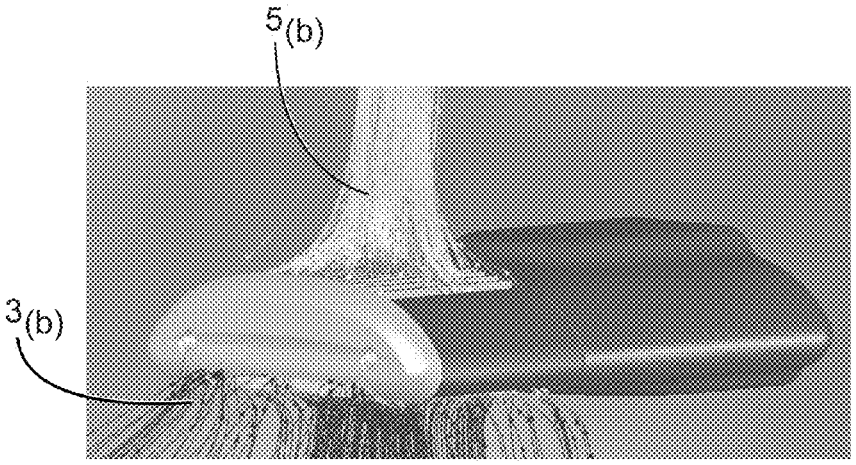
FIGS. 23-25 are heat-dissipation diagrams showing air-flow through the LED light fixture.
Figure 24:
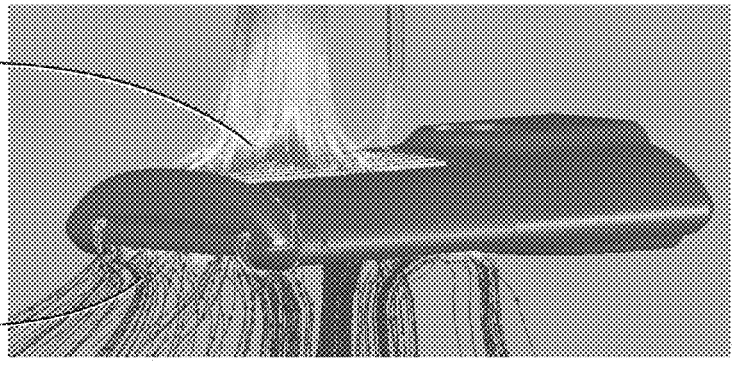
Figure 25:
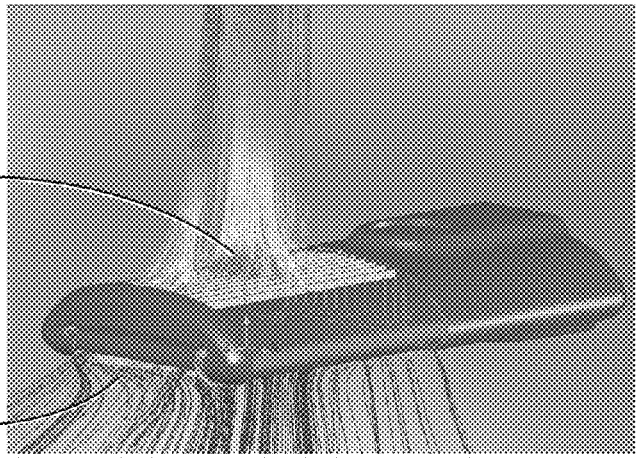

As best seen at least in FIGS. 22, 27, 29, 42 and 45, housing $10_{(b)}$ forms a venting gap $14_{(b)}$ between each end-portion $11_{(b)}$ and $12_{(b)}$ and single-piece extrusion $20_{(b)}$ to provide ingress of cool air $3_{(b)}$ to and along the heat-dissipating surfaces $241_{(b)}$ by upward flow of heated air $5_{(b)}$ therefrom. FIGS. 23-25 illustrate the flow of air through heat-dissipating section $24_{(b)}$ of extrusion $20_{(b)}$. The upward flow of heated air $5_{(b)}$ draws cool air $3_{(b)}$ into heat-dissipating section $24_{(b)}$ and along heat-dissipating surfaces $241_{(b)}$ without any aid from mechanical devices such as fans or the like.

Figure 26:
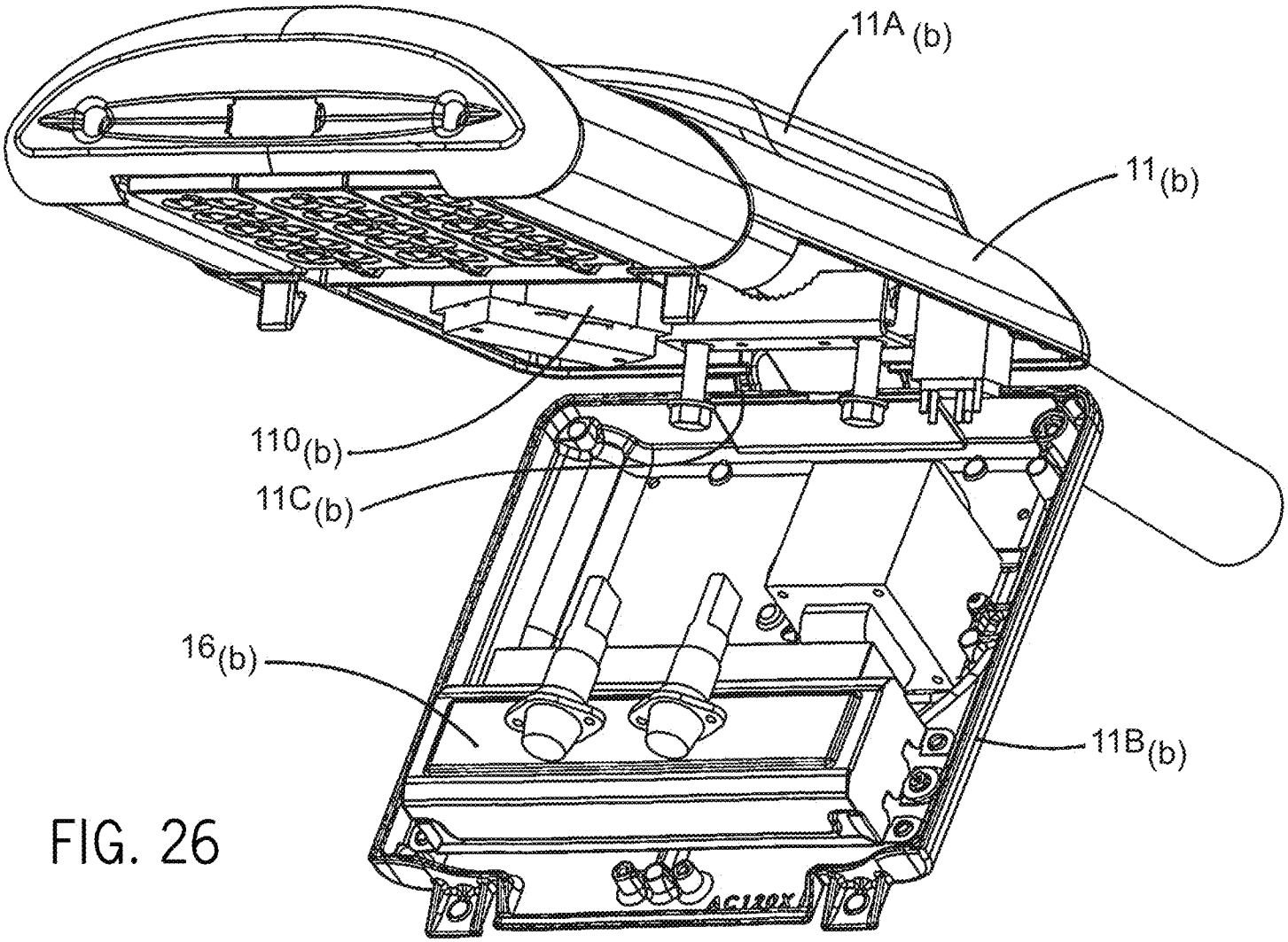
FIG. 26 is a perspective view from below of the LED light fixture of FIG. 16 shown with a lower portion in open position.

As seen in FIG. 26, first end-portion $11_{(b)}$ forms a water/air-tight chamber $110_{(b)}$ enclosing an electronic LED driver $16_{(b)}$ and/or other electronic and electrical components needed for LED light fixtures. First end-portion $11_{(b)}$ has upper and lower portions $11A_{(b)}$ and $11B_{(b)}$ which are hinged together by a hinge $11C_{(b)}$. This hinging arrangement facilitates easy opening of first end-portion $11_{(b)}$ by the downward swinging of lower portion $11B_{(b)}$. LED driver $16_{(b)}$ is mounted on lower portion $11B_{(b)}$ for easy maintenance.

Figure 42:
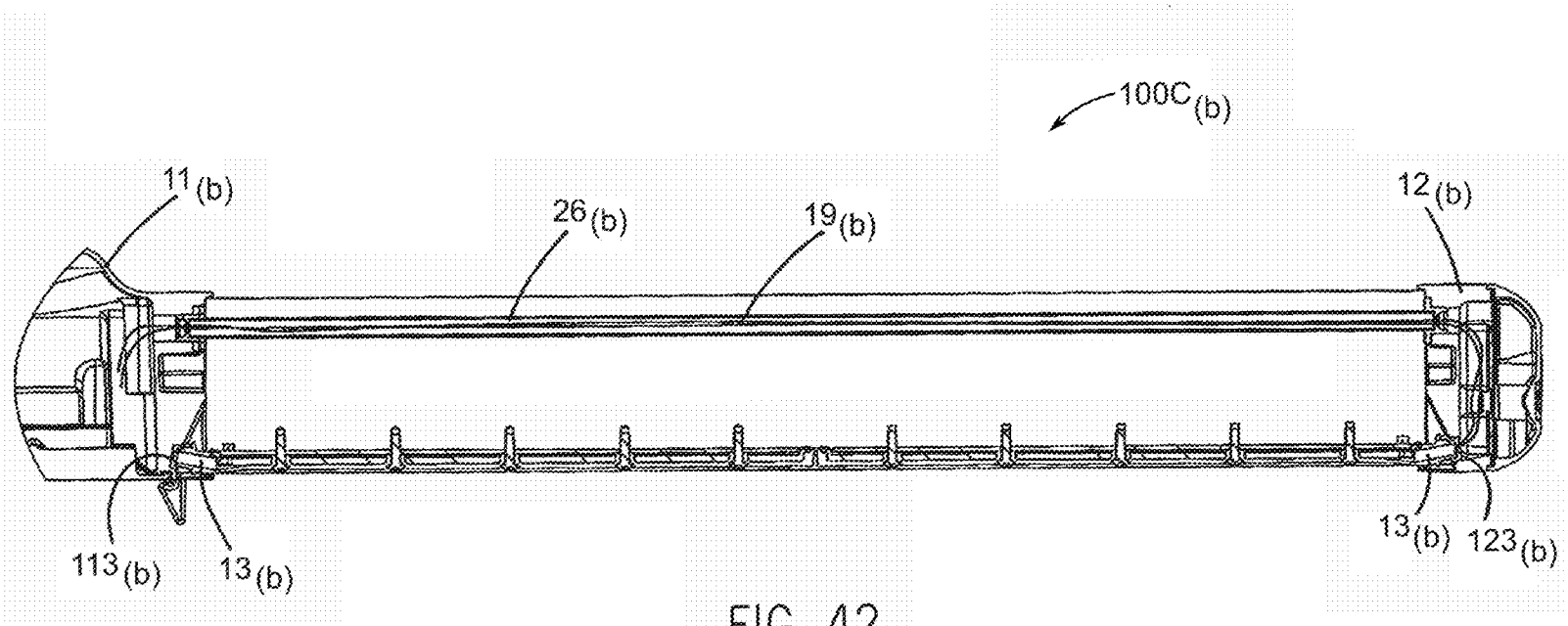
FIG. 42 is a fragmentary lengthwise cross-sectional view of the LED light fixture of FIG. 32 taken along lines 42-42 to show a closed wireway formed of and along the extrusion.
Figure 45:
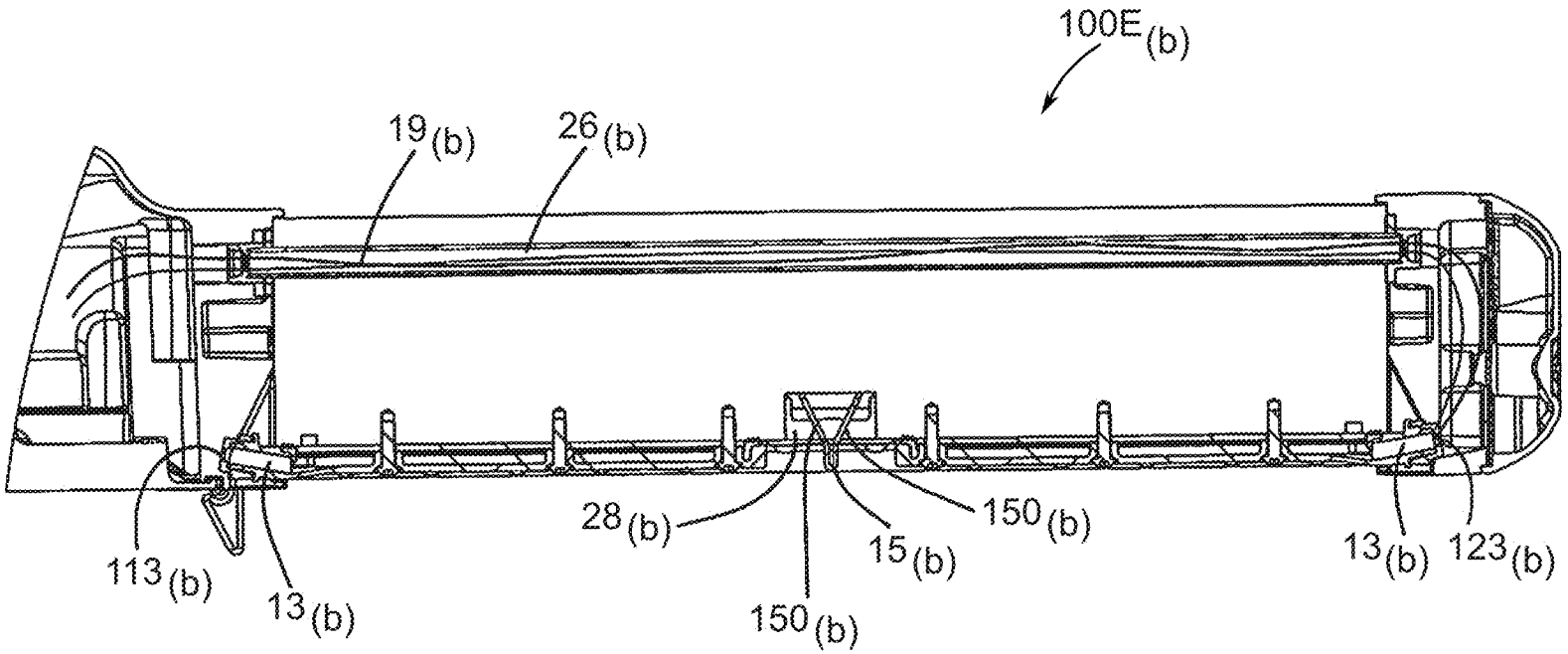
FIG. 45 is a fragmentary lengthwise cross-sectional view of the LED light fixture of FIG. 43 taken along lines 45-45.
Figure 46:
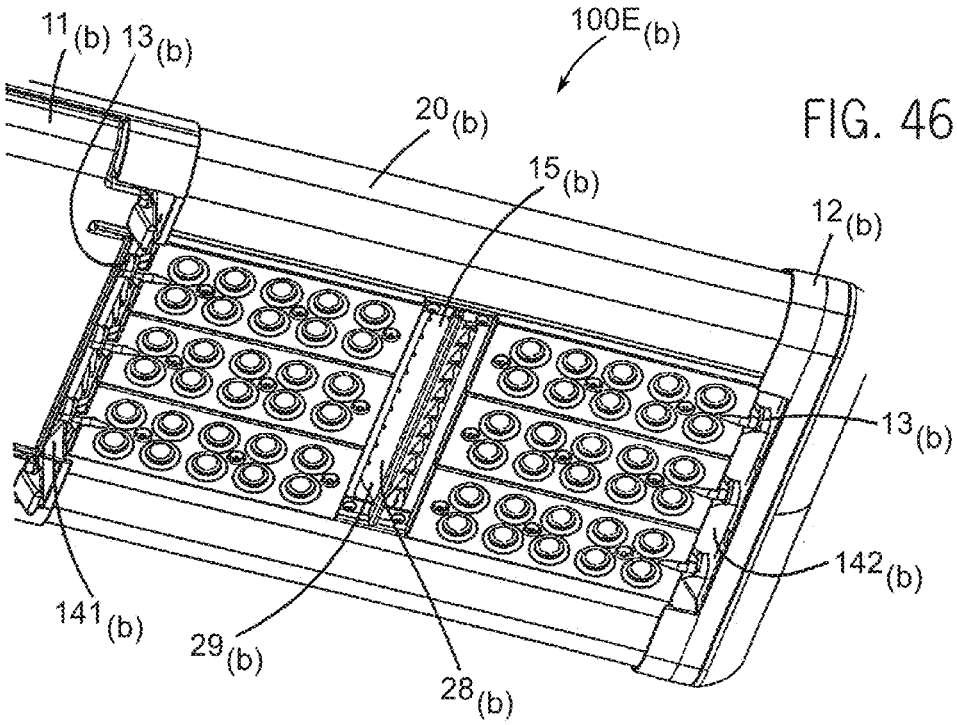
FIG. 46 is a fragmentary perspective view from below of the LED light fixture of FIG. 43 showing a deflector member within the venting aperture.
Figure 47:
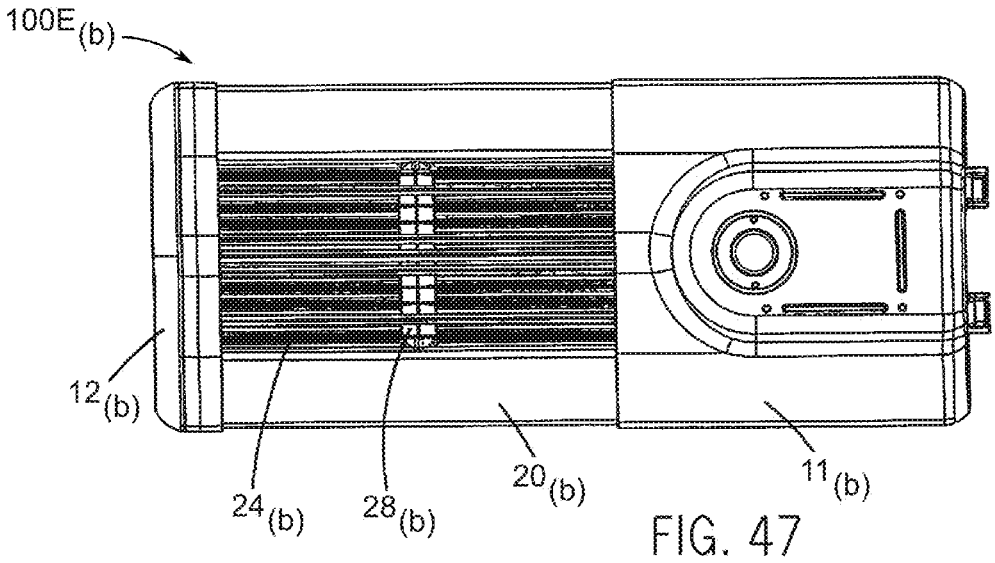
FIG. 47 is a top plan view of the embodiment of the LED light fixture of FIG. 43.

First end-portion $11_{(b)}$ at first end $201_{(b)}$ of extrusion $20_{(b)}$ has a lower surface $111_{(b)}$ and an extrusion-adjacent end surface $112_{(b)}$. As best seen in FIGS. 22, 42 and 45, extrusion-adjacent end surface $112_{(b)}$ and lower surface $111_{(b)}$ form a first recess $114_{(b)}$ which extends away from first end $201_{(b)}$ of extrusion $20_{(b)}$ and defines a first venting gap $141_{(b)}$. End surface $112_{(b)}$ along first recess $114_{(b)}$ is tapered such that first venting gap $141_{(b)}$ is upwardly narrowed, thereby directing and accelerating the air flow along heat-dissipating surfaces $241_{(b)}$.

Endcap $120_{(b)}$ at second end $202_{(b)}$ of extrusion $20_{(b)}$ has an inner surface $121_{(b)}$ and a lower edge-portion $122_{(b)}$. Inner surface $121_{(b)}$ and lower edge-portion $122_{(b)}$ of endcap $120_{(b)}$ form a second recess $124_{(b)}$ which extends away from second end $202_{(b)}$ of extrusion $20_{(b)}$ and defines a second venting gap $142_{(b)}$. Inner surface $121_{(b)}$ along second recess $142_{(b)}$ is tapered such that second venting gap $142_{(b)}$ is upwardly narrowed, thereby directing and accelerating the air flow along heat-dissipating surfaces $241_{(b)}$.

As best seen in FIGS. 16, 18, 22 and 26-46, LED arrangement $\mathbf{30}_{(b)}$ is secured outside water/air-tight chamber $\mathbf{110}_{(b)}$ and is free from fixture enclosures. LED arrangement $\mathbf{30}_{(b)}$ includes a plurality of LED-array modules $\mathbf{31}_{(b)}$ or $\mathbf{32}_{(b)}$. As further seen in these FIGURES, LED-array modules $\mathbf{31}_{(b)}$ and $\mathbf{32}_{(b)}$ are substantially rectangular elongate modules.

Figure 27:
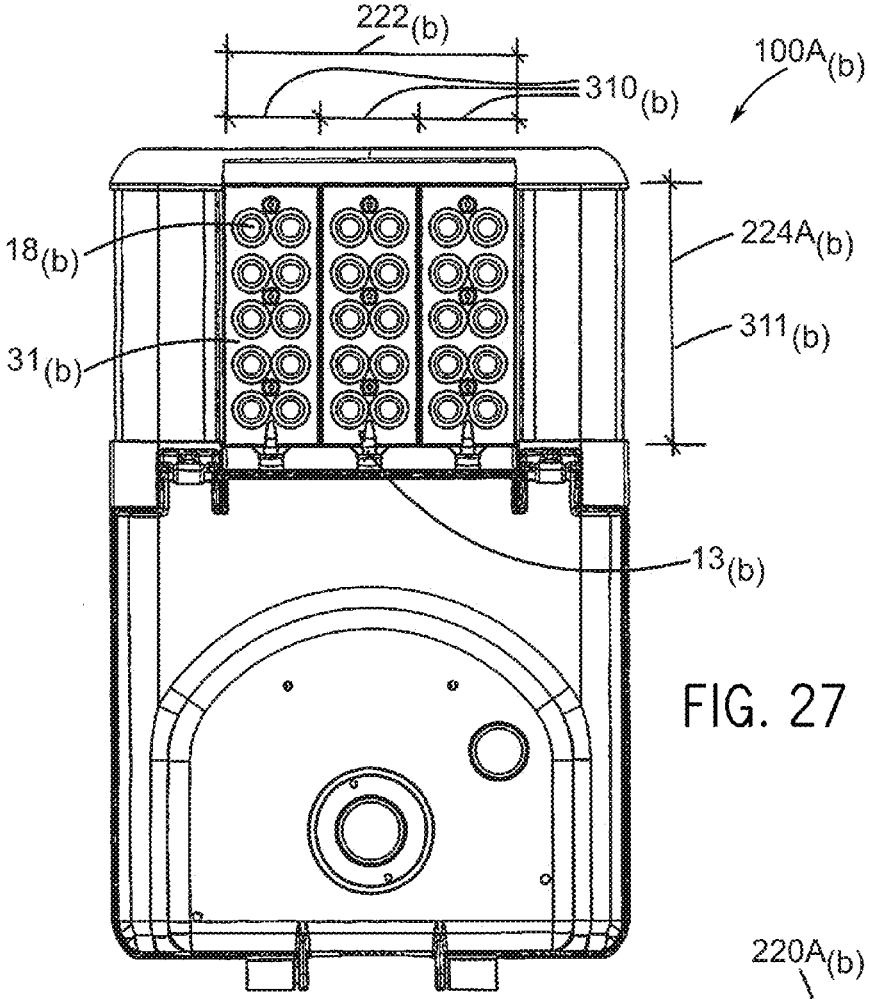
FIG. 27 is a bottom plan view of the LED light fixture of FIG. 16.
Figure 28:
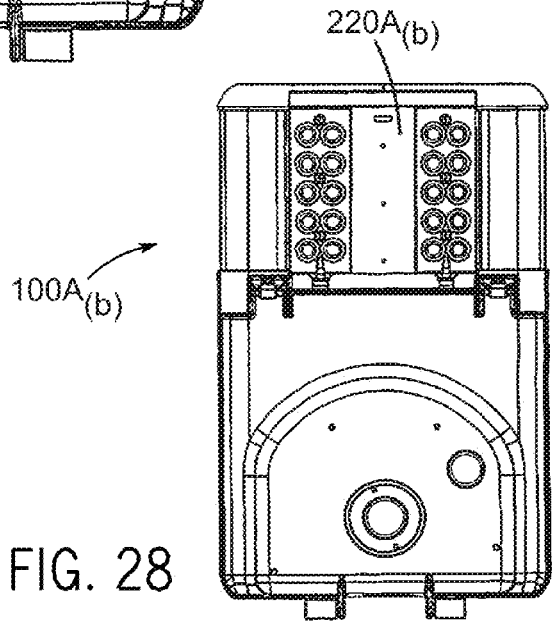
FIG. 28 is a bottom plan view of the LED light fixture of FIG. 27 with an LED arrangement including two side-by-side LED-array modules.
Figure 30:
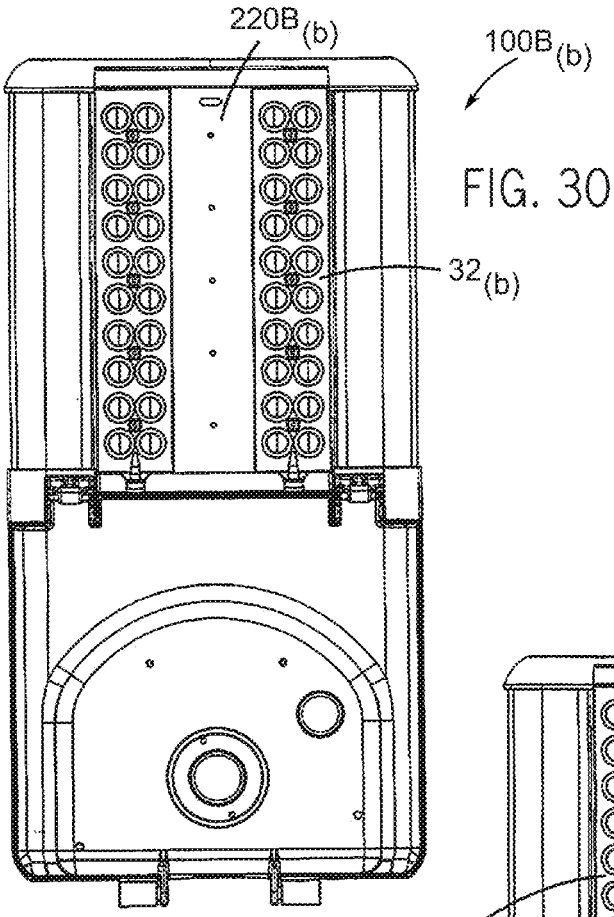
FIG. 30 is a bottom plan view of the LED light fixture of FIG. 29 with an LED arrangement including two side-by-side LED-array modules.
Figure 31:
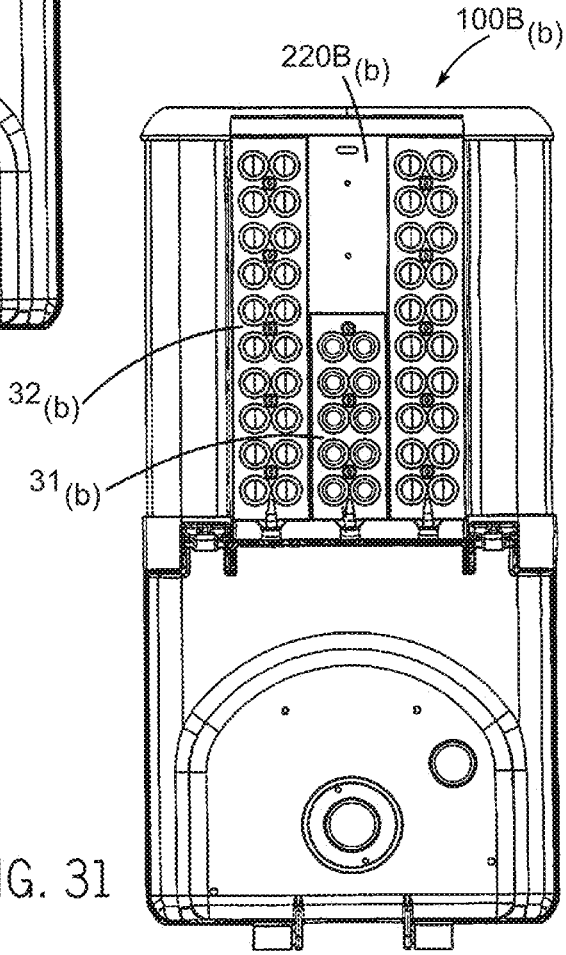
FIG. 31 is a bottom plan view of the LED light fixture of FIG. 29 with an LED arrangement including side-by-side LED-array modules having different lengths.
Figure 32:
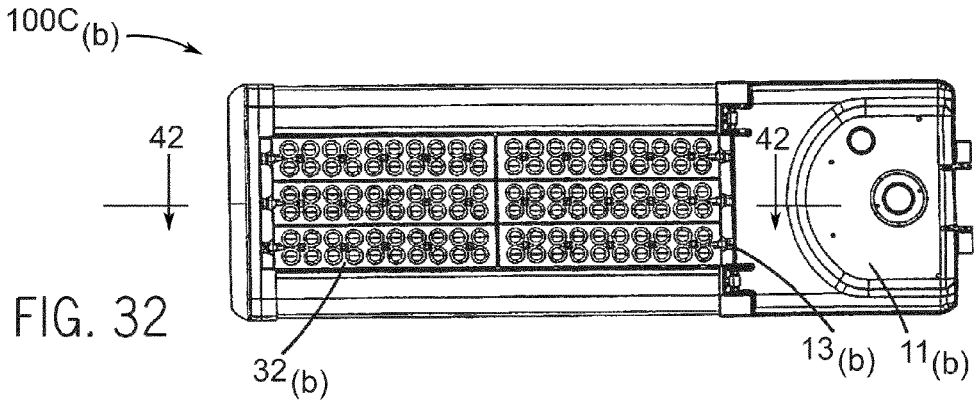
FIG. 32 is a bottom plan view of an embodiment of the LED light fixture with LED-array modules mounted in end-to-end relationship to one another.
Figure 33:
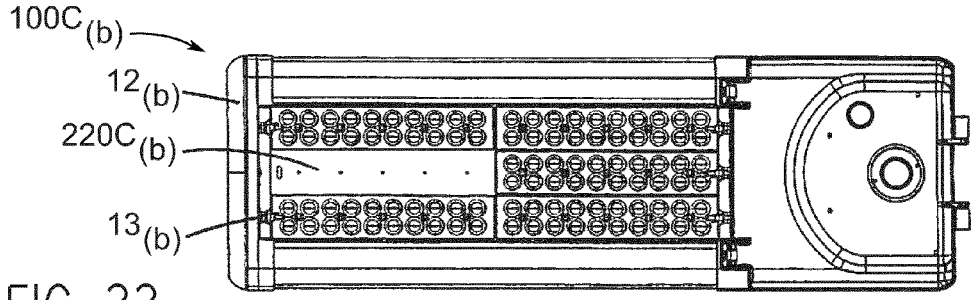
FIGS. 33-35 are bottom plan views of embodiments of the LED light fixture of FIG. 32 with same-length LED-array modules mounted in end-to-end relationship to one another showing alternative arrangements of the LED-array modules.
Figure 34:
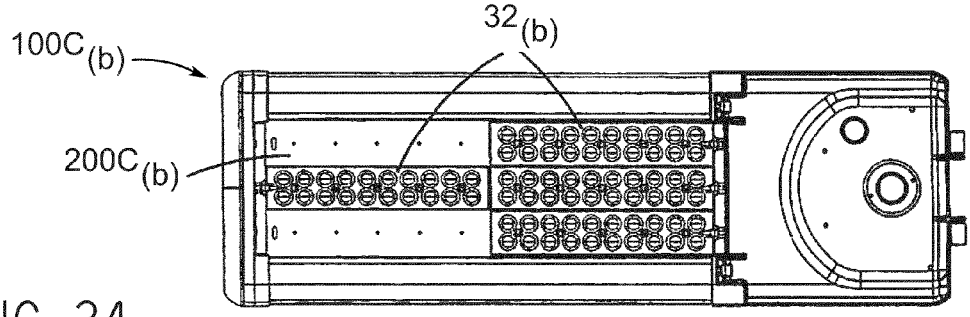
Figure 35:
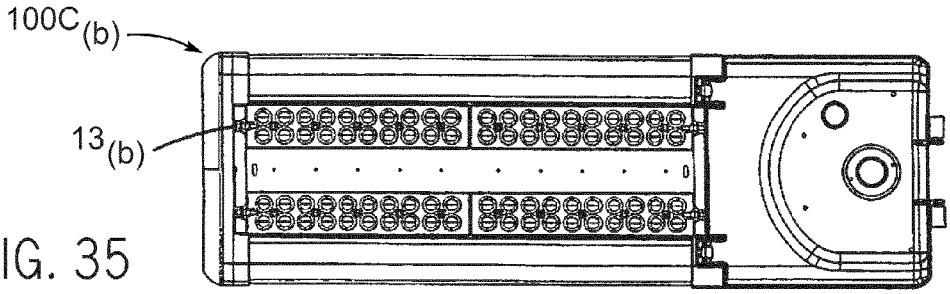

LED-array modules $\mathbf{31}_{(b)}$ and $\mathbf{32}_{(b)}$ each have a common module-width $\mathbf{310}_{(b)}$ (see FIGS. 27-46). LED-adjacent surface $\mathbf{220}\mathrm{A}_{(b)}$ has a width $\mathbf{222}_{(b)}$ which is approximately the multiple of the maximum number of LED-array modules mountable in side-by-side relationship thereon by common module-width $\mathbf{310}_{(b)}$. FIGS. 28, 30 and 31 show alternative arrangements of LED-array modules $\mathbf{31}_{(b)}$ on LED-adjacent surface $\mathbf{220}_{(b)}$ of same width $\mathbf{222}_{(b)}$ as shown in FIGS. 27 and 29.

LED-array modules further have predetermined module-lengths associated with the numbers of LEDs $\mathbf{18}_{(b)}$ on modules $\mathbf{31}_{(b)}$ or $\mathbf{32}_{(b)}$.

Figure 16:
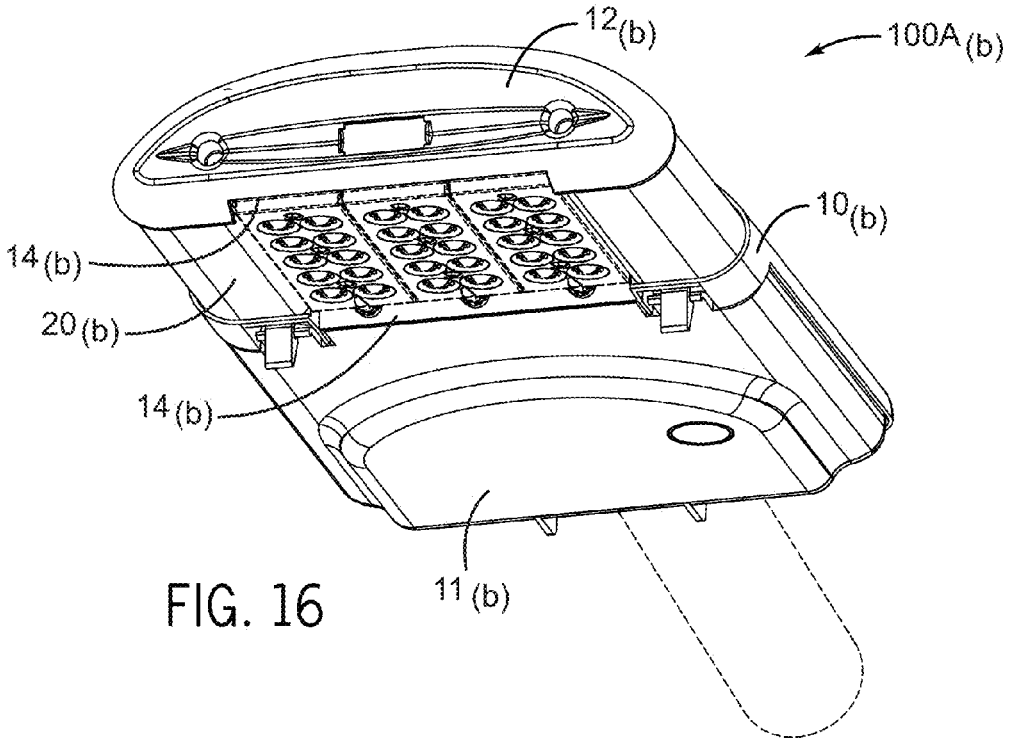
FIG. 16 is a perspective view from below of another embodiment of an LED light fixture in accordance with this invention.
Figure 17:
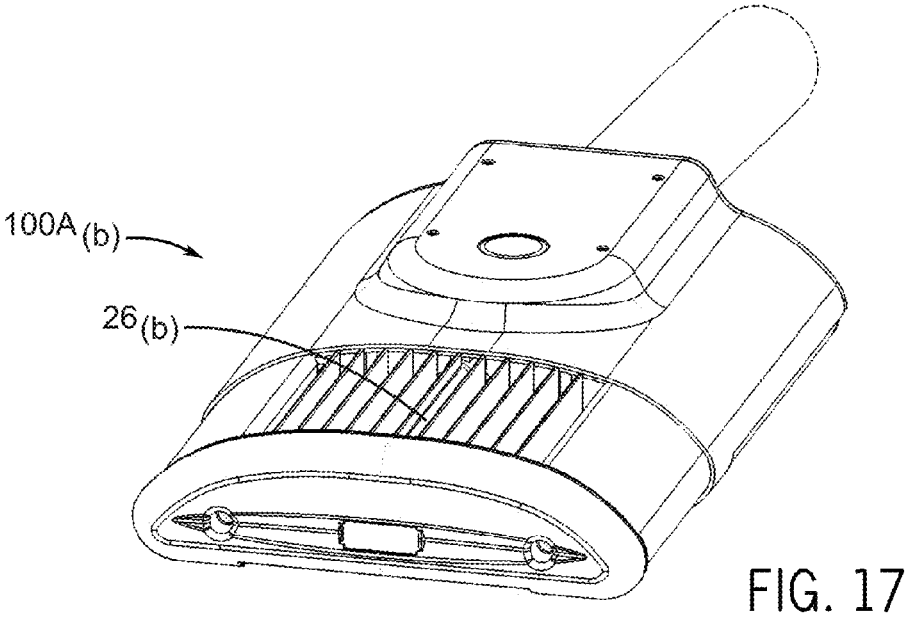
FIG. 17 is a perspective view from above of the LED light fixture of FIG. 16.

FIGS. 16 and 17 best show LED light fixture $\mathbf{100}\mathrm{A}_{(b)}$ with modules $\mathbf{31}_{(b)}$ each having ten LEDs $\mathbf{18}_{(b)}$ thereon determining a module-length $\mathbf{311}_{(b)}$. Fixture $\mathbf{100}\mathrm{A}_{(b)}$ has LED-adjacent surface $\mathbf{220}\mathrm{A}_{(b)}$ with a length $\mathbf{224}\mathrm{A}_{(b)}$ which is approximately a dimension of predetermined module-lengths $\mathbf{311}_{(b)}$.

Figure 18:
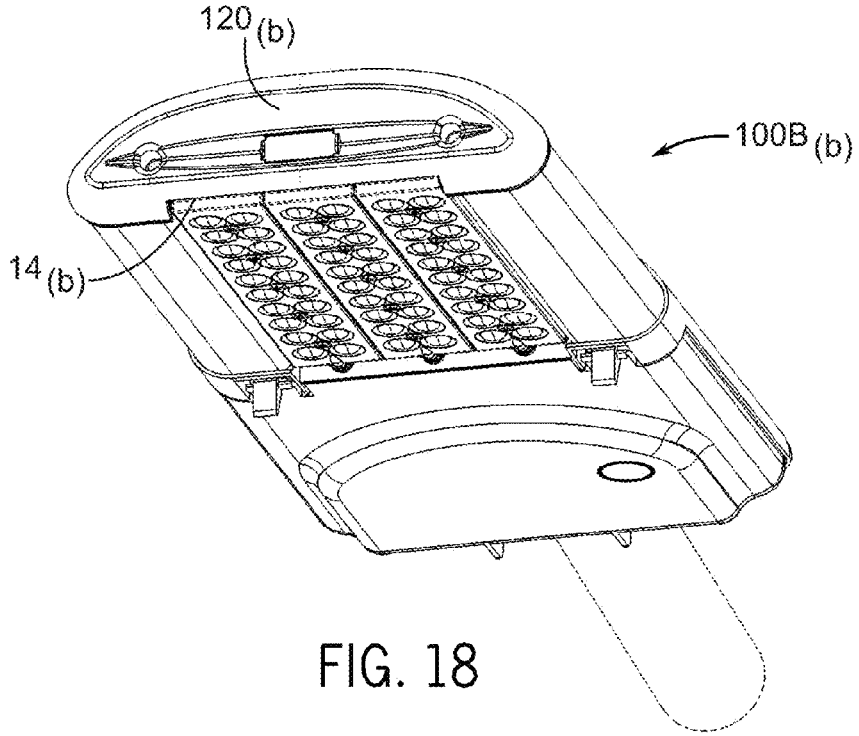
FIG. 18 is a perspective view from below of another embodiment of an LED light fixture in accordance with this invention.
Figure 19:
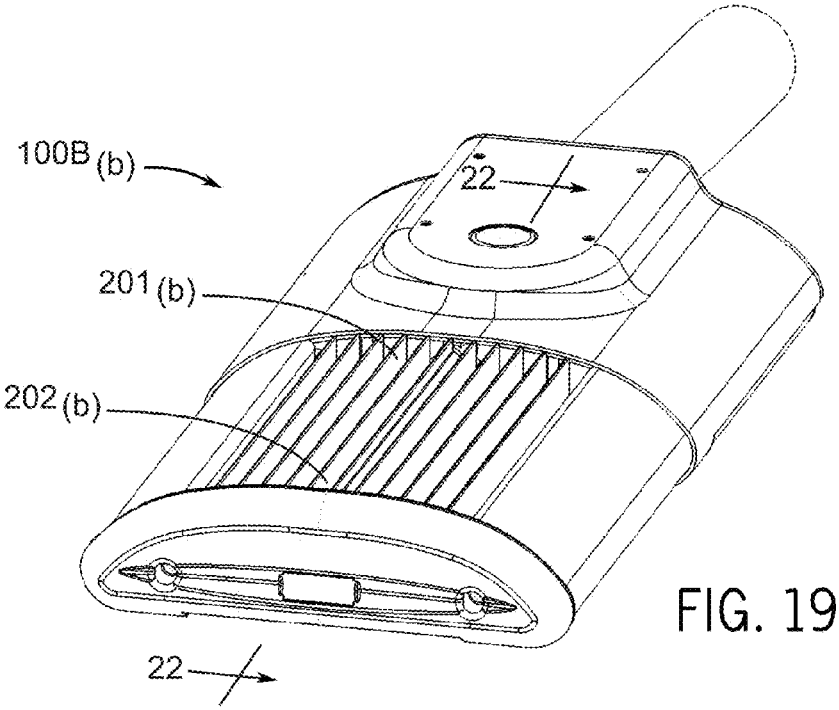
FIG. 19 is a perspective view from above of the LED light fixture of FIG. 18.
Figure 29:
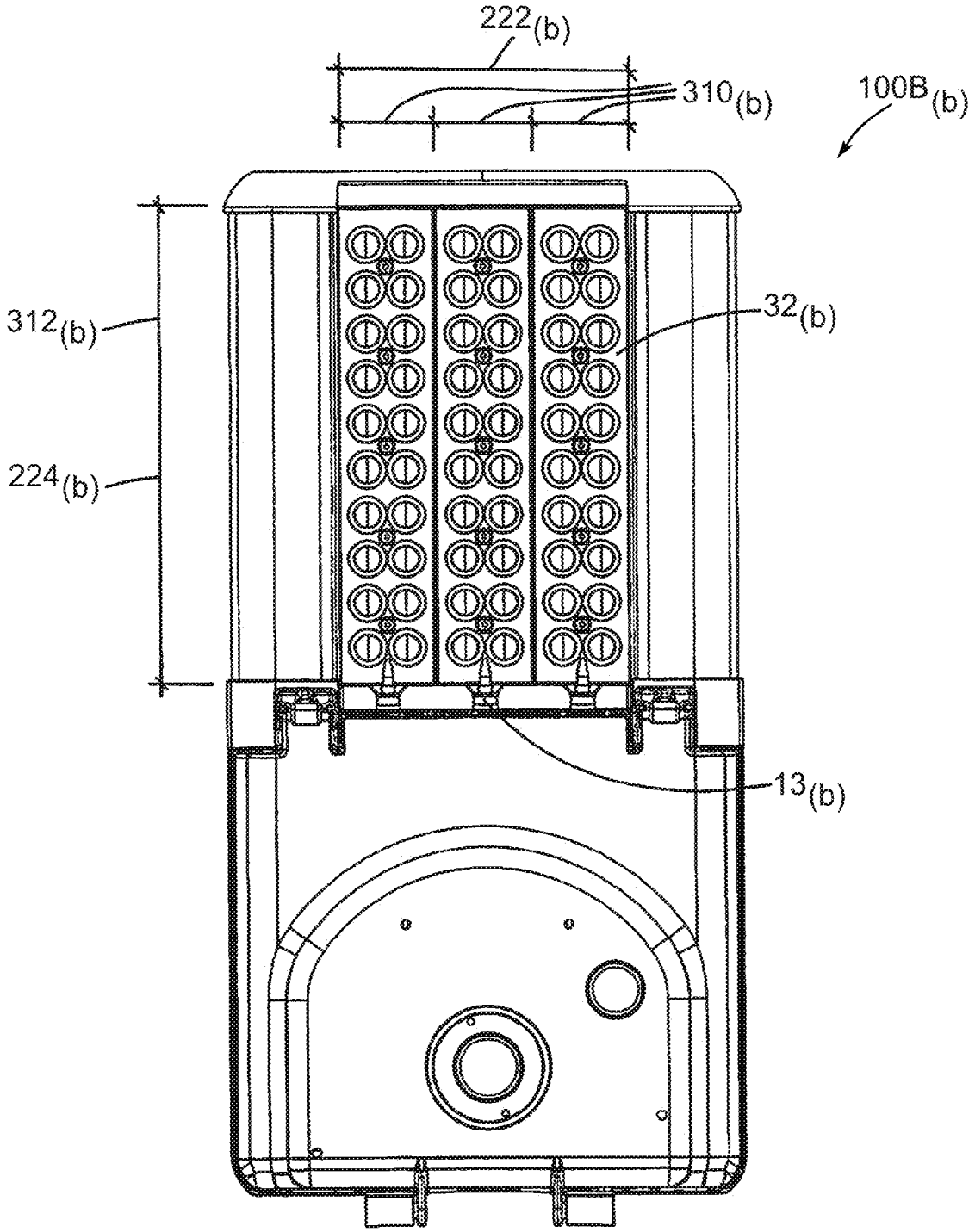
FIG. 29 is a bottom plan view of the LED light fixture of FIG. 18.

FIGS. 18 and 29 best show LED light fixture $\mathbf{100}\mathrm{B}_{(b)}$ with modules $\mathbf{32}_{(b)}$ each having twenty LEDs $\mathbf{18}_{(b)}$ thereon determining a module-length $\mathbf{312}_{(b)}$. Fixture $\mathbf{100}\mathrm{B}_{(b)}$ has LED-adjacent surface $\mathbf{220}\mathrm{B}_{(b)}$ with a length $\mathbf{224}\mathrm{B}_{(b)}$ which is approximately a dimension of predetermined module-lengths $\mathbf{312}_{(b)}$.

FIGS. 28 and 30 illustrate how, based on illumination requirements, LED lighting fixture $\mathbf{100}_{(b)}$ allows for a variation in a number of modules $\mathbf{31}_{(b)}$ or $\mathbf{32}_{(b)}$ mounted on LED-adjacent surface $\mathbf{220}_{(b)}$. FIG. 31 illustrates a combination of different-length modules $\mathbf{31}_{(b)}$ and $\mathbf{32}_{(b)}$ on LED-adjacent surface $\mathbf{220}\mathrm{B}_{(b)}$.

Figure 36:
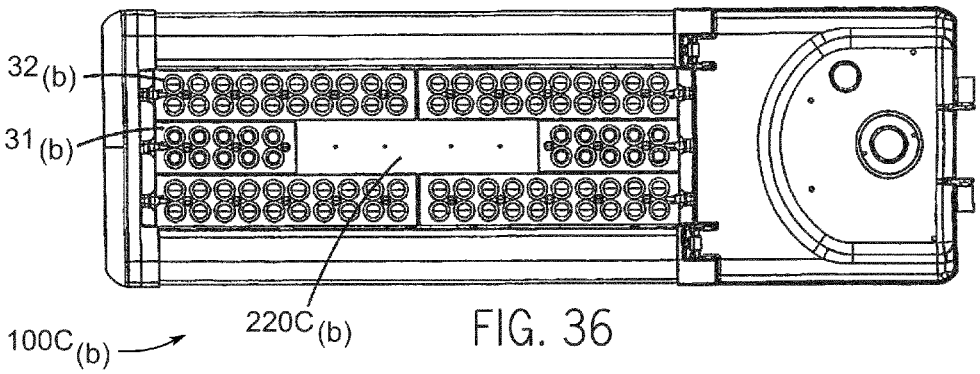
FIGS. 36, 37 and 37A are bottom plan views of yet more embodiments of the LED light fixture of FIG. 32 showing an LED arrangement with a combination of same-length and different-length LED-array modules in end-to-end relationship to one another.
Figure 37:
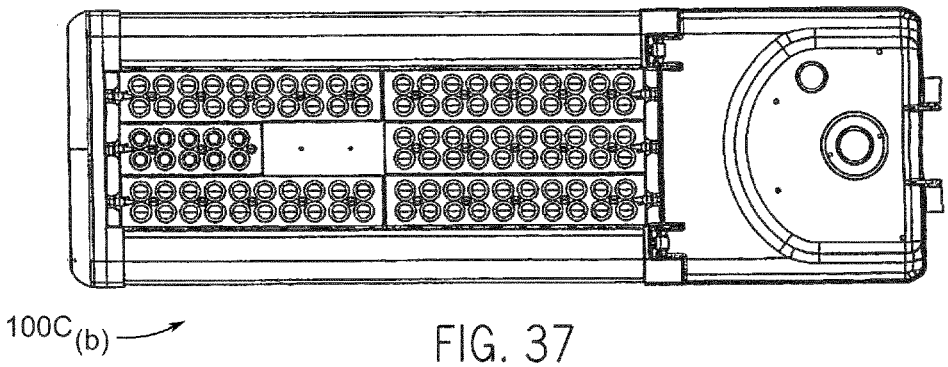
Figure 37A:
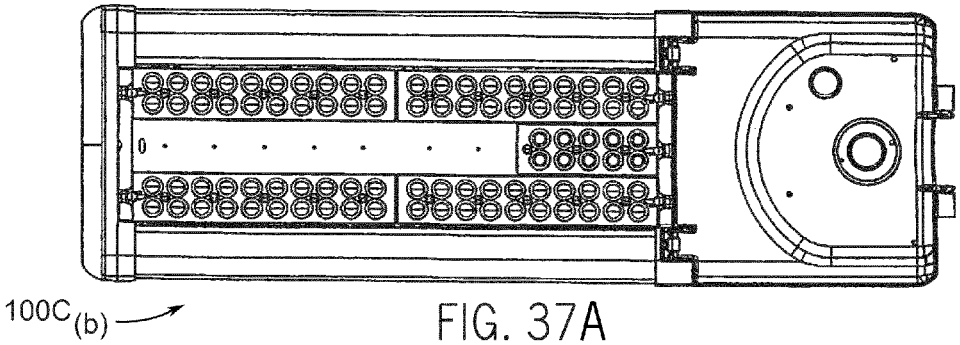
Figure 38:
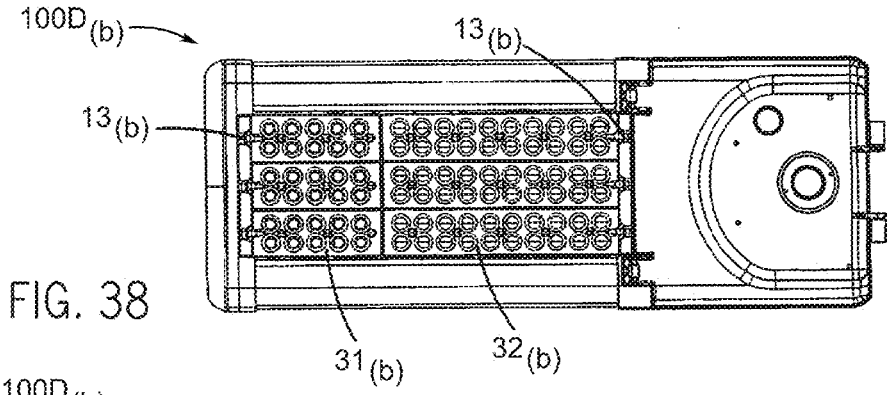
FIG. 38 is a bottom plan view of still another embodiment of the LED light fixture with different-length LED-array modules mounted in end-to-end relationship to one another.
Figure 39:
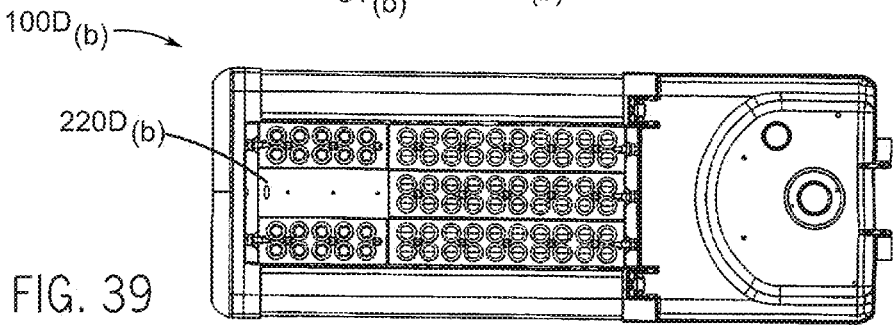
FIGS. 39-41 are bottom plan views of alternative embodiments of the LED light fixture of FIG. 38 showing alternative arrangements of such LED-array modules.
Figure 40:
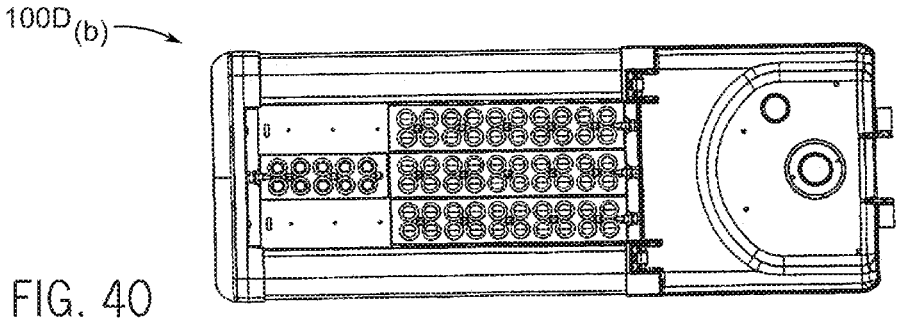
Figure 41:
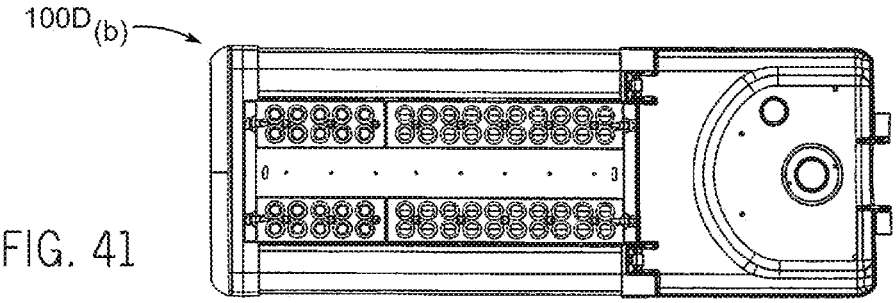

FIGS. 32-35 show an LED light fixture $\mathbf{100}\mathrm{C}_{(b)}$ with modules $\mathbf{32}_{(b)}$ each having twenty LEDs $\mathbf{18}_{(b)}$ thereon determining a module-length $\mathbf{312}_{(b)}$. Fixture $\mathbf{100}\mathrm{C}_{(b)}$ has LED-adjacent surface $\mathbf{220}\mathrm{C}_{(b)}$ with a length $\mathbf{224}\mathrm{C}_{(b)}$ which is approximately a double of module-length $\mathbf{312}_{(b)}$ of each of LED-array modules $\mathbf{32}_{(b)}$. FIGS. 32-35 show alternative arrangements of LED-array modules $\mathbf{32}_{(b)}$ on LED-adjacent surface $\mathbf{220}\mathrm{C}_{(b)}$ of same width $\mathbf{222}_{(b)}$. FIGS. 36, 37 and 37A show a combination of different-length modules $\mathbf{31}_{(b)}$ and $\mathbf{32}_{(b)}$ on LED-adjacent surface $\mathbf{220}\mathrm{C}_{(b)}$. Such arrangement allows for providing a reduced illumination intensity by reducing a number of LED modules $\mathbf{32}_{(b)}$ or using modules $\mathbf{31}_{(b)}$ with less LEDs.

FIGS. 38-41 show an LED light fixture $\mathbf{100}\mathrm{D}_{(b)}$ with LED-adjacent surface $\mathbf{220}\mathrm{D}_{(b)}$ supporting a plurality of modules of different module-lengths—both modules $\mathbf{31}_{(b)}$ (ten LEDs $\mathbf{18}_{(b)}$) with module-length $\mathbf{311}_{(b)}$ and modules $\mathbf{32}_{(b)}$ (twenty LEDs $\mathbf{18}_{(b)}$) with module-length $\mathbf{312}_{(b)}$. Fixture $\mathbf{100}\mathrm{D}_{(b)}$ has LED-adjacent surface $\mathbf{220}\mathrm{D}_{(b)}$ with a length $\mathbf{224}\mathrm{D}_{(b)}$ which is approximately a sum of module-lengths $\mathbf{311}_{(b)}$ and $\mathbf{312}_{(b)}$ of pairs of LED-array modules $\mathbf{31}_{(b)}$ and $\mathbf{32}_{(b)}$ in end-to-end relationship to one another. FIGS. 38-41 show alternative arrangements of LED-array modules $\mathbf{31}_{(b)}$ and $\mathbf{32}_{(b)}$ on LED-adjacent surface $\mathbf{220}\mathrm{D}_{(b)}$.

FIGS. 32-41 illustrate fixtures $\mathbf{100}\mathrm{C}_{(b)}$ and $\mathbf{100}\mathrm{D}_{(b)}$ with the plurality of LED-array modules $\mathbf{31}_{(b)}$ and $\mathbf{32}_{(b)}$ in end-to-end relationship to one another. In such arrangement, the modules are positioned as modules $\mathbf{33}_{(b)}$ which are proximal to first end-portion $\mathbf{11}_{(b)}$, and modules $\mathbf{34}_{(b)}$ which are distal from first end-portion $\mathbf{11}_{(b)}$. It can be seen in FIGS. 22, 42 and 45, that modules $\mathbf{31}_{(b)}$ and $\mathbf{32}_{(b)}$ include wireways $\mathbf{13}_{(b)}$ that connect to water/air-tight wire-accesses $\mathbf{113}_{(b)}$ and $\mathbf{123}_{(b)}$ of first and second end-portions $\mathbf{11}_{(b)}$ and $\mathbf{12}_{(b)}$, respectively.

Figure 20:
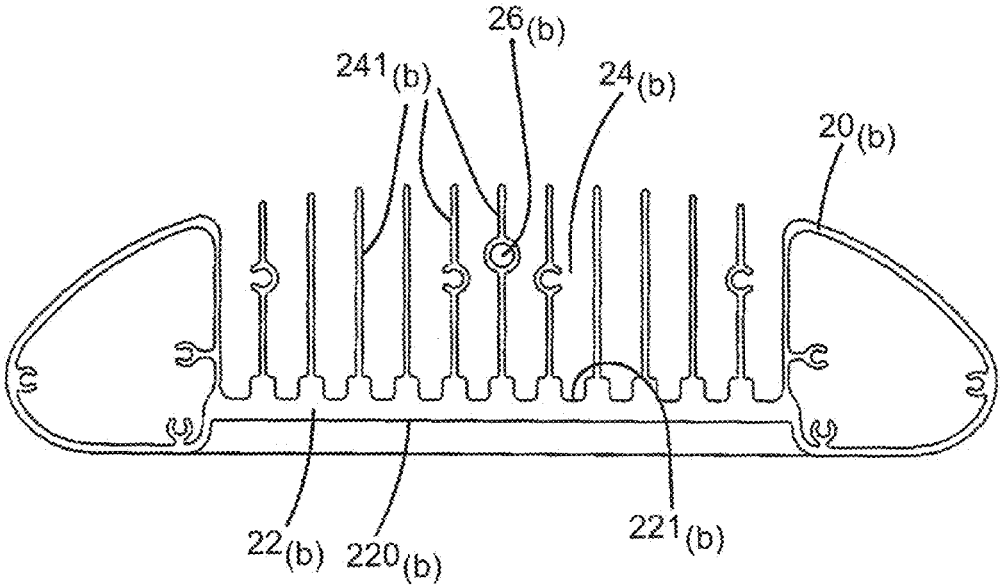
FIG. 20 is a widthwise cross-sectional view of the LED light fixture across the single-piece extrusion showing one configuration of the extrusion.
Figure 21:
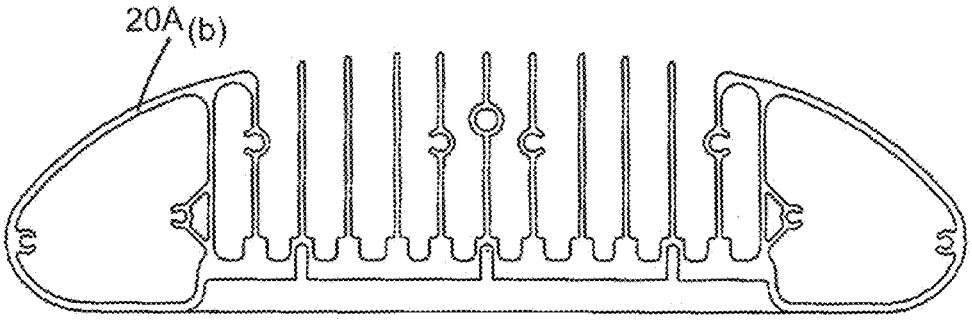
FIG. 21 is a widthwise cross-sectional view of the LED light fixture across the single-piece extrusion showing another configuration of the extrusion.
Figure 52:
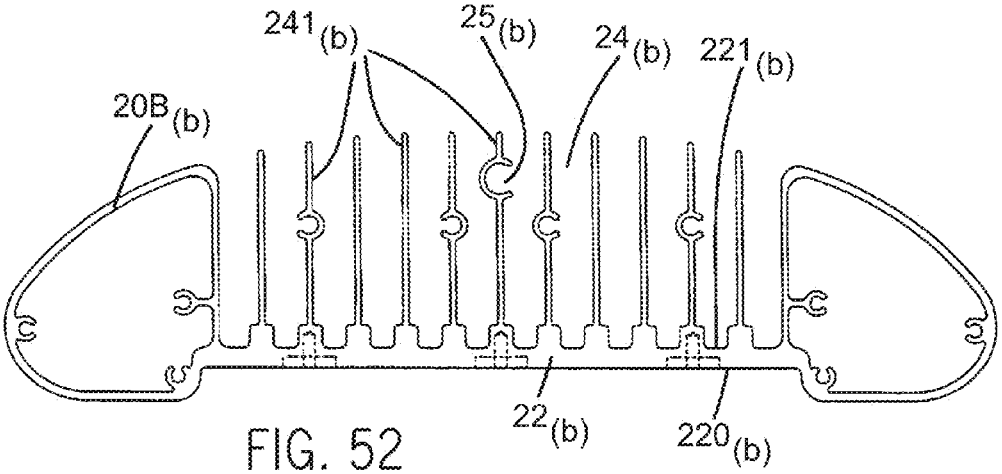
FIG. 52 is a widthwise cross-sectional view of the LED light fixture across the single-piece extrusion showing an example of a wireway retention channel.
Figure 53:
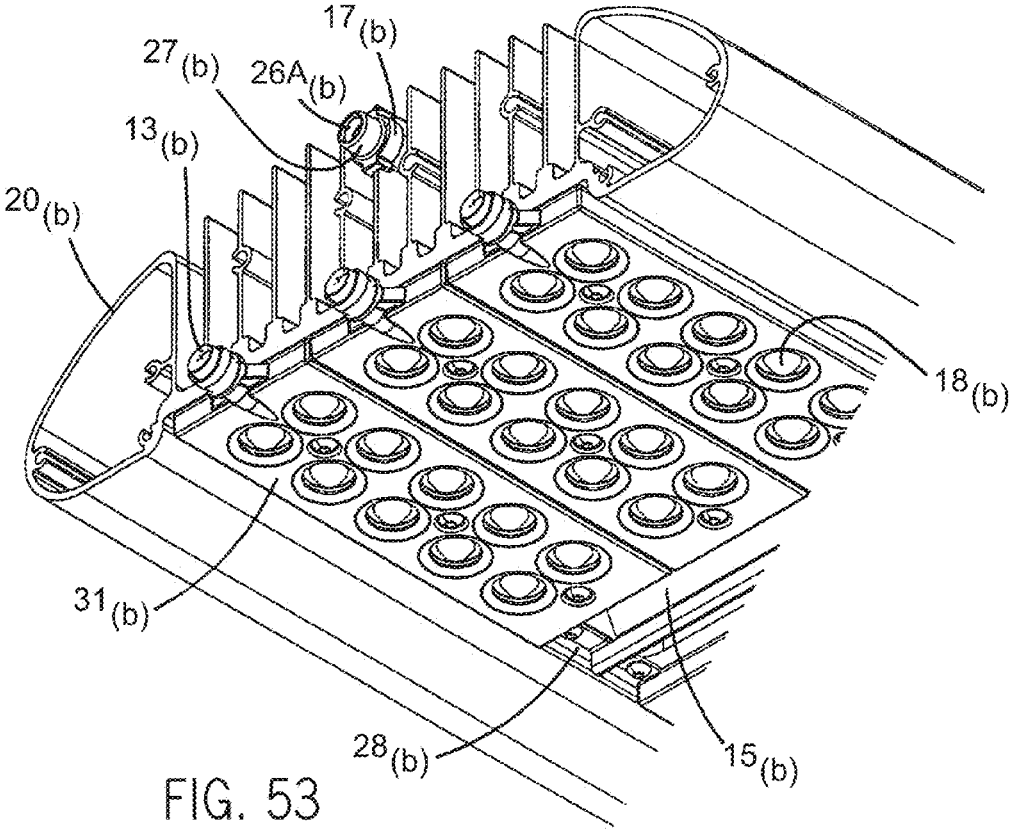
FIG. 53 is a fragmentary perspective view from below of the single-piece extrusion of the LED light fixture of FIG. 46.
Figures 54, 55, 56:
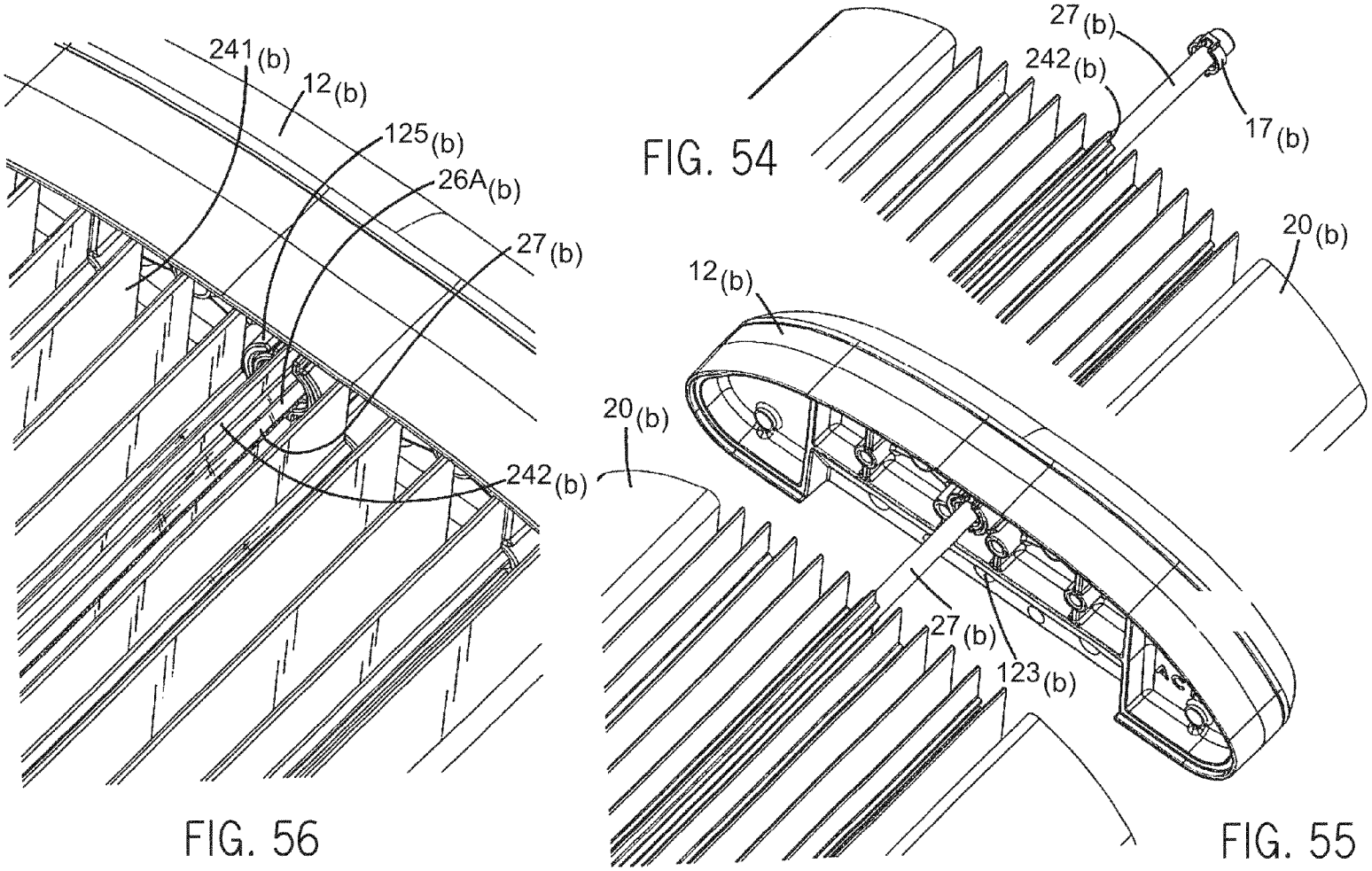
FIG. 54 is a fragmentary perspective view from above of the single-piece extrusion of FIG. 52 showing a wireway tube extending from the retention channel.
FIG. 55 is a fragmentary perspective view from above of the single-piece extrusion of FIG. 52 showing a wireway tube extending from the retention channel and received by the second end-portion.
FIG. 56 is a fragmentary perspective view from above of the single-piece extrusion of FIG. 52 with the wireway tube secured with respect to the second end-portion.
Figure 57:
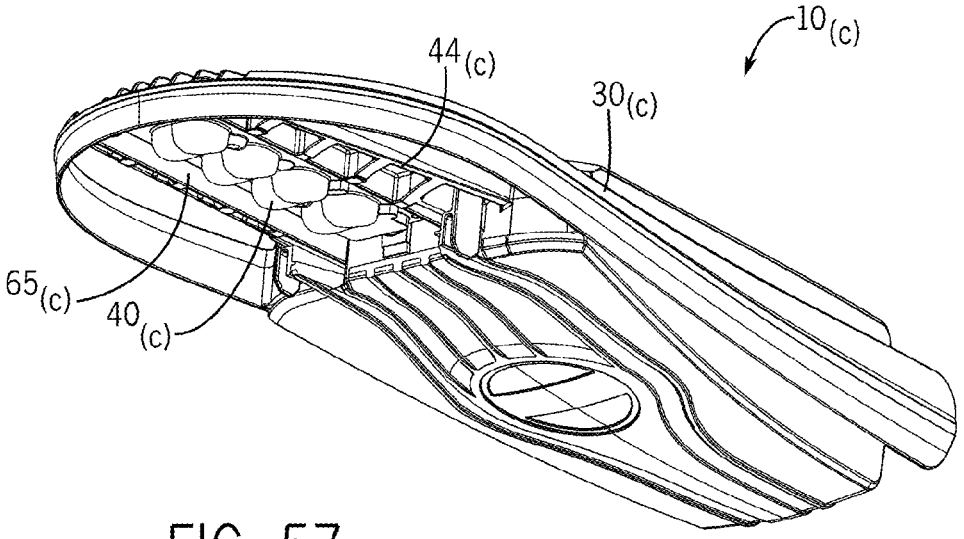
FIG. 57 is a perspective view from below of one embodiment of an LED light fixture in accordance with this invention.

Extrusion $\mathbf{20}_{(b)}$ includes a water/air-tight wireway $\mathbf{26}_{(b)}$ for receiving wires $\mathbf{19}_{(b)}$ from distal LED-array modules $\mathbf{34}_{(b)}$. Wireway $\mathbf{26}_{(b)}$ is connected to housing $\mathbf{10}_{(b)}$ through wire-accesses $\mathbf{115}_{(b)}$ and $\mathbf{125}_{(b)}$ of first and second end-portions $\mathbf{11}_{(b)}$ and $\mathbf{12}_{(b)}$, respectively. Wires $\mathbf{19}_{(b)}$ from distal modules $\mathbf{34}_{(b)}$ reach water/air-tight chamber $\mathbf{110}_{(b)}$ of first end-portion $\mathbf{11}_{(b)}$ through wireway $\mathbf{26}_{(b)}$ connected to water/air-tight wire-access $\mathbf{115}_{(b)}$. Wireway $\mathbf{26}_{(b)}$ extends along and through heat-dissipating section $\mathbf{24}_{(b)}$ and is spaced from base $\mathbf{22}_{(b)}$. Heat-dissipating section $\mathbf{24}_{(b)}$ includes parallel fins $\mathbf{242}_{(b)}$ along the lengths of single-piece extrusion $\mathbf{20}_{(b)}$. FIGS. 20 and 21 illustrate wireway $\mathbf{26}_{(b)}$ as formed of and along fin $\mathbf{242}_{(b)}$. Fin $\mathbf{242}_{(b)}$ is a middle fin positioned at the longitudinal axis of extrusion $\mathbf{20}_{(b)}$. However, wireway $\mathbf{26}_{(b)}$ may be formed along any other fin. Such choice depends on the fixture configuration and is in no way limited to the shown embodiments. Wireway $\mathbf{26}_{(b)}$ may be positioned along fin $\mathbf{242}_{(b)}$ at any distance from base $\mathbf{22}_{(b)}$ that provides safe temperatures for wires $\mathbf{19}_{(b)}$. It should, therefore, be appreciated that wireway $\mathbf{26}_{(b)}$ may be positioned at a tip of fin $\mathbf{242}_{(b)}$ with the farthest distance from base $\mathbf{22}_{(b)}$. Alternatively, if temperature characteristics allow, wireway $\mathbf{26}_{(b)}$ may be positioned near the middle of fin $\mathbf{242}_{(b)}$ and closer to base $\mathbf{22}_{(b)}$. FIG. 53 shows wireway $\mathbf{26}\mathrm{A}_{(b)}$ as an enclosed tube $\mathbf{27}_{(b)}$ secured with respect to fin $\mathbf{242}_{(b)}$. As can be seen in FIGS. 52 and 54-56, fin $\mathbf{242}_{(b)}$ forms an extruded retention channel $\mathbf{25}_{(b)}$ securely retaining wireway tube $\mathbf{27}_{(b)}$ therein. Wireway $\mathbf{26}\mathrm{A}_{(b)}$ may have a jacketed cord or rigid tube which is made of aluminum or other suitable material. As best seen in FIG. 52, extruded retention channel $\mathbf{25}_{(b)}$ has an open "C" shape with an opening being smaller than the largest inner diameter. When the jacketed cord is secured with respect to fin $\mathbf{242}_{(b)}$ by snap fitting or the rigid tube is slid inside retention channel $\mathbf{25}_{(b)}$, retention channel $\mathbf{25}_{(b)}$ securely holds wireway tube $\mathbf{27}_{(b)}$.

Wire-accesses $\mathbf{115}_{(b)}$, $\mathbf{125}_{(b)}$ and wireway $\mathbf{26}_{(b)}$ provide small surfaces between water/air-tight chamber and non-water/air-tight environment. Such small surfaces are insulated with sealing gaskets $\mathbf{17}_{(b)}$ thereabout. In inventive LED light fixture $\mathbf{100}_{(b)}$, the mounting of single-piece extrusion $\mathbf{20}_{(b)}$ with respect to end-portions $\mathbf{11}_{(b)}$ and $\mathbf{12}_{(b)}$ provides sufficient pressure on sealing gaskets $\mathbf{17}_{(b)}$ such that no additional seal, silicon or the like, is necessary.

FIGS. 43-47 show LED light fixture $\mathbf{100}\mathrm{E}_{(b)}$ in which single-piece extrusion $\mathbf{20}\mathrm{E}_{(b)}$ has a venting aperture $\mathbf{28}_{(b)}$ therethrough to provide ingress of cool-air $\mathbf{3}_{(b)}$ to and along heat-dissipating surfaces $\mathbf{241}_{(b)}$ by upward flow of heated air $\mathbf{5}_{(b)}$ from surfaces $\mathbf{241}_{(b)}$. Venting aperture $\mathbf{28}_{(b)}$, as shown in FIGS. 43, 44, 46 and 47, is an elongate aperture across a majority of the width of base $\mathbf{22}_{(b)}$. FIGS. 43-46 further show a deflector member $\mathbf{15}_{(b)}$ secured to base $\mathbf{22}_{(b)}$ along elongate aperture $\mathbf{28}_{(b)}$. Deflector member $\mathbf{15}_{(b)}$ has a pair of oppositely-facing beveled deflector surfaces $\mathbf{150}_{(b)}$ oriented to direct and accelerate air flow in opposite directions along heat-dissipating surfaces $\mathbf{241}_{(b)}$.

In LED light fixture $\mathbf{100}\mathrm{E}_{(b)}$, as shown in FIGS. 43-47, the plurality of LED-array modules $\mathbf{31}_{(b)}$ are in lengthwise relationship to one another. Venting aperture $\mathbf{28}_{(b)}$ is distal from first and second ends $\mathbf{201}_{(b)}$ and $\mathbf{202}_{(b)}$ of extrusion $\mathbf{20}_{(b)}$.

In LED light fixture $\mathbf{100}\mathrm{E}_{(b)}$ distal LED-array modules $\mathbf{34}_{(b)}$ are spaced from proximal LED-array modules $\mathbf{33}_{(b)}$. Venting aperture $\mathbf{28}_{(b)}$ is distal from first and second ends $201_{(b)}$ and $202_{(b)}$ of extrusion $20_{(b)}$ and is at the space $29_{(b)}$ between proximal and distal LED-array modules $33_{(b)}$ and $34_{(b)}$.

Figure 43:
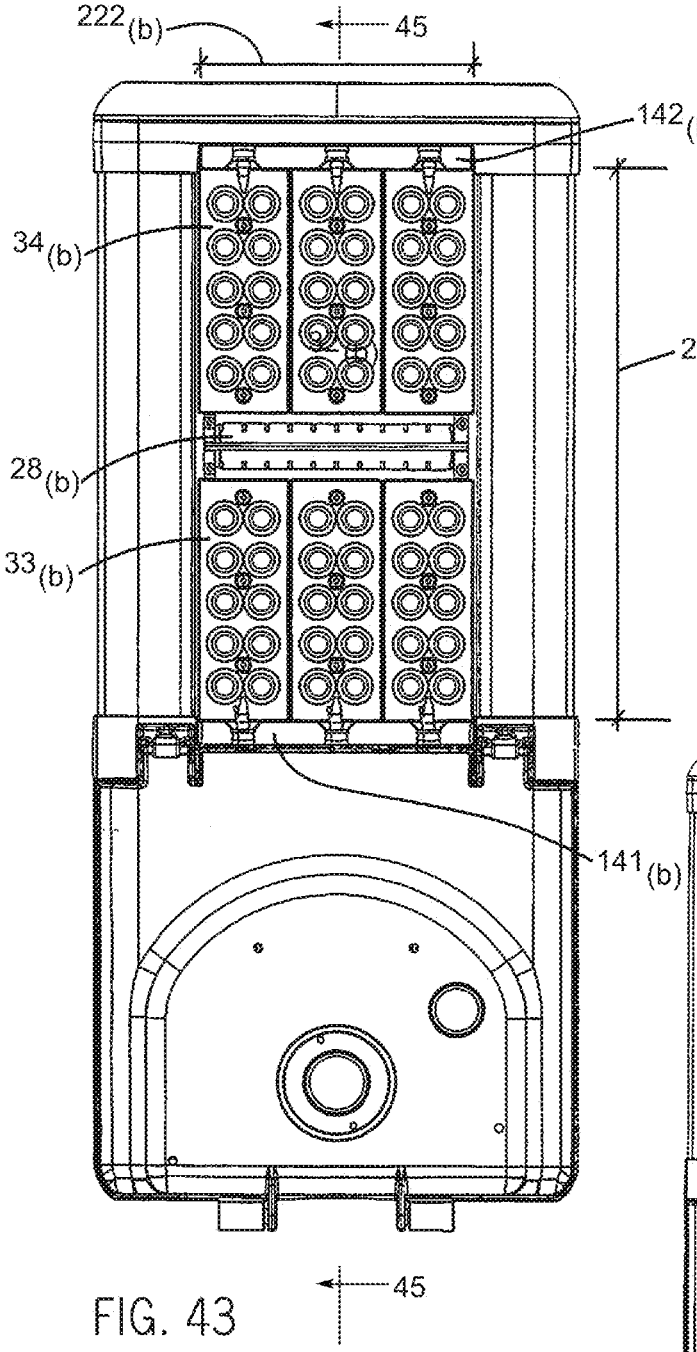
FIG. 43 is a bottom plan view of an embodiment of the LED light fixture which has a venting aperture through a base of the extrusion.
Figure 44:
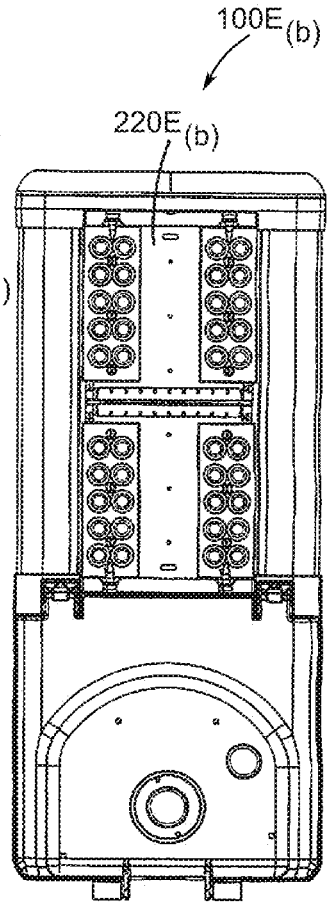
FIG. 44 is a bottom plan view of another embodiment of the LED light fixture as in FIG. 43 but with an alternative arrangement of LED modules.

LED-adjacent surface $220E_{(b)}$ of fixture $100E_{(b)}$ has a length $224E_{(b)}$. As best shown in FIG. 43, length $224E_{(b)}$ is approximately a dimension which is (a) the sum of module-length $311_{(b)}$ of pairs of end-to-end LED-array modules $31_{(b)}$ plus (b) the length of space $29_{(b)}$ between proximal and distal LED-array modules $33_{(b)}$ and $34_{(b)}$ LED-adjacent surface $220E_{(b)}$, as further shown in FIG. 43, has width $222_{(b)}$ which is approximately the multiple of the three LED-array modules $31_{(b)}$ mounted in side-by-side relationship thereon by module-width $310_{(b)}$.

Figure 48:
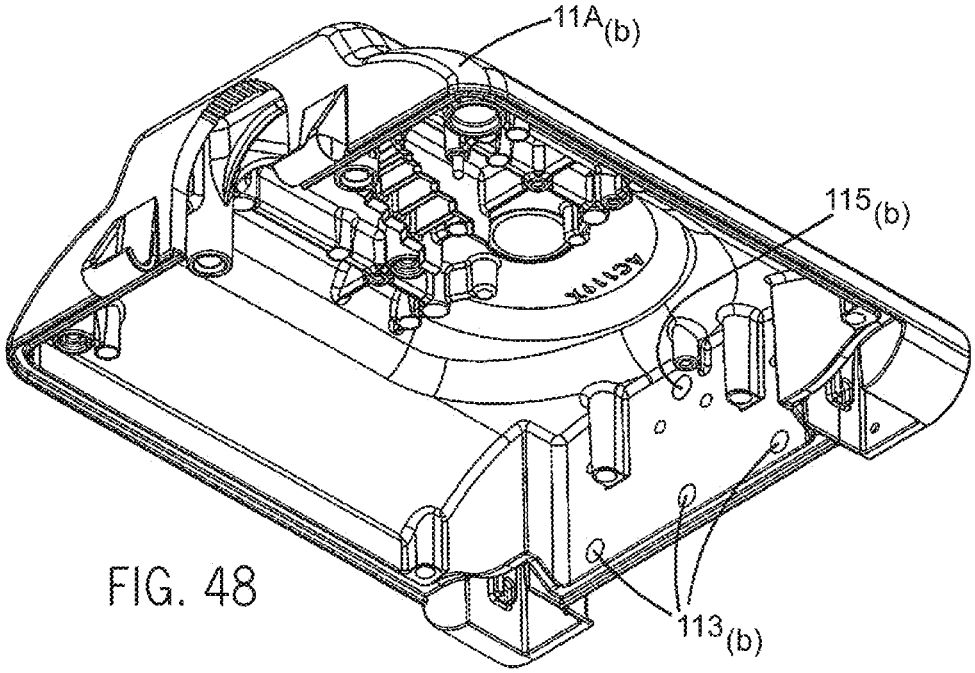
FIG. 48 is a perspective view from below of an upper portion of a first-end portion of a housing of the inventive LED light fixture.
Figure 49:
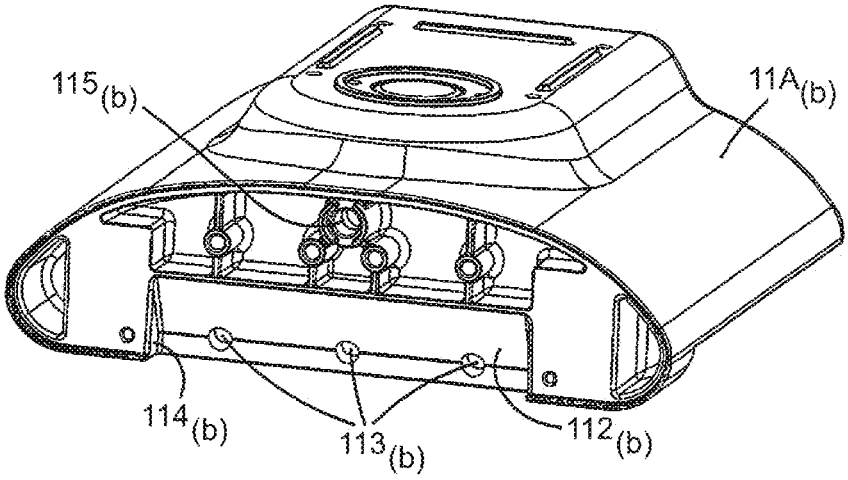
FIG. 49 is a front perspective view of the upper portion of FIG. 48.

FIGS. 48 and 49 best illustrate first end-portion $11_{(b)}$ which is configured for mating arrangement with single-piece extrusion $20_{(b)}$ and its wireway $26_{(b)}$.

Figure 50:
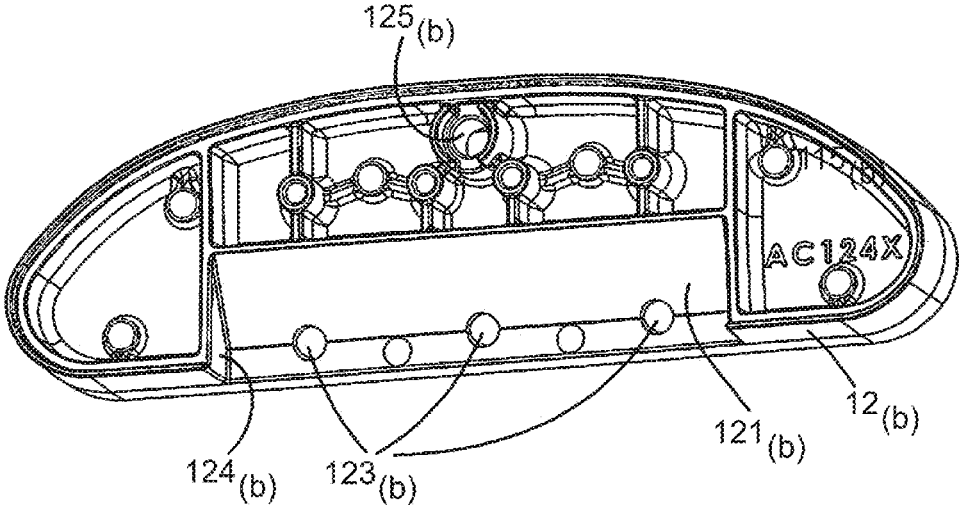
FIG. 50 is a rear perspective view of an end-casting of a second-end portion of the housing of the inventive LED light fixture.
Figure 51:
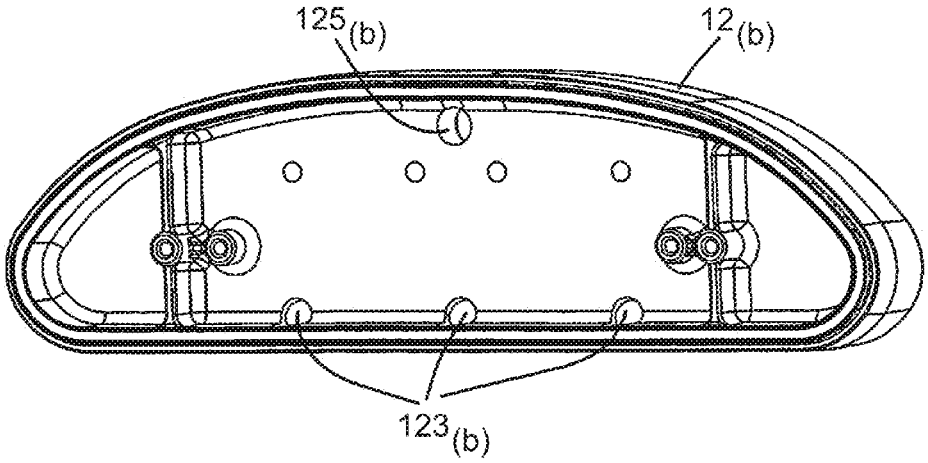
FIG. 51 is a front perspective view of the end-casting of FIG. 49.

FIGS. 50 and 51 illustrate second end-portion $12_{(b)}$ which is configured for mating arrangement with single-piece extrusion $20_{(b)}$ and its wireway $26_{(b)}$ and shows wire-accesses $123_{(b)}$ and $125_{(b)}$ through which wires $19_{(b)}$ are received into second end-portion $12_{(b)}$ and channeled to wireway $26_{(b)}$.

FIGS. 57-75, 88-89 and 91-93 illustrate a light fixture $10_{(c)}$ which is a first embodiment in accordance with this invention. Light fixture $10_{(c)}$ includes a frame $30_{(c)}$ and an LED assembly $40_{(c)}$ secured with respect to frame $30_{(c)}$. Frame $30_{(c)}$ surrounds and defines a forward open region $31_{(c)}$ and a rearward region $32_{(c)}$. Rearward region has a rearmost portion $33_{(c)}$ adapted for securement to a support member $11_{(c)}$. LED assembly $40_{(c)}$ is positioned within open forward region $31_{(c)}$ with open spaces $12_{(c)}$ remaining therebetween—e.g., between either side of frame $30_{(c)}$ and LED assembly $40_{(c)}$. Other embodiments are possible where there are additional open spaces or one single open space.

Figure 61:
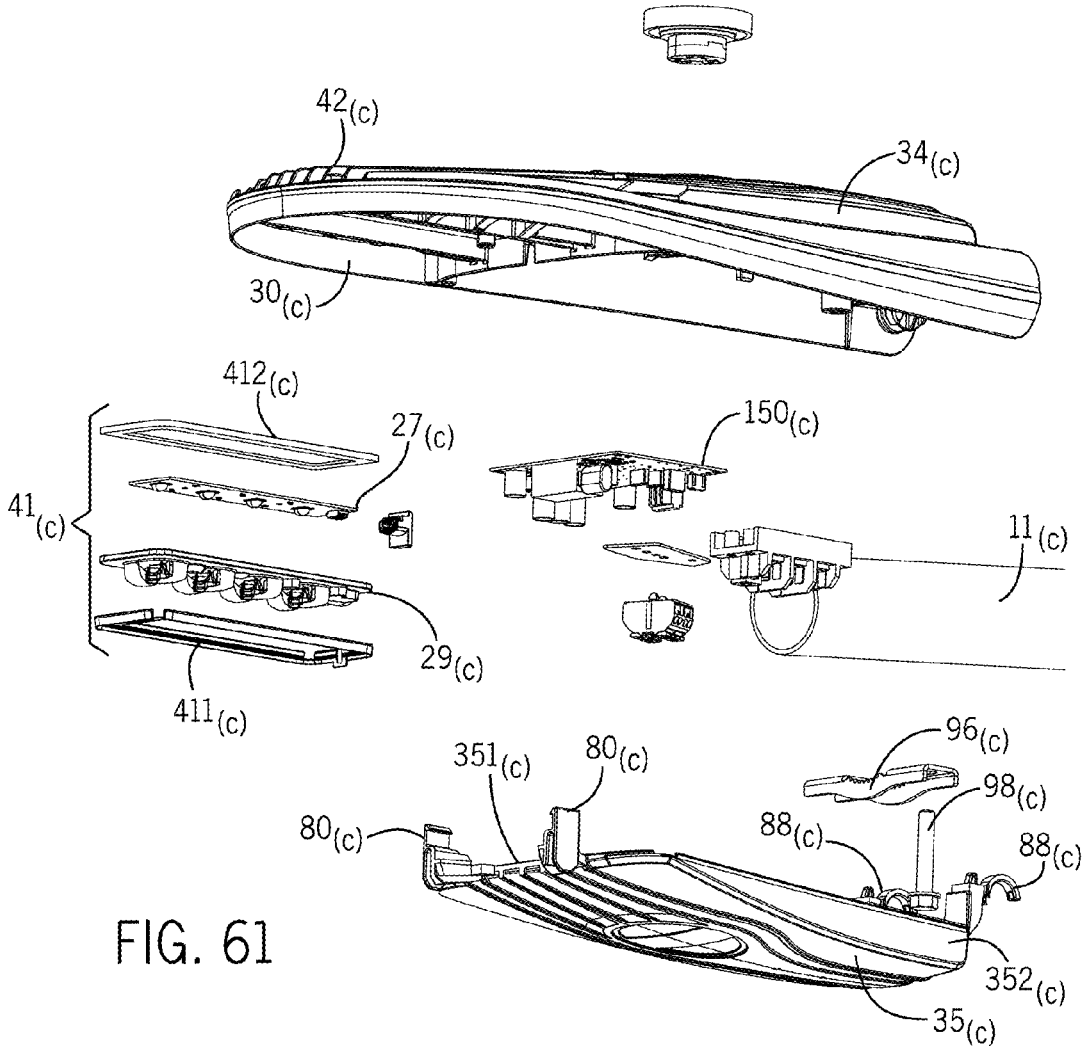
FIG. 61 is an exploded perspective view of the LED lighting of FIG. 57.

LED assembly $40_{(c)}$ includes a heat sink $42_{(c)}$ and an LED illuminator $41_{(c)}$ secured with respect to heat sink $42_{(c)}$. Heat sink $42_{(c)}$ includes an LED-supporting region $43_{(c)}$ with heat-dissipating surfaces $44_{(c)}$ extending from LED-supporting region $43_{(c)}$. LED illuminator $41_{(c)}$ is secured with respect to LED-supporting region $43_{(c)}$. As shown in FIG. 61, LED illuminator $41_{(c)}$ includes a circuit board $27_{(c)}$ with LED emitters $20_{(c)}$ thereon and an optical member $29_{(c)}$ over LED emitters $20_{(c)}$ for illumination of areas below light fixture $10_{(c)}$ (when fixture $10_{(c)}$ is mounted in its usual use orientation).

FIGS. 83-87 show LED emitters in different forms among those usable in the present invention. Each LED emitter includes one or more light-emitting diodes (LED) $22_{(c)}$ with a primary lens $24_{(c)}$ thereover, forming what is referred to as LED package.

Figure 83:
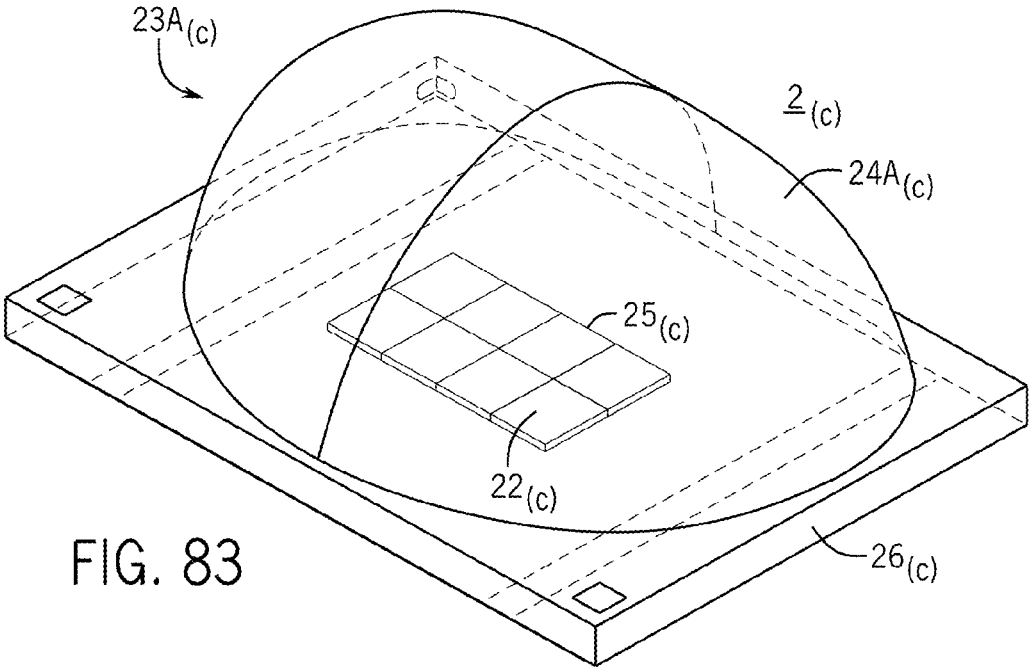
FIGS. 83 and 84 are enlarged perspective views of two examples of LED packages usable in LED light fixtures of this invention, the LED packages including different arrays of LEDs on a submount with an asymmetric primary lens overmolded on the LED arrays.
Figure 84:
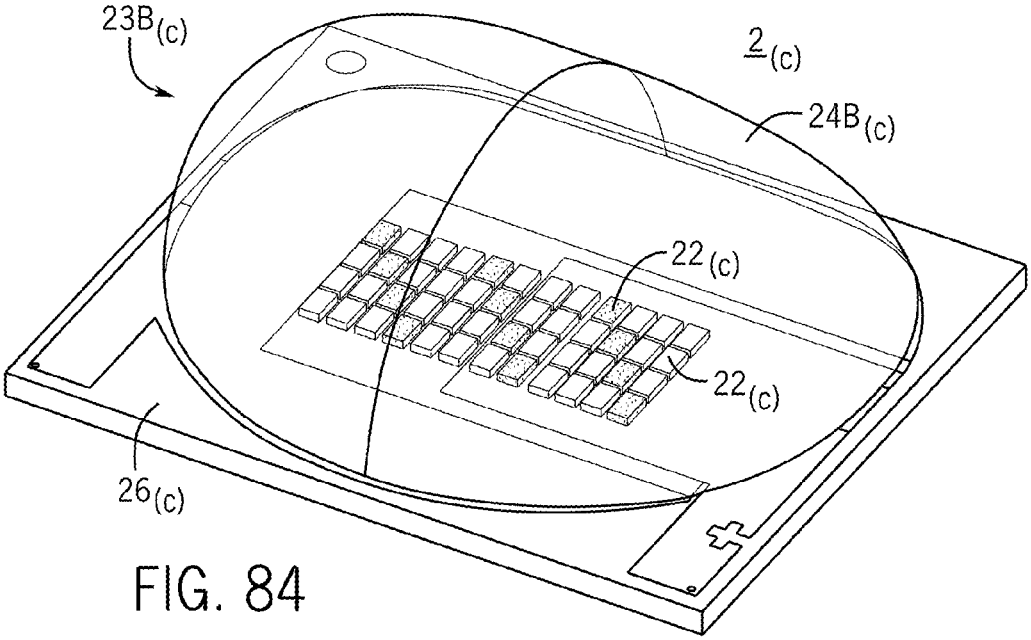

FIGS. 83 and 84 illustrate exemplary LED packages $23A_{(c)}$ and $23B_{(c)}$, each including an array of LEDs $22_{(c)}$ on an LED-populated area $25_{(c)}$ which has an aspect ratio greater than 1, and primary lenses $24_{(c)}$ being overmolded on a submount $26_{(c)}$ over LED-populated area $25_{(c)}$. It is seen in FIG. 84 that the array may include LEDs $22_{(c)}$ emitting different-wavelength light of different colors such as including red LEDs along with light green or other colors to achieve natural white light. Light emitters of the type as LED packages $23A_{(c)}$ and $23B_{(c)}$ are described in detail in patent application Ser. No. 13/441,558, filed on Apr. 6, 2012, and in patent application Ser. No. 13/441,620, filed on Apr. 6, 2012. Contents of both applications are incorporated herein by reference in their entirety.

FIGS. 83 and 84 also illustrate versions of LED light emitters configured to refract LED-emitted light toward a preferential direction 2. In each LED package $23A_{(c)}$ and $23B_{(c)}$, each LED array defines emitter axis. FIGS. 83 and 84 illustrate primary lens $24A_{(c)}$ configured to refract LED-emitted light toward preferential side 2. It should be understood that for higher efficiency the LED emitter may have a primary lens having its centerline offset from the emitter axis and also being shaped for refraction of LED-emitted light toward preferential side 2. In FIGS. 83 and 84, primary lens $24A_{(c)}$ is asymmetric.

Figure 85:
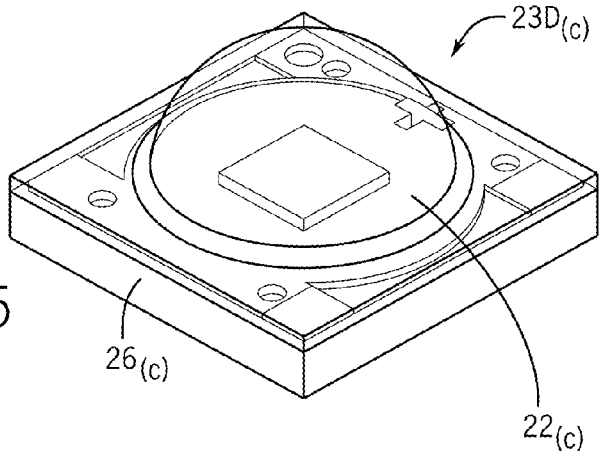
FIG. 85 is an enlarged perspective of yet another example of an LED package which has a single LED on a submount with an overmolded hemispheric primary lens.
Figure 86:
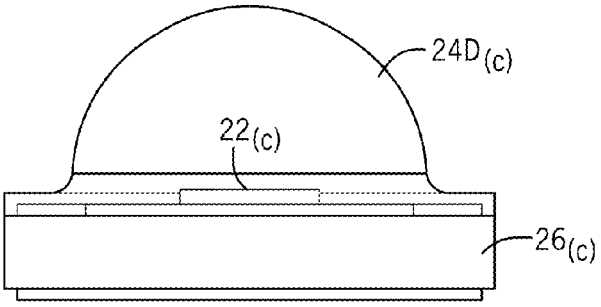
FIG. 86 is an enlarged side view of the LED package of FIG. 85.
Figure 87:
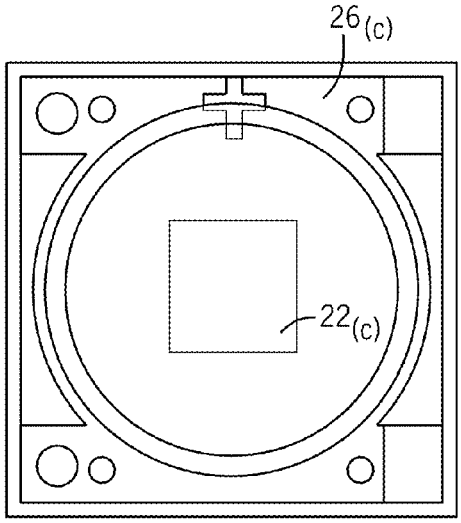
FIG. 87 is an enlarged top plan view of the LED package of FIG. 85.

FIGS. 85-87 show LED package $23D_{(c)}$ with a single LED $22_{(c)}$ on a submount $26_{(c)}$ and a hemispheric primary lens $24D_{(c)}$ coaxially overmolded on submount $26_{(c)}$ over LED $22_{(c)}$.

In fixtures utilizing a plurality of emitters, a plurality of LEDs or LED arrays may be disposed directly on a common submount in spaced relationship between the LEDs or LED arrays, each of which is overmolded with a respective primary lens. These types of LED emitters are sometimes referred to as chip-on-board LEDs.

LED optical member $29_{(c)}$ is a secondary lens placed over the primary lens. In embodiments with a plurality of LED emitters (packages), optical member $29_{(c)}$ includes a plurality of lenses $28_{(c)}$ each positioned over a respective one of the primary lenses. The plurality of secondary lenses $28_{(c)}$ are shown molded as a single piece $29_{(c)}$ with a single flange surrounding each of the plurality of lenses $28_{(c)}$.

FIG. 61 also illustrates LED illuminator $41_{(c)}$ including a securement structure which includes rigid peripheral structure $411_{(c)}$ which applies force along the circuit-board peripheral area toward heat sink $42_{(c)}$. This structure serves to increase thermal contact across the facing area of the thermal-engagement surface of circuit board $27_{(c)}$ and the surface of heat sink $42_{(c)}$ which receives circuit board $27_{(c)}$. This arrangement facilitates removal of heat from LED emitters $20_{(c)}$ during operation by increasing surface-to-surface contact between the thermal-engagement surface of the circuit board and the heat sink by facilitating excellent, substantially uniform thermal communication from the circuit board to the heat sink, thereby increasing heat transfer from the LEDs to the heat sink during operation. Rigid peripheral structure $411_{(c)}$ may be a drawn sheet-metal single-piece structure. As shown in FIG. 61, a gasket $412_{(c)}$ is sandwiched between optical member $29_{(c)}$ and heat sink $42_{(c)}$, thereby facilitating fluid-tight sealing of the circuit board $27_{(c)}$. The securement structure is described in detail in Patent Application Ser. No. 61/746,862, filed Dec. 28, 2012, the entire contents of which are incorporated herein by reference.

LED light fixture $10_{(c)}$ has a housing $17_{(c)}$ and LED assembly $40_{(c)}$ is secured with respect to housing $17_{(c)}$. Housing $17_{(c)}$ has an enclosure $13_{(c)}$ which is within rearward region $32_{(c)}$ and defines a chamber $14_{(c)}$ enclosing electronic LED power circuitry $15_{(c)}$. As shown in FIGS. 61-63, 65 and 73, enclosure $13_{(c)}$ has an upper shell $34_{(c)}$ and a lower shell $35_{(c)}$. Lower shell $35_{(c)}$, which is a one-piece polymeric structure, is movably secured with respect to upper shell $34_{(c)}$, which is a metal structure.

Figure 75:
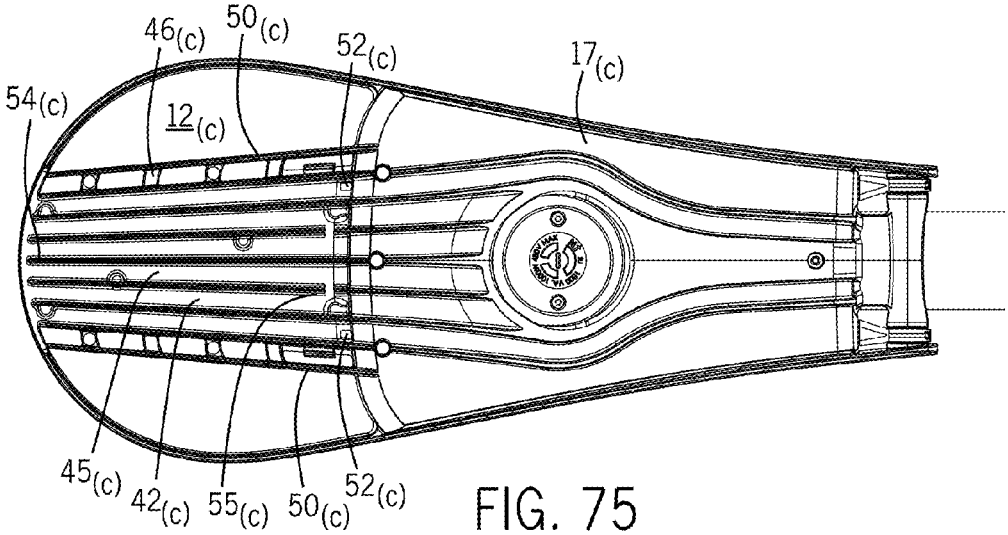
FIG. 75 is a top plan view of the LED light fixture secured to a support member.
Figure 76:
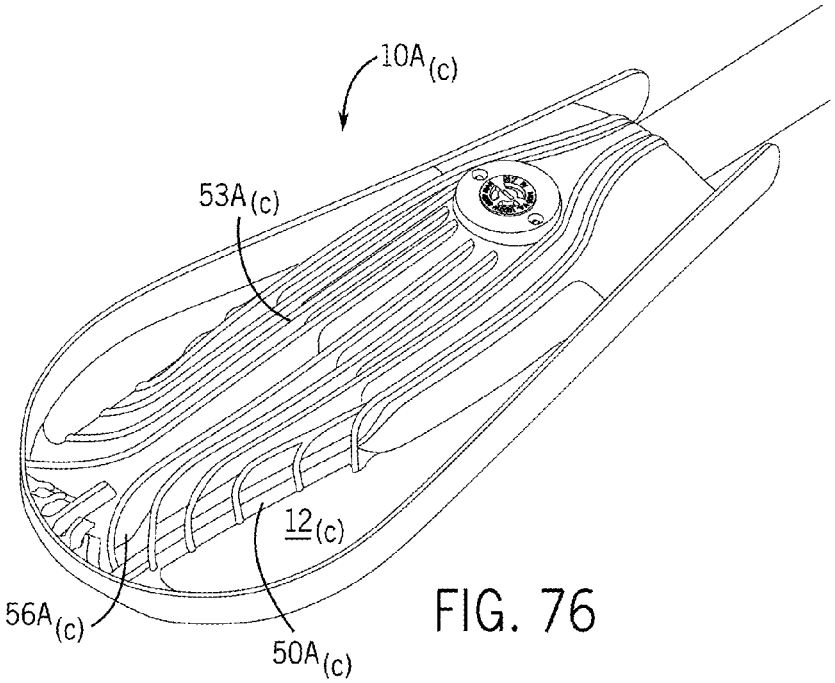
FIG. 76 is a top perspective view of an alternative embodiment of this invention.
Figure 77:
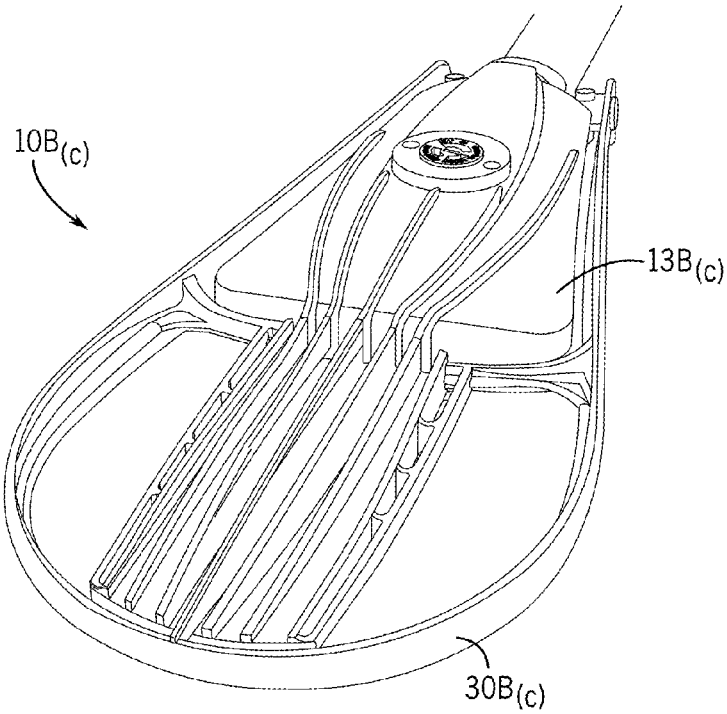
FIG. 77 is a front top perspective view of another alternative embodiment of this invention.
Figure 78:
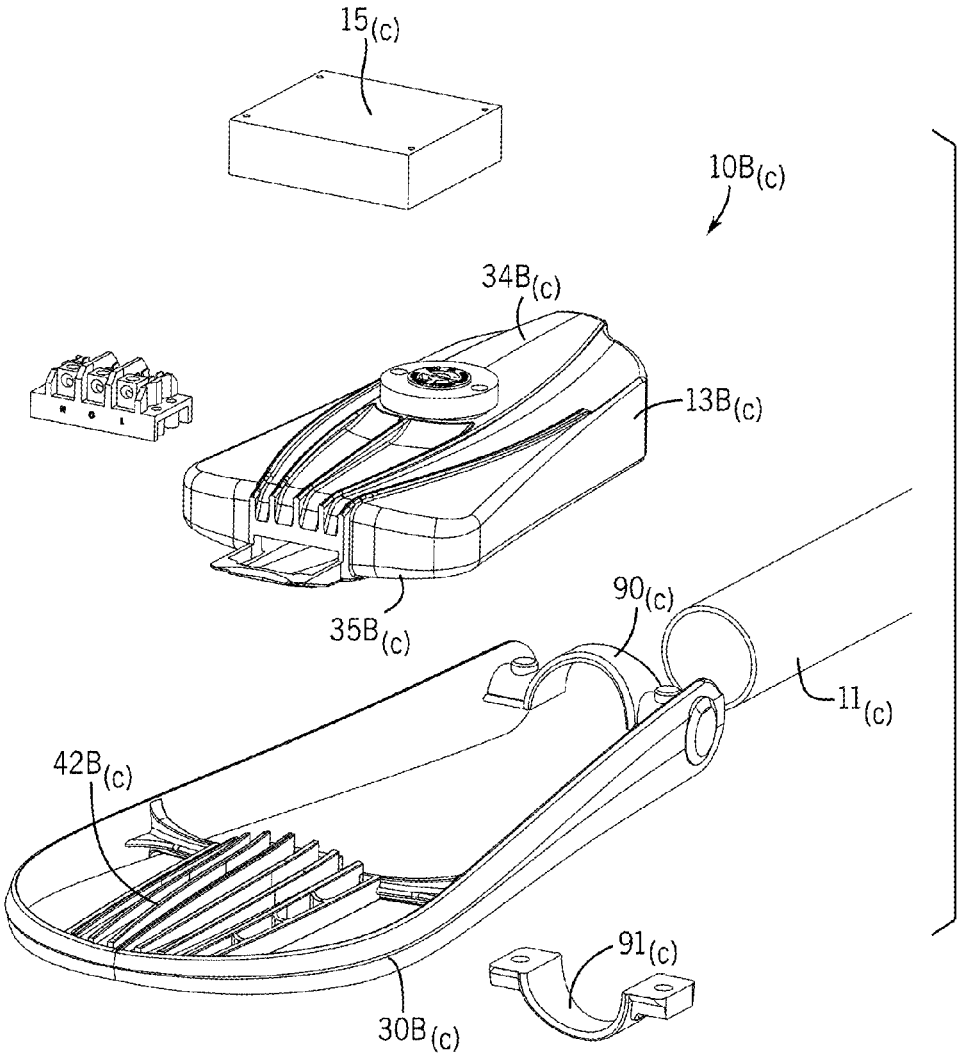
FIG. 78 is an exploded perspective view of the LED light fixture of FIG. 77.

In various embodiments of the invention, including the first embodiment (which is shown in FIGS. 57-75, 88-89 and 91-93), a second embodiment which is shown in FIG. 76, and a third embodiment which is shown in FIGS. 77 and 78, the heat sink and the frame are formed as a single piece by metal casting. In the first and second of these embodiments, the frame, the heat sink and the upper shell are all formed as a single piece by metal casting.

Figure 62:
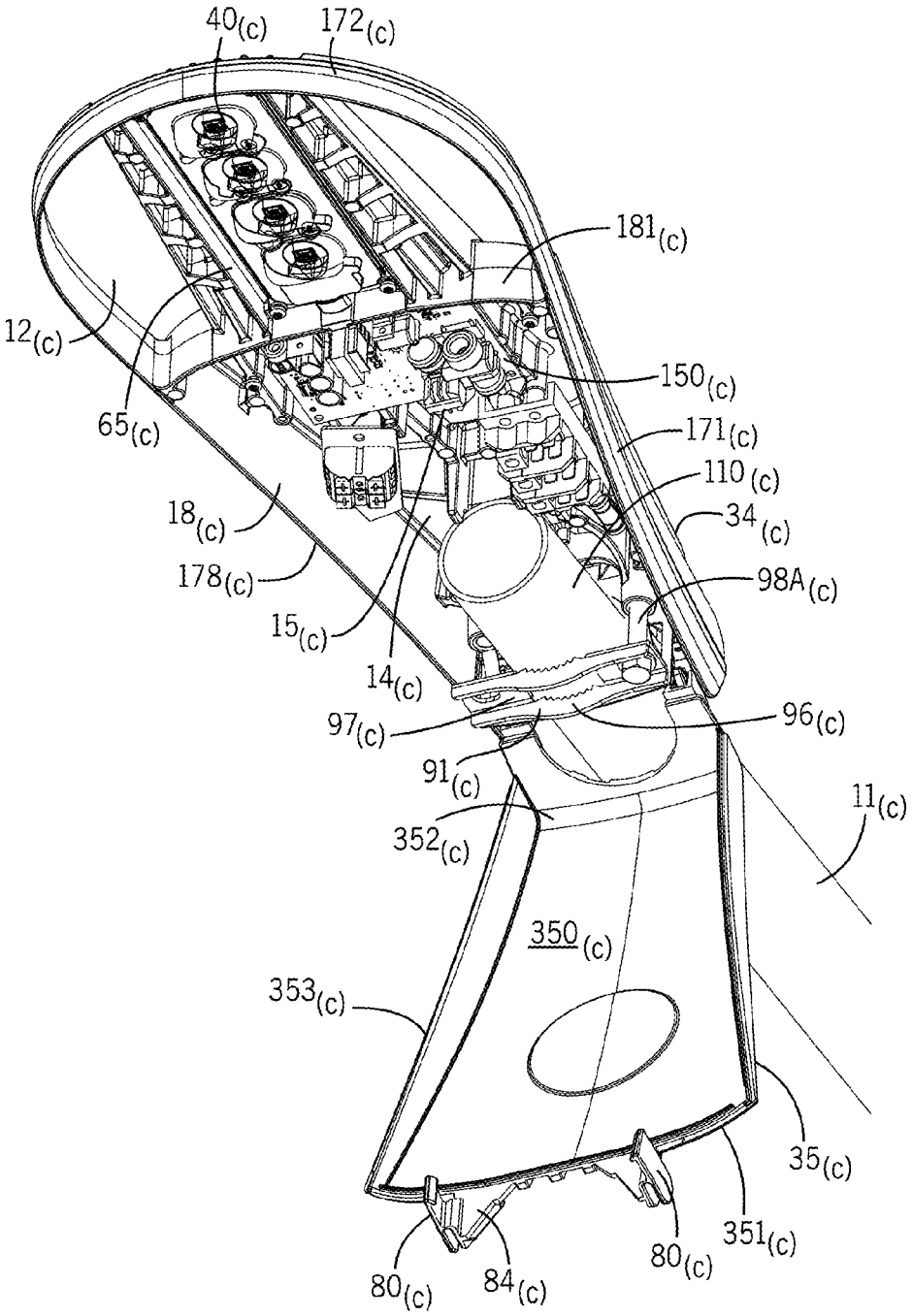
FIG. 62 is another perspective view showing a front of the LED light fixture from below with open cover member and secured to a support member.
Figure 63:
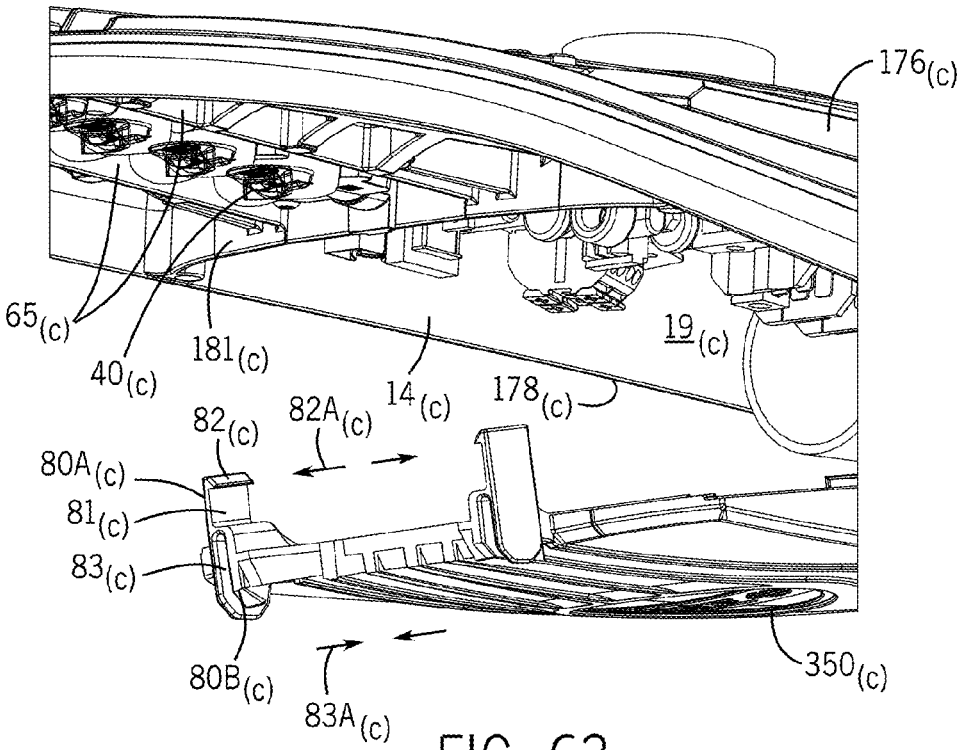
FIG. 63 is a fragmentary perspective view showing the disengaged forward end of the cover member with an integrated latching member.

FIGS. 62 and 63 illustrate electronic LED power circuitry $15_{(c)}$ within chamber $14_{(c)}$. Such LED power circuitry includes a caseless LED driver $150_{(c)}$ which is removably secured to the inner surface of upper shell 34$_{(c)}$. Driver components of caseless LED driver 150$_{(c)}$ are encapsulated (potted) in a protective polymeric material prior to installation in the fixture such that driver 150$_{(c)}$ is readily replaceable and does not have any potting applied during or after installation in the fixture. Suitable examples of such protective polymeric encapsulating material include thermoplastic materials such as low-pressure injection-molded nylon, which amply protect driver 150$_{(c)}$ from electrostatic discharge while conducting heat to upper shell 34$_{(c)}$ to facilitate cooling of the driver during operation.

With lower shell 35$_{(c)}$ being of polymeric material, a wireless signal can be received by the antenna which is fully enclosed within chamber 14$_{(c)}$ along with circuitry for wireless control of the fixture. Such circuitry with the antenna may be included as part of LED driver 150$_{(c)}$. The advantage of the fully enclosed antenna is also available on other embodiments of this invention having enclosures, all or portions of which are non-metallic material.

Housing 17$_{(c)}$ includes a main portion 171$_{(c)}$ which includes upper shell 34$_{(c)}$ and lower shell 35$_{(c)}$ and also includes a forward portion 172$_{(c)}$ extending forwardly from main portion 171$_{(c)}$. (Forward portion 172$_{(c)}$ of housing 17$_{(c)}$ is the forward portion of frame 30$_{(c)}$.) In main portion 171$_{(c)}$, upper shell 34$_{(c)}$ forms a housing body 176$_{(c)}$ and lower shell 35$_{(c)}$ serves as a cover member 350$_{(c)}$ movably secured with respect to housing body 176$_{(c)}$.

As shown in FIGS. 62-66 and 73, housing body 176$_{(c)}$ of the first embodiment has a main wall 170$_{(c)}$ (the upper portion of upper shell 34$_{(c)}$) and a surrounding wall 18$_{(c)}$ extending downwardly therefrom to a housing-body edge 178$_{(c)}$. Surrounding wall 18$_{(c)}$ has two opposed lateral wall-portions 180$_{(c)}$ extending between a forward heat-sink-adjacent wall-portion 181$_{(c)}$ and a rearward wall-portion 182$_{(c)}$. Cover member 350$_{(c)}$ has a forward end 351$_{(c)}$ and a rearward end 352$_{(c)}$. FIGS. 62, 64, 65 and 73 show rearward end 352$_{(c)}$ hingedly secured with respect to rearward wall-portion 182$_{(c)}$ of housing body 176$_{(c)}$.

The nature of the hinging securement is seen in FIGS. 59-62, 64, 65, 71, 74 and 75. In particular, polymeric lower shell 35$_{(c)}$ has an integral hinging member 87$_{(c)}$ in snap engagement with rearmost portion 33$_{(c)}$ of frame 30$_{(c)}$. Hinging member 87$_{(c)}$ has a pair of engaging portions 88$_{(c)}$, and the flexibility of the polymeric material of lower shell 35$_{(c)}$ permits snap engagement of each engaging portion 88$_{(c)}$ with rearmost portion 33$_{(c)}$ of frame 30$_{(c)}$ for secure pivoting thereabout. This provides secure connection of lower shell 35$_{(c)}$ portion with upper shell 34$_{(c)}$, allowing lower shell 35$_{(c)}$ to hang safely in open position during servicing of light fixture 10$_{(c)}$. In other words, the snap engagement of hinging member 87$_{(c)}$ with rearmost portion 33$_{(c)}$ allows controlled disengagement of lower shell 35$_{(c)}$ from upper shell 34$_{(c)}$.

Figure 64:
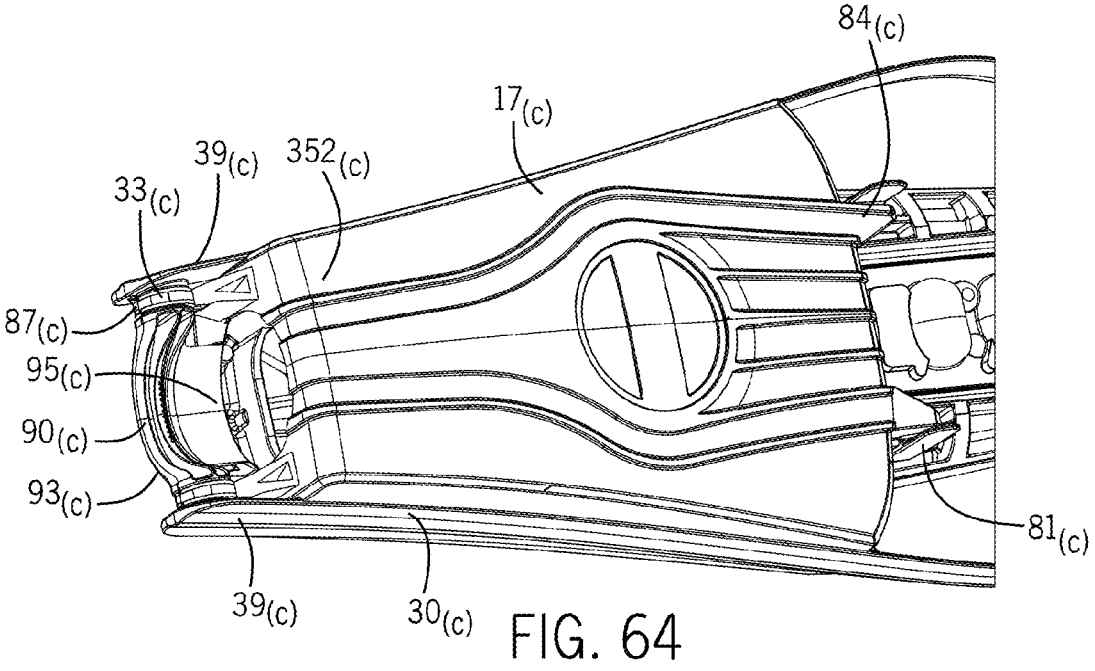
FIG. 64 is another fragmentary perspective view showing the rearward end of the cover member with an integrated hinging member.

As shown in FIGS. 61-63 and 65, forward end 351$_{(c)}$ of cover member 350$_{(c)}$ has an integrated latching member 80$_{(c)}$ detachably securing forward end 351$_{(c)}$ of cover member 350$_{(c)}$ with respect to forward wall-portion 181$_{(c)}$ of housing body 176$_{(c)}$, thereby closing chamber 14$_{(c)}$. As seen in FIGS. 62-64, cover member 350$_{(c)}$ has a cover edge 353$_{(c)}$ which is configured to engage housing-body edge 178$_{(c)}$.

FIGS. 61-63, 65 and 73 show that integrated latching member 80$_{(c)}$ includes a spring tab 81$_{(c)}$ with a hook 82$_{(c)}$ at one end 80A$_{(c)}$ and a release actuator 83$_{(c)}$ at opposite end 80B$_{(c)}$. FIG. 63 shows hook 82$_{(c)}$ positioned and configured for locking engagement with respect to housing body 176$_{(c)}$. Release actuator 83$_{(c)}$ is configured such that force applied thereto in the direction of arrow 83A$_{(c)}$ pivots hook 82$_{(c)}$ in opposite direction 82A$_{(c)}$ sufficiently to release hook 82$_{(c)}$ from the locking engagement. This serves to detach forward end 351$_{(c)}$ of cover member 350$_{(c)}$ from housing body 176$_{(c)}$ to allow access to chamber 14$_{(c)}$. In should be understood that other suitable locking engagement between cover member 350$_{(c)}$ and housing body 176$_{(c)}$ may be possible.

As seen in FIGS. 57-60, 64, 67, 68, 74 and 75, hook 82$_{(c)}$ is positioned and configured for locking engagement with the one-piece casting. Integrated latching member 80$_{(c)}$ also includes a cover-member forward extension 84$_{(c)}$ extending beyond forward wall-portion 181$_{(c)}$ of housing-body surrounding wall 18$_{(c)}$. Spring tab 81$_{(c)}$ is supported by forward extension 84$_{(c)}$ such that hook 82$_{(c)}$ is positioned for locking engagement with heat sink 42$_{(c)}$. As seen in FIGS. 59, 67, 73 and 75, heat sink 42$_{(c)}$ has a protrusion 85$_{(c)}$ configured and positioned for locking engagement by hook 82$_{(c)}$.

Light fixture 10B$_{(c)}$ of the third embodiment, shown in FIGS. 77 and 78 and which as indicated above includes frame 30B$_{(c)}$ and heat sink 42B$_{(c)}$ formed as a one-piece metal casting, has upper shell 34B$_{(c)}$ and lower shell 35B$_{(c)}$ both formed of polymeric material. The enclosure 13B$_{(c)}$ which is formed by such polymeric shells is secured with respect to the metal casting of this embodiment.

Figure 79:
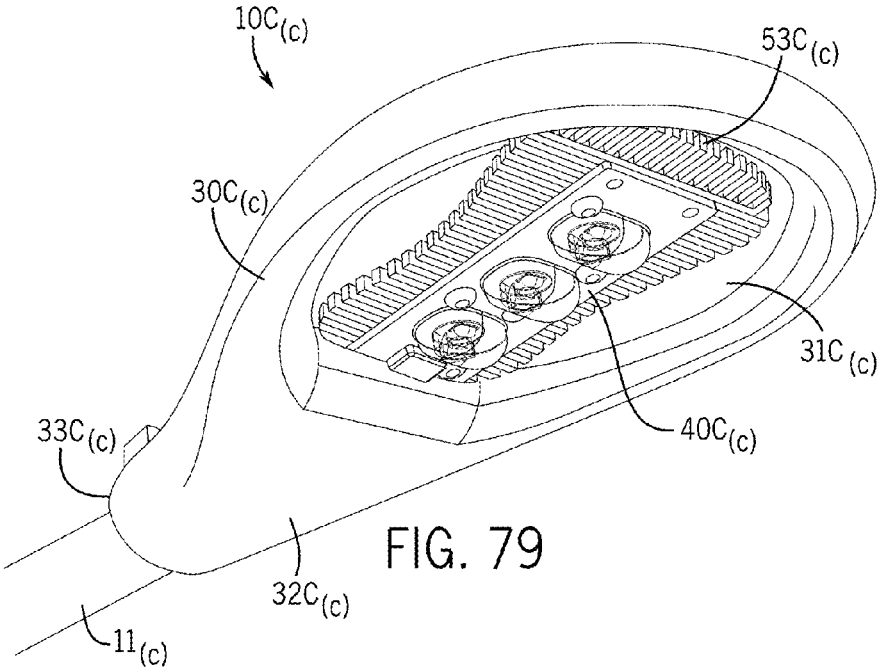
FIG. 79 is a bottom perspective view of yet another alternative embodiment of this invention.

A fourth embodiment of this invention is illustrated in FIG. 79. In such embodiment, LED light fixture 10C$_{(c)}$ has a non-metallic (polymeric) frame 30C$_{(c)}$. Frame 30C$_{(c)}$ defines a forward open region 31C$_{(c)}$ and has a rearward region 32C$_{(c)}$ with a rearmost portion 33C$_{(c)}$ adapted for securement to support member 11$_{(c)}$.

Figure 80:
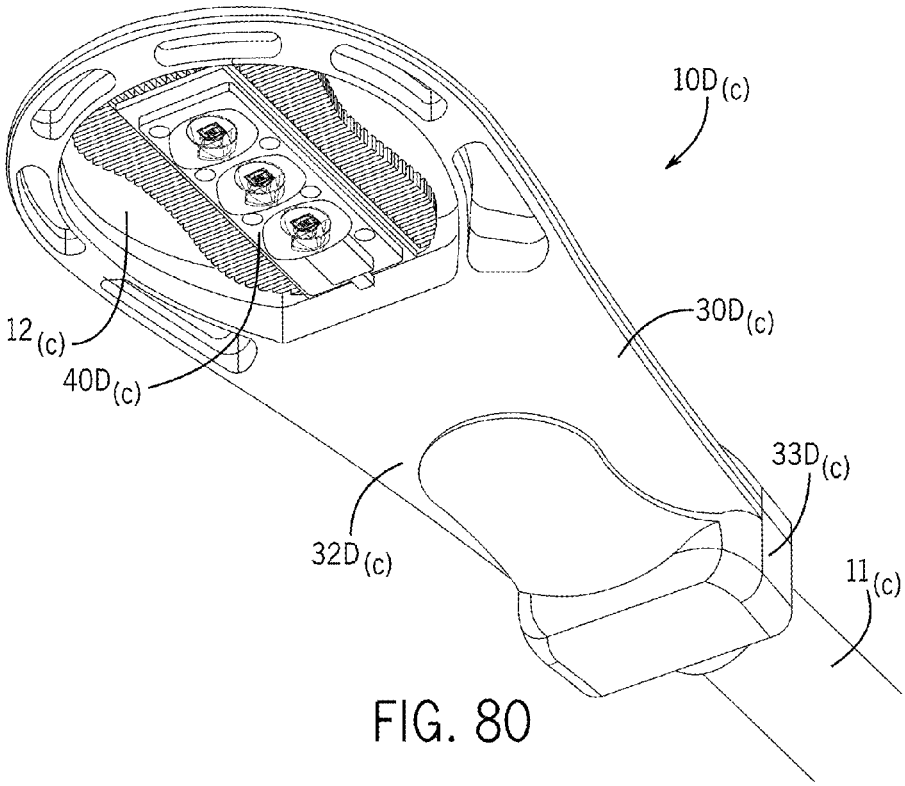
FIG. 80 is a bottom perspective view of still another embodiment of this invention.
Figure 81:
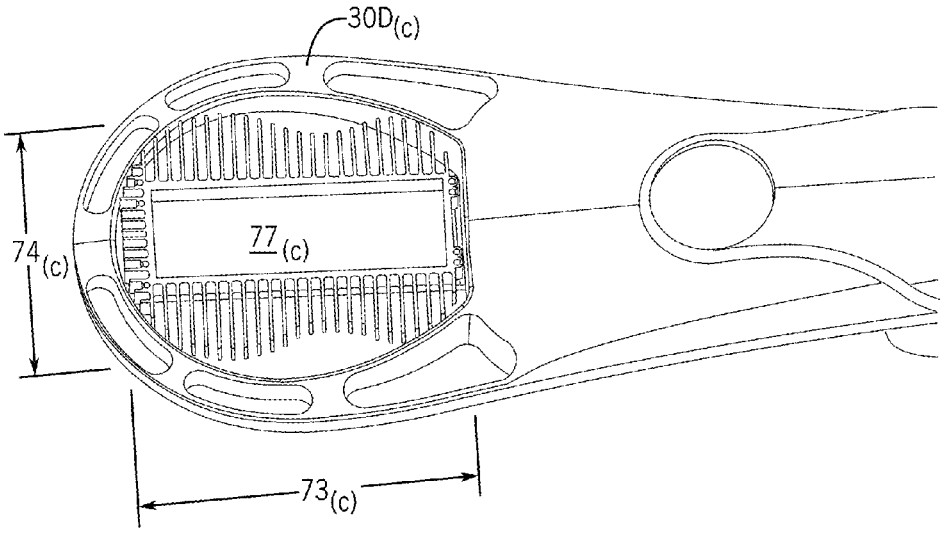
FIG. 81 is a bottom plan view showing the LED light fixture of FIG. 80 without its LED illuminator in place.
Figure 82:
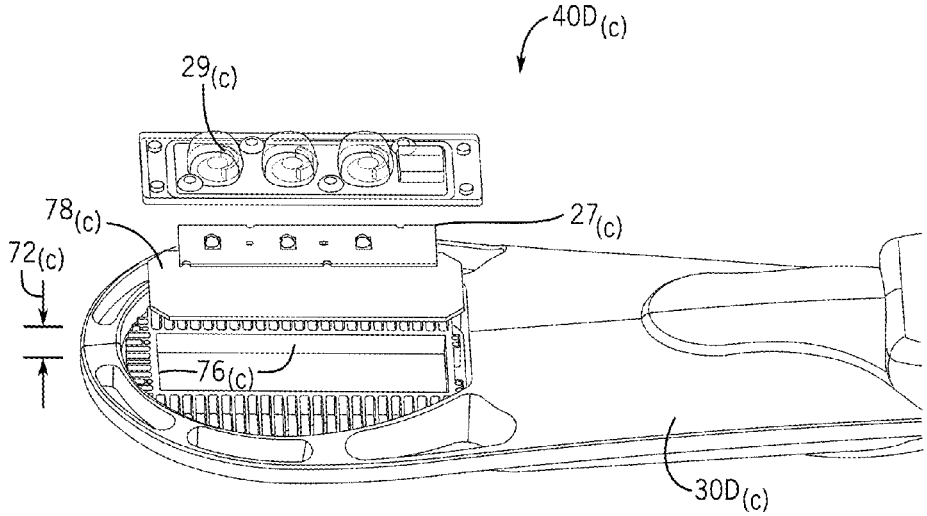
FIG. 82 is a bottom perspective partially-exploded view of the LED light fixture of FIG. 80.

FIGS. 80-82 illustrate a fifth embodiment of this invention. Light fixture 10D$_{(c)}$ has an LED assembly 40D$_{(c)}$ secured with respect to a non-metallic (polymeric) frame 30D$_{(c)}$. In the fourth and fifth embodiments, the frame itself serves to form the enclosure for the LED power circuitry, and such circuitry may include a fully-enclosed antenna.

The embodiments of FIGS. 79-82 each include extruded heat sinks which are characterized by having fins extending laterally on either side and forwardly on the front side. In each embodiment, the extruded heat sink has been extruded in a direction orthogonal to both the forward and the lateral directions. The extruded dimension, which is illustrated by numeral 72$_{(c)}$ in FIG. 82, is less than the forward-rearward and side-to-side dimensions 73$_{(c)}$ and 74$_{(c)}$ of such heat sink, as illustrated in FIG. 25. In some embodiments, the fins may be on at least three sides of the heat sink, as seen in FIGS. 90, 96, 94A and 95A. As seen in FIGS. 90, 94-95A, through-spaces 12$_{(c)}$ may be located along at least two of transverse sides of the heat sink, e.g., at least on one lateral side and on the front and rear sides of the heat sink.

Figure 90:
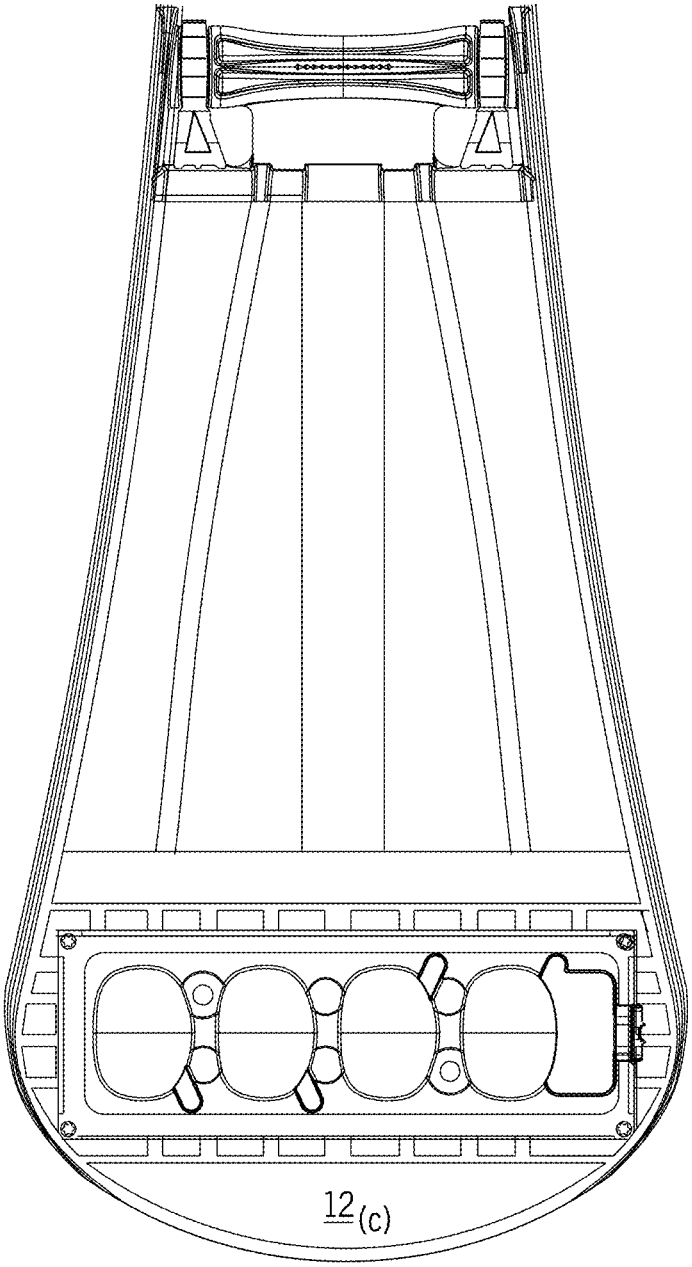
FIG. 90 is a bottom plan view of still another embodiment of the invention.
Figure 96:
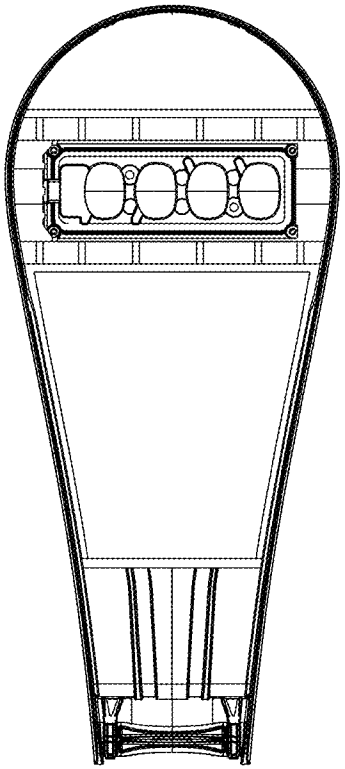
FIGS. 94-96 are bottom plan views of still alternative embodiments of the invention.
Figure 95:
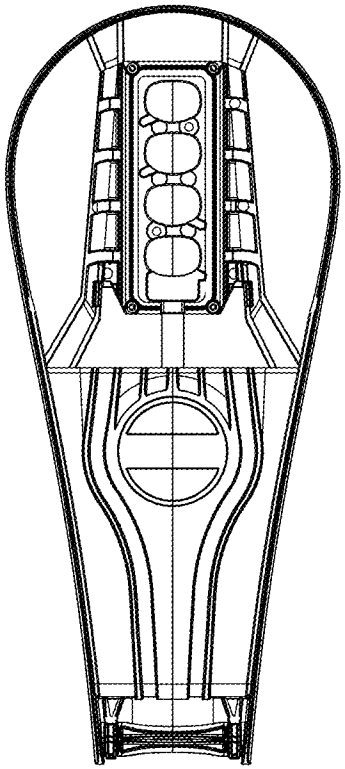
Figure 94:
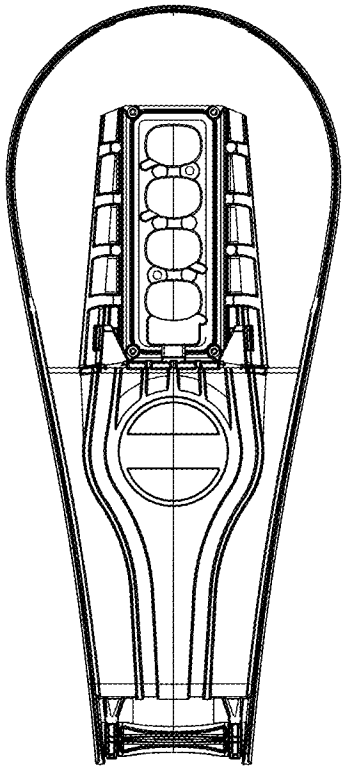
Figure 94A:
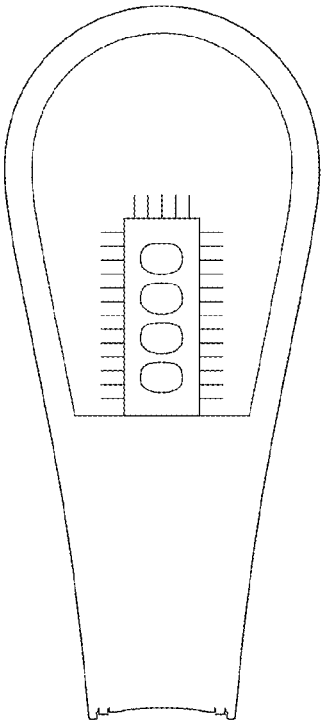
Figure 95A:
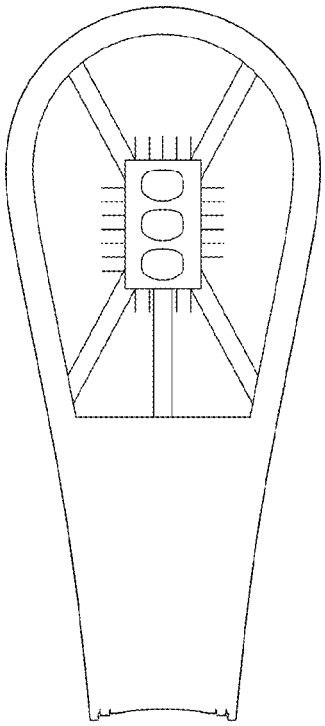
Figure 96A:
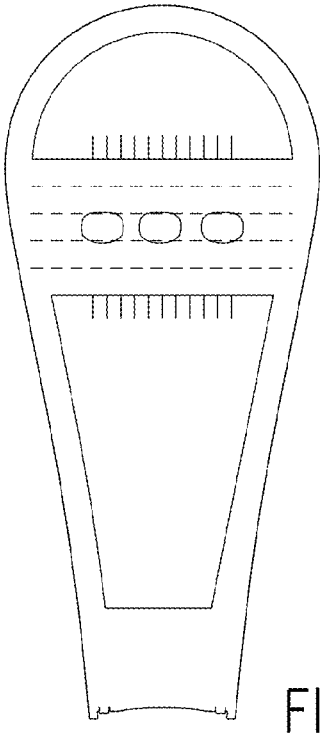

FIGS. 90-96 illustrate examples of embodiments which include at least one wall extending within the open space 12 and open for air/water-flow along at least two sides thereof. The examples of light fixture configurations shown in each of FIGS. 90-96 have at least one wall which extends within the open space substantially along the base. FIGS. 90 and 96 illustrate examples of at least one wall dividing the open space into an illuminator-adjacent flow region and a chamber-adjacent flow region.

The "short" extrusions of the heat sinks of the fourth and fifth embodiments are facilitated by structure shown best in FIGS. 81 and 82. More specifically, the heat sinks are each formed by an extrusion having a middle portion void, i.e., having walls 76$_{(c)}$ defining a central opening 77$_{(c)}$. As seen in FIG. 82, these heat sinks include, in addition to such extrusion, a mounting plate 78$_{(c)}$ in thermal contact with the extrusion. Mounting plate 78$_{(c)}$ may be thermally engaged to the extrusion by screws or in other ways. As shown in FIG. 82, LED illuminator $\mathbf{41}_{(c)}$ is secured to mounting plate $\mathbf{78}_{(c)}$.

The laterally- and forwardly-extending fins are open to free flow of ambient fluid (air and water), and their position and orientation serve to promote rapid heat exchange with the atmosphere and therefore rapid cooling of the LED illuminator during operation. Upwardly-flowing air and downwardly-flowing water (in the presence of precipitation) facilitate effective cooling, and reduce the need for upwardly-extending fins on top of the heat sinks.

Certain aspects are illustrated best by reference to the first embodiment, particularly as shown in FIGS. 57-63, 65-69, 73-82 and 90. Heat sink $\mathbf{42}_{(c)}$ of such embodiment has a front side $\mathbf{48}_{(c)}$, a rear side $\mathbf{49}_{(c)}$ and lateral sides $\mathbf{50}_{(c)}$ and is open to ambient-fluid flow to and from the various heat-dissipating surfaces $\mathbf{44}_{(c)}$. Heat sink $\mathbf{42}_{(c)}$ includes a central portion $\mathbf{45}_{(c)}$ and peripheral portions $\mathbf{46}_{(c)}$ along opposite lateral sides $\mathbf{50}_{(c)}$. Peripheral portions $\mathbf{46}_{(c)}$ have peripheral heat-dissipating surfaces $\mathbf{47}_{(c)}$ along lateral sides $\mathbf{50}_{(c)}$ of heat sink $\mathbf{42}_{(c)}$. Central portion $\mathbf{45}_{(c)}$ includes LED-supporting region $\mathbf{43}_{(c)}$ and has central heat-dissipating surfaces $\mathbf{51}_{(c)}$ opposite LED illuminator $\mathbf{41}_{(c)}$ from which a plurality of elongate fins $\mathbf{53}_{(c)}$ protrude in a direction opposite LED illuminator $\mathbf{41}_{(c)}$. Fins $\mathbf{53}_{(c)}$ extend from front fin-ends $\mathbf{54}_{(c)}$ adjacent to front side $\mathbf{48}_{(c)}$ of heat sink $\mathbf{42}_{(c)}$ to rear fin-ends $\mathbf{55}_{(c)}$ adjacent to rear side $\mathbf{49}_{(c)}$ of heat sink $\mathbf{42}_{(c)}$. As shown in FIGS. 59, 66, 72 and 75-78, some of rear fin-ends $\mathbf{55}_{(c)}$ are integral with housing $\mathbf{17}_{(c)}$.

FIGS. 59, 73, 75, 81 and 90 show central-portion openings $\mathbf{52}_{(c)}$ facilitating ambient-fluid flow to and from heat-dissipating surfaces $\mathbf{51}_{(c)}$ of central portion $\mathbf{45}_{(c)}$. Central-portion openings $\mathbf{52}_{(c)}$ are adjacent to enclosure $\mathbf{13}_{(c)}$ and are partially defined by housing $\mathbf{17}_{(c)}$. Fins $\mathbf{53}_{(c)}$ of central portion $\mathbf{45}_{(c)}$ define between-fin channels $\mathbf{56}_{(c)}$ (shown in FIG. 69), which in a mounted position extend along a plane which is close to, but not, horizontal. Between-fin channels $\mathbf{56}_{(c)}$ are open at front fin-ends $\mathbf{54}_{(c)}$; i.e., there is no structural barrier to flow of liquid from between-fin channels $\mathbf{56}_{(c)}$ at front fin-ends $\mathbf{54}_{(c)}$.

In the second embodiment illustrated in FIG. 76, fins $\mathbf{53A}_{(c)}$ are configured such that between-fin channels $\mathbf{56A}_{(c)}$ are open along the front and lateral sides of the heat sink.

Referring again to the first embodiment, FIGS. 59 and 75 show rear fin-ends $\mathbf{55}_{(c)}$ configured to permit ambient-fluid flow from between-fin channels $\mathbf{56}_{(c)}$ to central-portion openings $\mathbf{52}_{(c)}$, thereby facilitating liquid drainage therefrom. Liquid drainage from the top of heat sink $\mathbf{42}_{(c)}$ is facilitated by inclination of the top surface of heat sink $\mathbf{42}_{(c)}$, as explained more specifically below.

Figure 88:
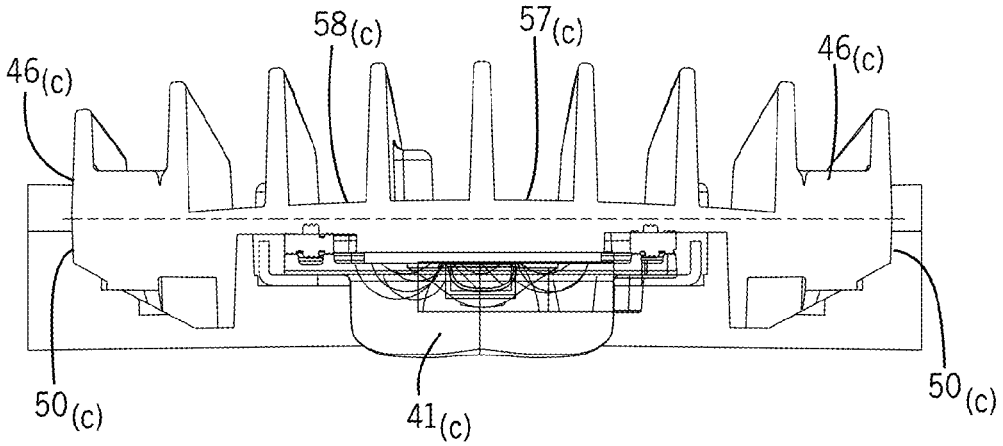
FIG. 88 is a fragmentary side-to-side cross-sectional view similar to FIG. 69, but illustrating the heat sink having a surface opposite the LED illuminator which slopes toward both lateral sides of the heat sink.
Figure 89:
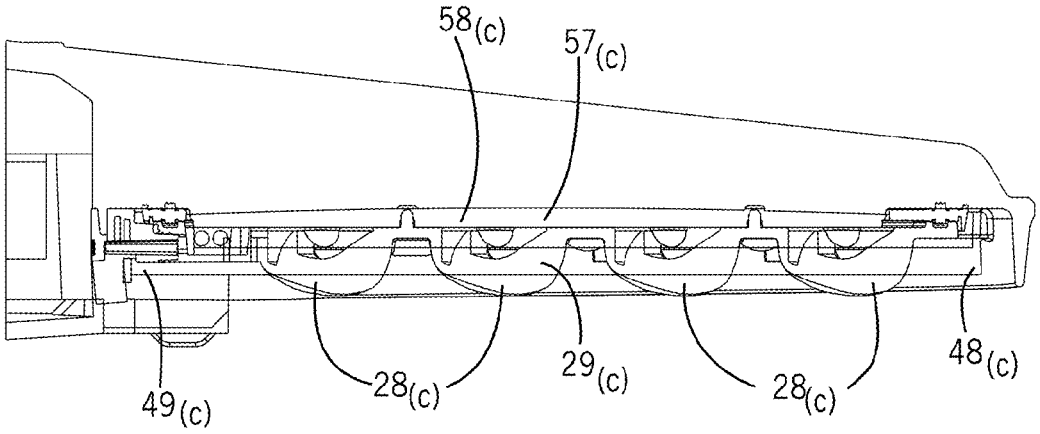
FIG. 89 is a fragmentary front-to-back cross-sectional view similar to FIG. 72, but illustrating the heat sink having a surface opposite the LED illuminator which slopes toward both the front and back sides of the heat sink.

FIGS. 88 and 89 show between-fin surfaces $\mathbf{57}_{(c)}$ inclined off-horizontal when light fixture $\mathbf{10}_{(c)}$ is in its usual use orientation. More specifically, FIG. 88 shows surfaces $\mathbf{57}_{(c)}$ sloping toward lateral sides $\mathbf{50}_{(c)}$ of heat sink $\mathbf{42}_{(c)}$, and FIG. 89 shows surfaces $\mathbf{57}_{(c)}$ sloping toward front and rear sides $\mathbf{48}_{(c)}$ and $\mathbf{49}_{(c)}$ of heat sink $\mathbf{42}_{(c)}$. In other words, portions of surfaces $\mathbf{57}_{(c)}$ are slightly but sufficiently downwardly inclined toward at least two dimensions and in this embodiment on each of the four sides of heat sink $\mathbf{42}_{(c)}$.

FIGS. 88 and 89 show LED assembly $\mathbf{40}_{(c)}$ on a bottom surface of heat sink $\mathbf{42}_{(c)}$. Heat sink $\mathbf{42}_{(c)}$, when the fixture is in its mounted orientation, includes a top surface which in plan view has a surrounding edge. FIG. 88 shows the top surface sloping downwardly toward the surrounding edge in opposite lateral plan-view directions, thereby facilitating liquid drainage from the heat sink. FIG. 89 shows the top surface sloping downwardly toward the surrounding edge in the forward and rearward directions. FIG. 88 further shows a plurality of elongate fins $\mathbf{53}_{(c)}$ protruding from the top surface in a direction opposite LED illuminator $\mathbf{41}_{(c)}$. Sloping top surface includes between-fin surfaces $\mathbf{57}_{(c)}$.

Figure 58:
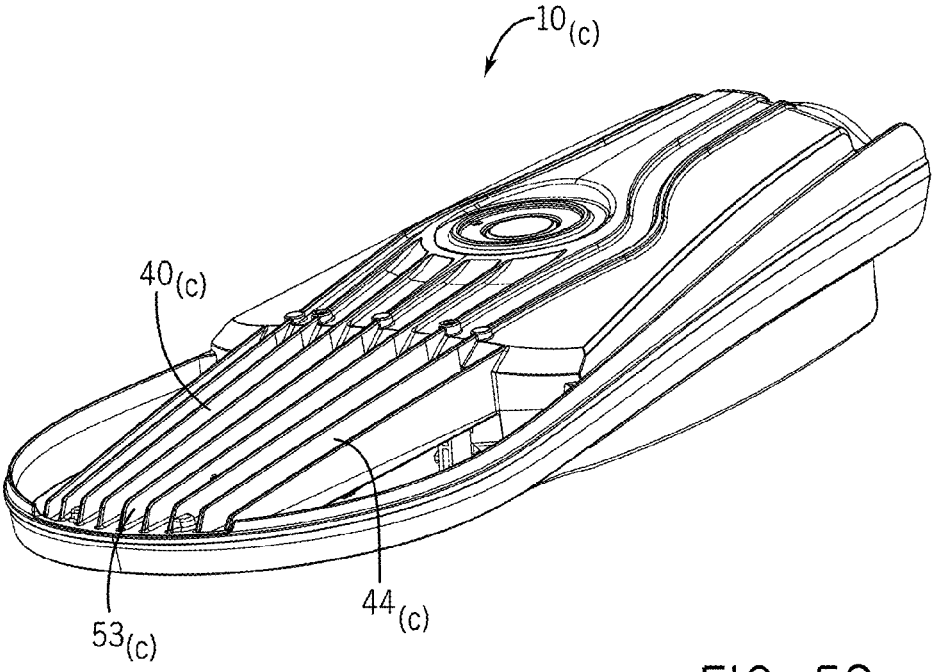
FIG. 58 is a perspective view from above of the LED light fixture of FIG. 57.
Figure 70:
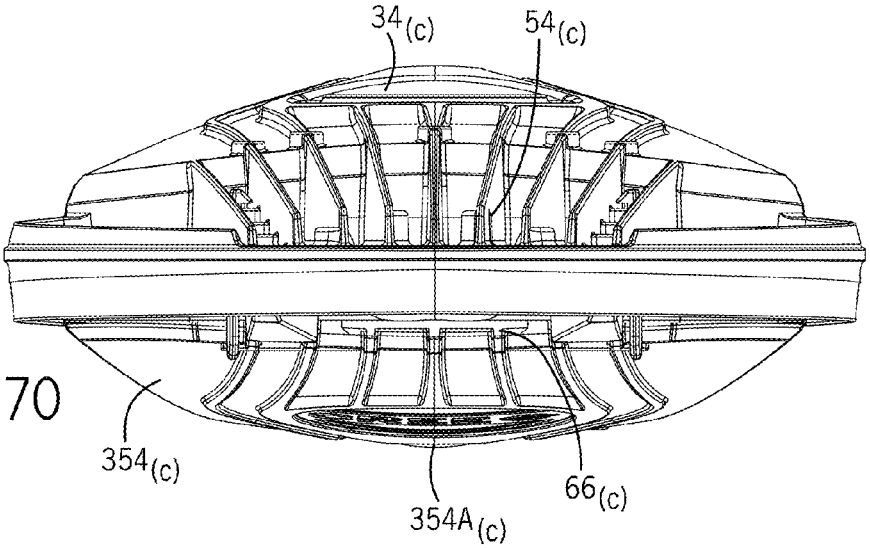
FIG. 70 is a front elevation of the LED light fixture of FIG. 57.
Figure 71:
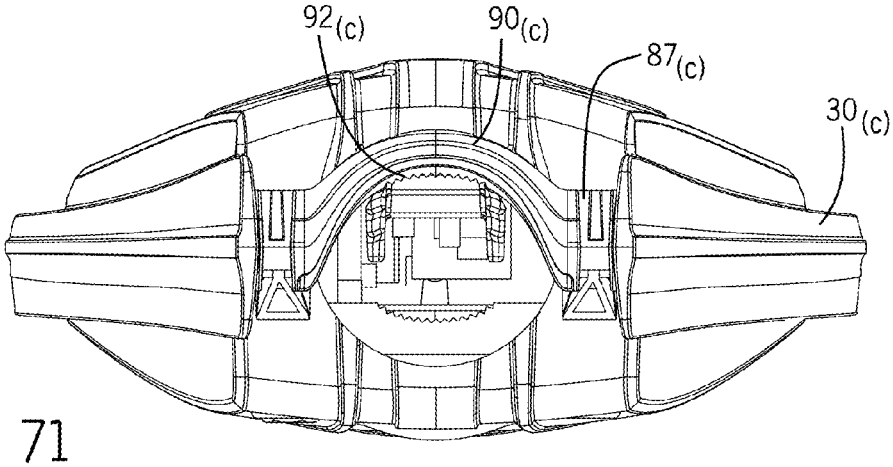
FIG. 71 is a rear elevation of the LED light fixture of FIG. 57.
Figure 72:
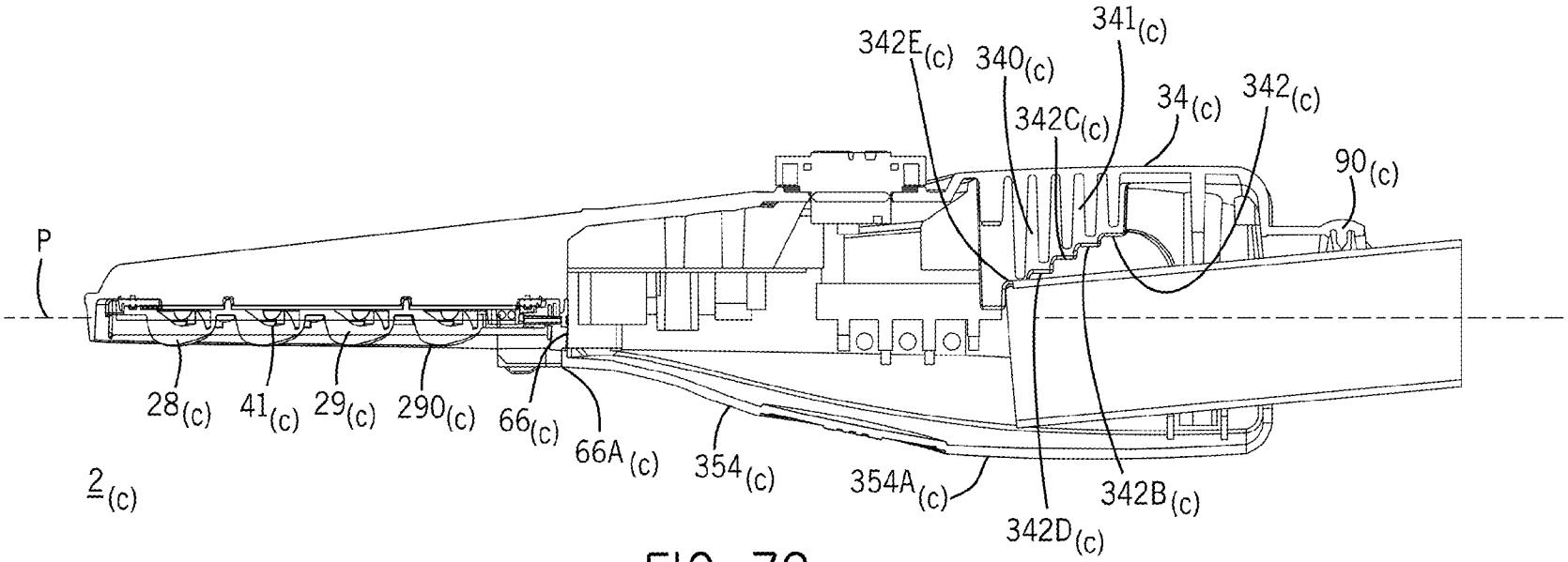
FIG. 72 is a side cross-sectional view of the LED light fixture taken along section 72-72 as indicated in FIG. 60.

FIGS. 58 and 72 show housing $\mathbf{17}_{(c)}$ including a housing top surface sloping downwardly in the forward direction. These figures also show the top housing surface sloping toward the top surface of heat sink $\mathbf{42}_{(c)}$, whereby liquid drainage from the housing facilitates cooling of heat sink $\mathbf{42}_{(c)}$. FIGS. 70 and 71 show the housing top surface sloping downwardly in opposite lateral plan-view directions, thereby facilitating liquid drainage therefrom.

Housing upper shell $\mathbf{34}_{(c)}$ and heat sink $\mathbf{42}_{(c)}$ are formed as a single piece, whereby the housing upper shell facilitates heat dissipation. The heat sink, the frame and the housing upper shell are formed as a single piece.

Figure 69:
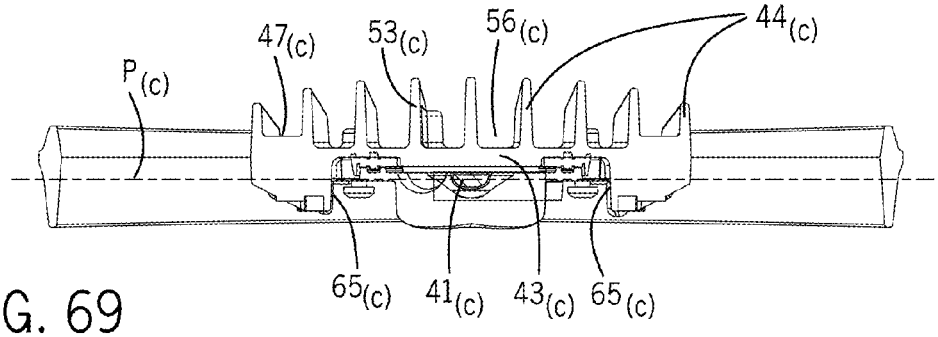
FIG. 69 is a side-to-side cross-sectional view of the LED light fixture taken along section 69-69 as indicated in FIG. 60.

In addition to the above-described sloping, LED light fixture $\mathbf{10}_{(c)}$ has various advantageous structural taperings. As seen best in FIGS. 59 and 60, heat sink $\mathbf{42}_{(c)}$, in plan view is tapered such that it is wider at its rearward end than at its forward end. Additionally, as seen in FIGS. 58 and 72, each of central-portion fins $\mathbf{53}_{(c)}$ has a tapered configuration such that its vertical dimension at the rearward end of heat sink $\mathbf{42}_{(c)}$ is greater than its vertical dimension at the forward end of heat sink $\mathbf{42}_{(c)}$. Furthermore, as seen in FIGS. 69 and 70, fins $\mathbf{53}_{(c)}$ have progressively lesser vertical dimensions toward each of opposite lateral sides $\mathbf{50}_{(c)}$ of heat sink $\mathbf{42}_{(c)}$.

As shown in FIGS. 57, 61, 6 and 67-69 and 88, peripheral portions $\mathbf{46}_{(c)}$ of heat sink $\mathbf{42}_{(c)}$ extend along opposite lateral sides $\mathbf{50}_{(c)}$. Peripheral heat-dissipating surfaces $\mathbf{47}_{(c)}$ include a plurality of fins $\mathbf{59}_{(c)}$ extending laterally from central portion $\mathbf{45}_{(c)}$ of heat sink $\mathbf{42}_{(c)}$, with open spaces $\mathbf{60}_{(c)}$ formed between adjacent pairs of fins $\mathbf{59}_{(c)}$. As seen in FIGS. 59, 60, 67-69 and 73-75, peripheral portion $\mathbf{46}_{(c)}$ also has a peripheral fin $\mathbf{59A}_{(c)}$ along each lateral side $\mathbf{50}_{(c)}$ of heat sink $\mathbf{42}_{(c)}$. Peripheral fins $\mathbf{59A}_{(c)}$ extend in length from front fin-ends $\mathbf{54A}_{(c)}$ adjacent to front side $\mathbf{48}_{(c)}$ of heat sink $\mathbf{42}_{(c)}$ to rear fin-ends $\mathbf{55A}_{(c)}$ adjacent to rear side $\mathbf{49}_{(c)}$ of heat sink $\mathbf{42}_{(c)}$. Rear fin-ends $\mathbf{55A}_{(c)}$ of peripheral fins $\mathbf{59A}_{(c)}$ are integral with housing $\mathbf{17}_{(c)}$. The configuration of peripheral portions $\mathbf{46}_{(c)}$ of heat sink $\mathbf{42}_{(c)}$ serves to facilitate cooling by providing additional heat-exchange surfaces in particular effective locations.

The various embodiments disclosed herein each illustrate one aspect of the present invention particularly related to the frame and open character of the fixtures. This is discussed in particular with respect to the first embodiment, and in particular with reference to FIGS. 91-93 which schematically illustrate "projected" areas of structure and through-spaces of the fixture in plan view.

More specifically, the first embodiment includes the following projected areas:

total area $\mathbf{36}_{(c)}$ of light-fixture forward region $\mathbf{31}_{(c)}$≈67.0 sq.in.;

total area $\mathbf{37}_{(c)}$ of LED assembly $\mathbf{40}_{(c)}$≈40.4 sq.in.;

total through-space area of the two lateral side voids $\mathbf{12}_{(c)}$≈26.5 sq.in.;

total area of the entire fixture≈160 sq. in.

Figure 91:
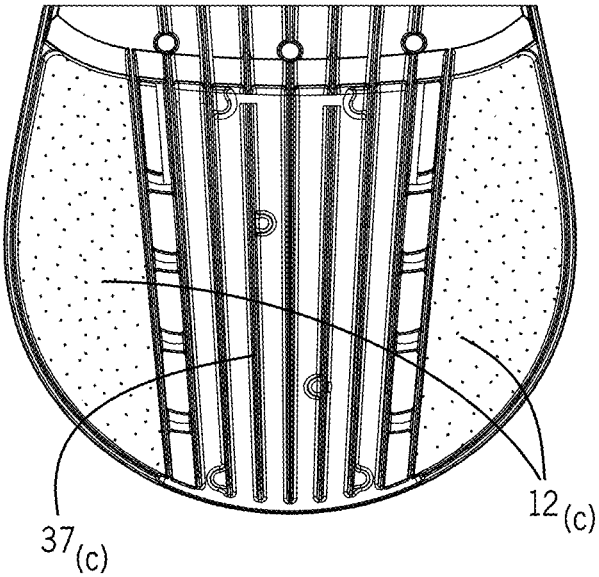
FIGS. 91-93 are schematic top plan views of the LED light fixture of FIG. 57, such figures serving to indicate particular projected areas of the fixture for purposes of facilitating description of certain aspects of the invention.
Figure 92:
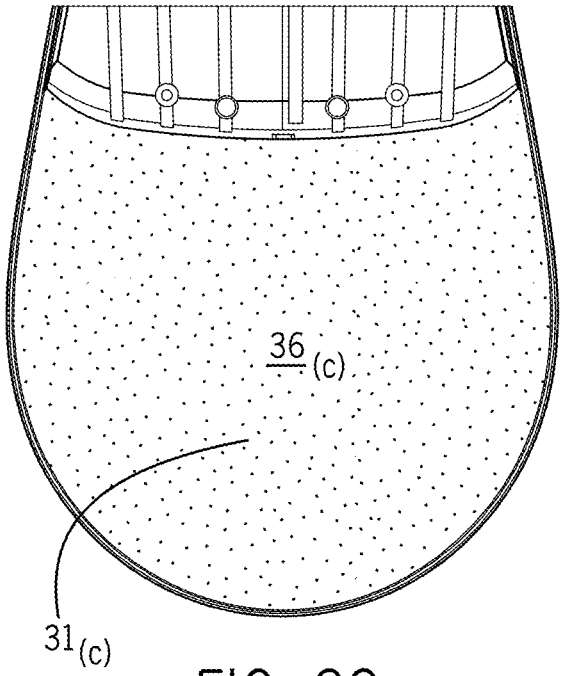
Figure 93:
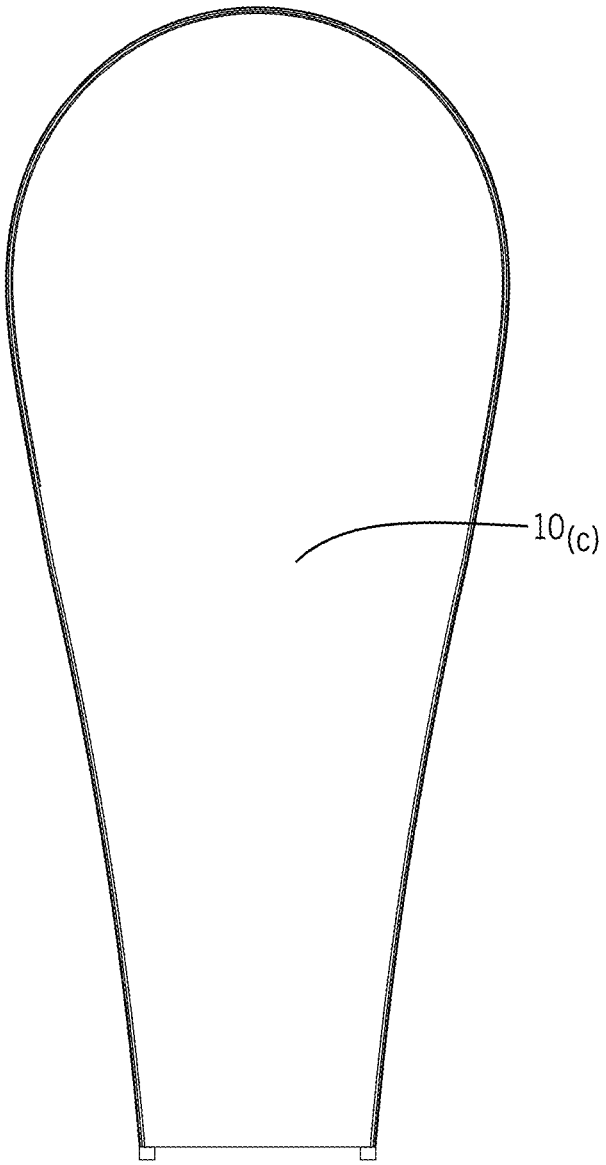

FIGS. 91-93 show projected LED-assembly area $\mathbf{37}_{(c)}$ of about 60% of the projected forward-region area $\mathbf{36}_{(c)}$. The total through-space area of the two lateral side voids $\mathbf{12}_{(c)}$ is about two-thirds of projected LED-assembly area $\mathbf{37}_{(c)}$.

When describing the openness aspect of this invention using reference to the illuminator plane P indicated in FIGS. 69 and 72, plane P is defined by LED illuminator $\mathbf{41}_{(c)}$ directly facing the area to be illuminated. The intersections referred to above with such plane P are illustrated in FIGS. 91 and 93.

Using such parameters, the total through-space area in the illuminator plane is slightly over 15% of the fixture area. And, if the light fixture is configured such that the enclosure with its LED power circuitry, rather than being beside the LED assembly, is offset above or otherwise away from the LED assembly (such as being in the support member), then the total through-space area in the illuminator plane may be at least about 40% of the fixture area. Described differently, the total through-space area in illuminator plane P is about two-thirds of the projected LED-assembly area.

While openness is discussed above with particular reference to the first embodiment, it should be noted that FIG. 76 illustrates an embodiment in which light fixture 10A$_{(c)}$ has openness along the majority of its length. More specifically, the openness extends well to the rear of the forward portion of fixture 10A$_{(c)}$, i.e., well to the rear of the LED assembly of such fixture, including on either side of the enclosure.

Such openness in an LED light fixture offers great flexibility from the standpoint of form-factor design, e.g., allowing overall shape of the fixtures to better accommodate replacement of existing non-LED fixtures of various shapes. Several of the embodiments disclosed herein have frames which at least in their forward portions provide a footprint substantially similar to the footprint of so-called "cobra-head" light fixtures. This is achieved despite the fact that the LED assemblies used in fixtures according to the recent invention have substantially straight opposite lateral sides, as seen in the figures.

The advantages of the openness disclosed herein extend beyond form-factor concerns. Just one example includes avoiding or minimizing accumulation of snow, leaves or other materials on the fixtures.

Another aspect of the present inventive light fixtures is illustrated in FIGS. 57,62, 63 and 67-69. Referring in particular to the first embodiment, central portion 45$_{(c)}$ of heat sink 42$_{(c)}$ has downwardly-extending shield members 65$_{(c)}$ at lateral sides 50$_{(c)}$ of heat sink 42$_{(c)}$. Shield members 65$_{(c)}$ are configured and dimensioned to block illumination which, when fixture 10$_{(c)}$ is installed as street-light, minimize upward illumination. This facilitates compliance with "dark-sky" requirements for limiting light pollution.

FIG. 72 shows that optical member 29$_{(c)}$ is configured for directing emitter light in preferential direction 2 toward the forward side. FIGS. 57, 62, 63, 67-70 and 72 show a downwardly-extending shield member 66$_{(c)}$ at rearward side 49$_{(c)}$ of central heat-sink portion 45$_{(c)}$. Shield member 66$_{(c)}$ is configured and dimensioned to block rearward illumination. Rearward shield member 66$_{(c)}$ extends to a position lower than the lowermost outer-surface portion 290$_{(c)}$ of optical member 29$_{(c)}$. Rearward shield member 66$_{(c)}$ may include a reflective coating redirecting rearward light.

FIGS. 57, 62, 63, 67-70 and 72 show that forward wall-portion 181$_{(c)}$ of housing main portion 171$_{(c)}$ partially defines rearward shield member 66$_{(c)}$. These figures also show cover-member forward end 351$_{(c)}$, which is secured to forward wall-portion 181$_{(c)}$ of housing body 176$_{(c)}$, partially defining rearward shield member 66$_{(c)}$. Reflective or white coating of housing 17$_{(c)}$ may provide reflective characteristics for redirecting rearward light toward the preferential forward side 2.

As seen in FIGS. 57, 61, 70 and 72, cover member 350$_{(c)}$ has a cover wall 354$_{(c)}$ extending between rearward and forward ends 352$_{(c)}$ and 351$_{(c)}$. Cover wall 354$_{(c)}$ includes a lowermost portion 354A$_{(c)}$ which is at a position lower than lowermost position 66A$_{(c)}$ of rearward shield member 66$_{(c)}$ to further block rearward illumination. Reflective or white coating of cover wall 354$_{(c)}$ may provide reflective characteristics for redirecting rearward light in useful direction.

In some prior LED devices, back-light shielding has been in the form of individual shields disposed on a non-preferential side of each LED emitter. Some of such prior shielding was positioned over the exterior of a corresponding lens. In such prior cases, over time the back-light shielding often became covered with dust or other ambient particles and simply absorbed rearward light from the respective LED emitter. Such absorption translated in decreased efficiency of light output from such LED devices. In other examples, prior back-light shielding was positioned inside each lens corresponding to each individual LED emitter. While protected from contamination, such shielding resulted in lenses which were both complex and expensive to manufacture. In either type of the back-light shielding disposed on the non-preferential side of each individual LED emitter, there was still some undesired light in the rearward direction. Such light escaped the prior lens-shield configuration through unintended refraction or reflection by the lens.

In some other prior examples of back-light shielding used in light fixtures, such shields were in the form of a separate structure secured with respect to the fixture rearwardly to the illuminator. Such separate shielding structures often required complicated securement arrangements as well as interfered with the overall shape of the light fixture.

The integrated back-light shielding of the present invention, provides effective blocking of rearward light and provides reflection of such light away from areas of undesired illumination. The reflection provided by the integrated back-light shield of this invention facilitates higher light-output efficiency of the LED illuminator used in the LED light fixture of the present invention. The integrated nature of the back-light shielding of the present invention provides all the benefits of a single back-light shield without disruption of the overall shape of the fixture. Furthermore, the back-light shielding of the present invention is defined by surfaces which are open to air and water flow, which facilitates self cleaning of the reflective surface and minimizes absorption of light received by such shield surface.

Another aspect of this invention is illustrated best in FIGS. 59-62, 64-66, 71-75, 77 and 78. These figures show an exterior fulcrum 90$_{(c)}$ of fixture 10$_{(c)}$ affixed to rearward portion 33$_{(c)}$ of the fixture. Fulcrum 90$_{(c)}$ is configured to pivotably engage one side 11A$_{(c)}$ of support member 11$_{(c)}$ when a fixture-adjacent end 110$_{(c)}$ of support member 11$_{(c)}$ is within fixture interior 19$_{(c)}$. FIGS. 61, 62, 65, 72, 73 and 78 show that fixture 10$_{(c)}$ also includes an engager 91$_{(c)}$ secured within fixture interior 19$_{(c)}$ in position to engage the opposite side 11B$_{(c)}$ of support member 11$_{(c)}$ at a position offset from fulcrum 90$_{(c)}$. This arrangement holds fixture 10$_{(c)}$ in the desired orientation when support member 11$_{(c)}$ is held between fulcrum 90$_{(c)}$ and engager 91$_{(c)}$.

Figure 65:
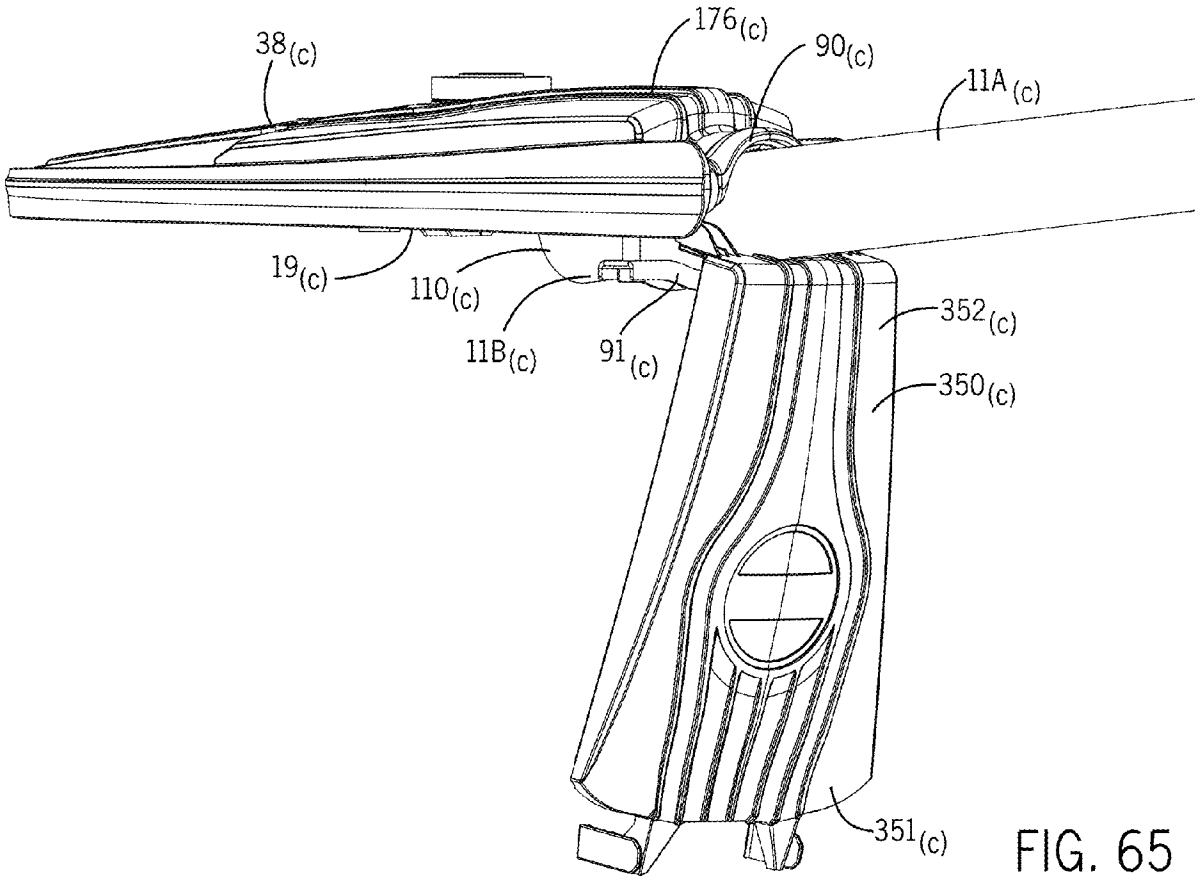
FIG. 65 is a side rear perspective view showing the LED light fixture secured with respect to a support member and having its cover member hanging open.
Figure 66:
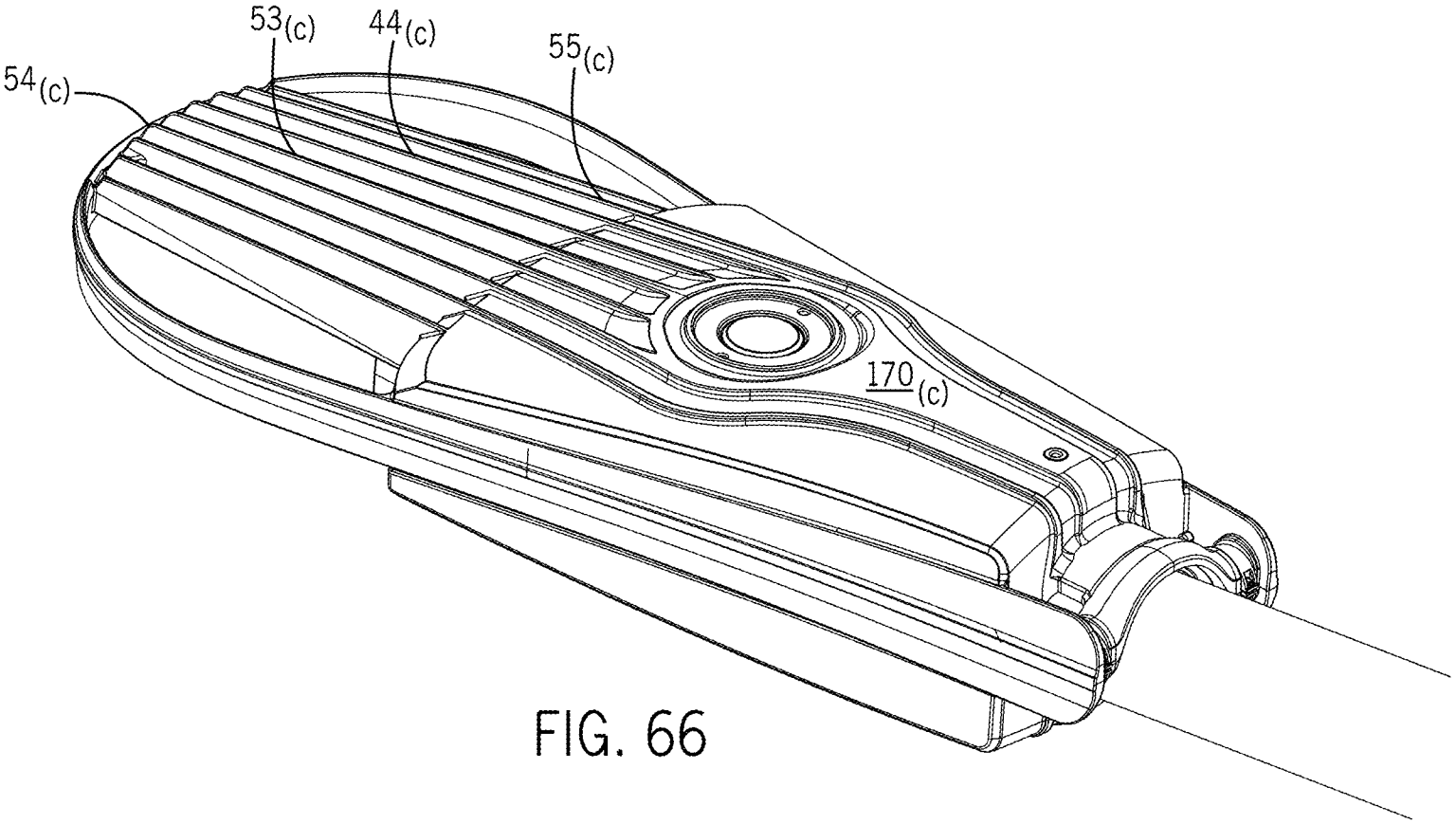
FIG. 66 is a top rear perspective view showing the LED light fixture secured with respect to the support.
Figure 67:
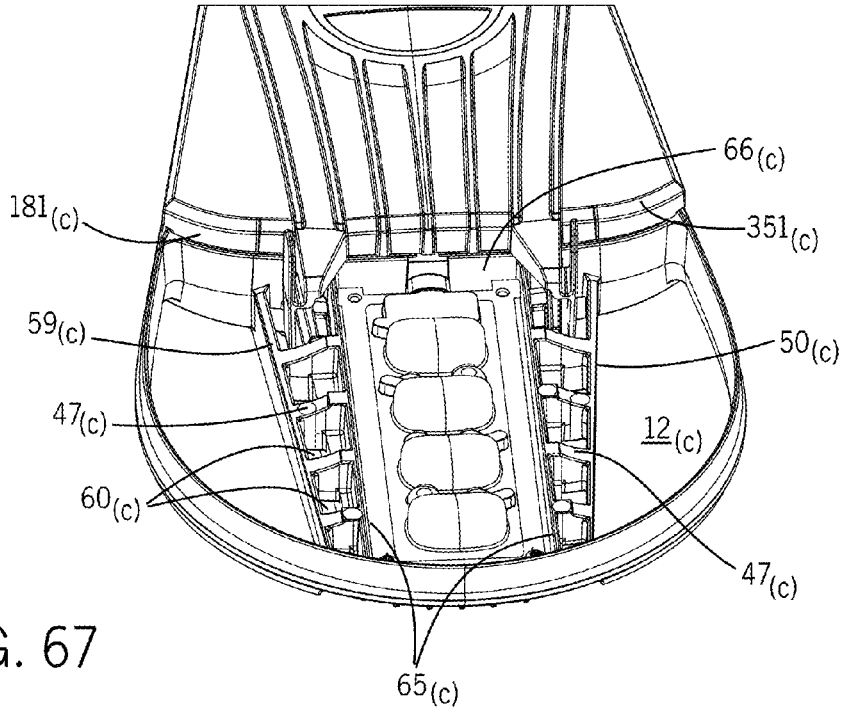
FIG. 67 is a fragmentary front perspective view from below illustrating the forward region of the fixture with its LED assembly therein, including its LED illuminator.
Figure 68:
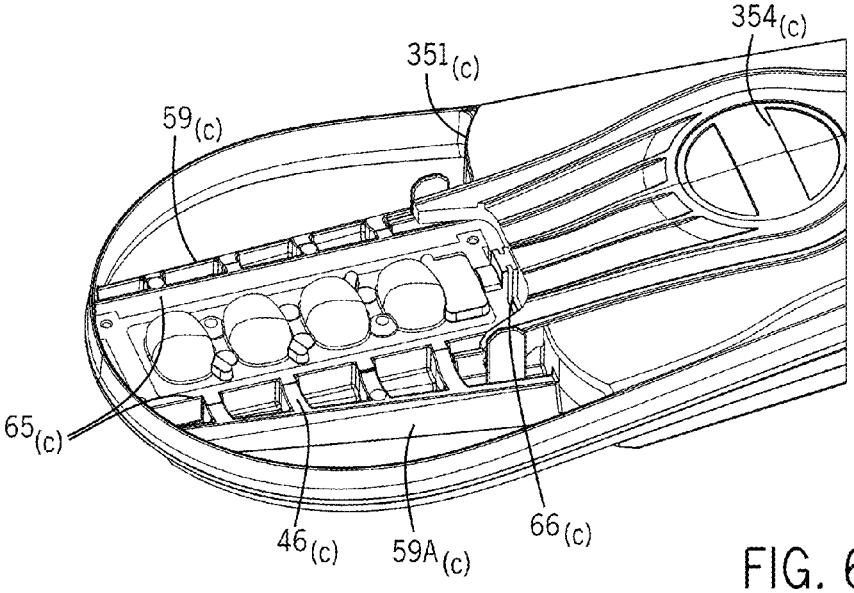
FIG. 68 is a fragmentary side perspective view from below showing the same portions of the fixtures as shown in FIG. 67 from a somewhat different angle.

FIGS. 64-66 show that fulcrum 90$_{(c)}$ is shaped to limit lateral movement of support member 11$_{(c)}$ thereagainst by its cradling shape and the fact that fulcrum 90$_{(c)}$ includes a row of teeth 92$_{(c)}$ configured to engage support member 11$_{(c)}$.

Fulcrum 90$_{(c)}$ is part of a fulcrum member 93$_{(c)}$ which also includes support structure 95$_{(c)}$ for fulcrum 90$_{(c)}$. FIGS. 59, 60, 64-66, 71, 74 and 75 show frame 30$_{(c)}$ having a pair of rearmost extensions 39$_{(c)}$ between which fulcrum 90$_{(c)}$ is secured. FIG. 10 also shows heat sink 42$_{(c)}$, frame 30$_{(c)}$, upper shell 34$_{(c)}$ and fulcrum 90$_{(c)}$ formed as a single piece.

The exterior fulcrum provides advantages such as allowing a smaller aperture for a support-member entry into the fixture interior 13$_{(c)}$ as well as easier access to the interior by providing more room for clearance of a compartment door.

The smaller entry aperture may eliminate the need for a splash guard which is typically required for UL listed outdoor light fixtures, while still providing for the possibility of a splash-guard arrangements.

Figure 73:
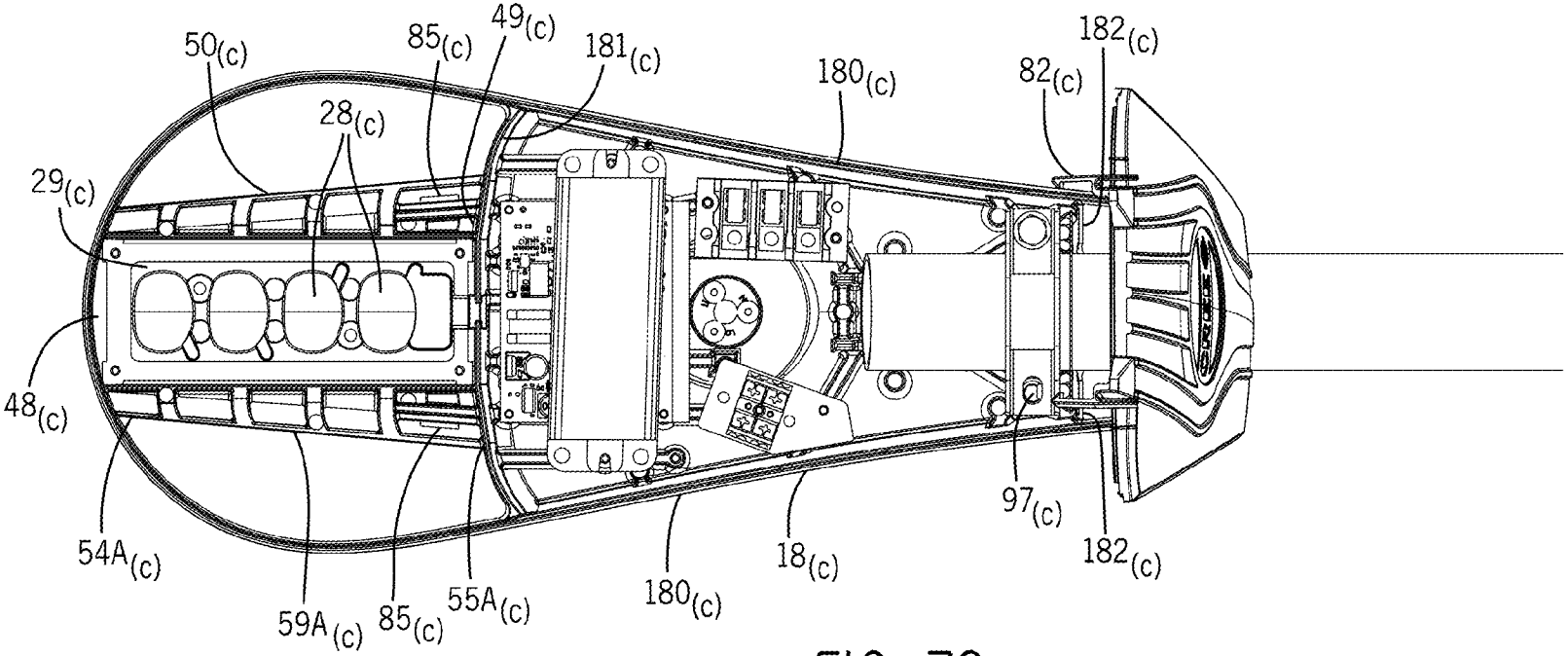
FIG. 73 is a bottom plan view of one embodiment of the LED light fixture secured to a support member and with its cover member open.
Figure 74:
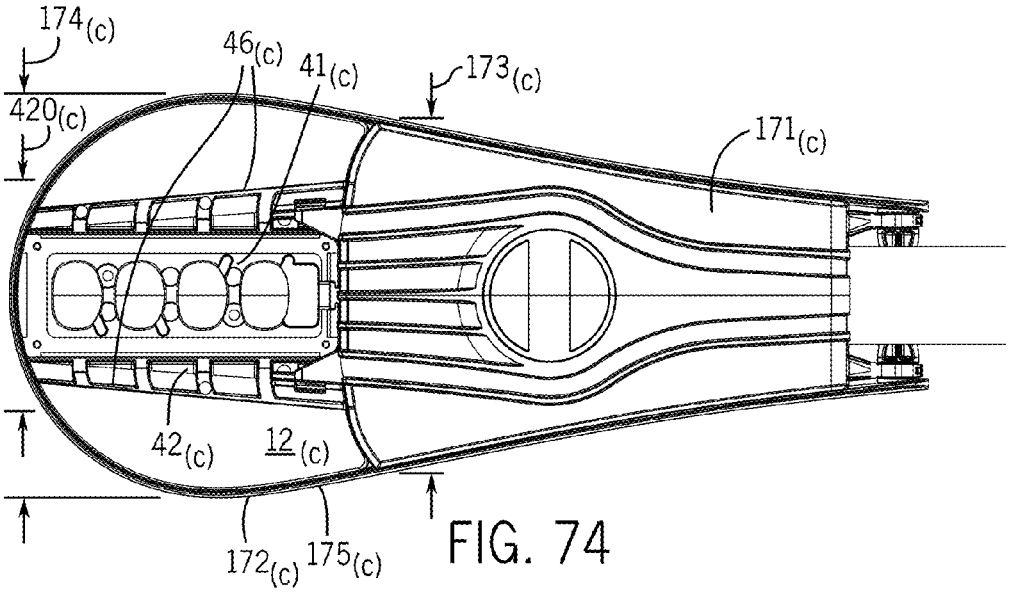
FIG. 74 is a bottom plan view similar to FIG. 73 but with the cover in its closed position.

As shown in FIGS. 62, 65 and 73, engager $\mathbf{91}_{(c)}$ is adjustably secured with respect to upper shell $\mathbf{34}_{(c)}$ and includes a yoke $\mathbf{96}_{(c)}$ shaped to substantially conform to the shape of support member $\mathbf{11}_{(c)}$. Yoke $\mathbf{96}_{(c)}$ has a pair of pin-receiving apertures $\mathbf{97}_{(c)}$ with a shaft portion $\mathbf{98}A_{(c)}$ of a corresponding pin $\mathbf{98}_{(c)}$ extending therethrough into threaded engagement with upper shell $\mathbf{34}_{(c)}$.

FIGS. 72 and 73 show that fixture interior $\mathbf{19}_{(c)}$ has an angle-referencing region $\mathbf{340}_{(c)}$ shaped to engage fixture-adjacent end $\mathbf{110}_{(c)}$ of support member $\mathbf{11}_{(c)}$ in order to facilitate positioning of fixture $\mathbf{10}_{(c)}$ (with respect to support member $\mathbf{11}_{(c)}$) within one of plural predetermined angle ranges 344). FIG. 72 shows angle-referencing region $\mathbf{340}_{(c)}$ as a step-like configuration extending downwardly from upper shell $\mathbf{34}_{(c)}$. Steps $\mathbf{341}_{(c)}$ each correspond to one of the plural predetermined angle ranges such that, depending on which of steps $\mathbf{341}_{(c)}$ is selected for engagement by fixture-adjacent end $\mathbf{110}_{(c)}$ of support member $\mathbf{11}_{(c)}$, adjustment of engager $\mathbf{91}_{(c)}$ locks fixture $\mathbf{10}_{(c)}$ at a particular angle with respect to support member $\mathbf{11}_{(c)}$ within the range of the selected step $\mathbf{341}_{(c)}$. Such predetermined angle ranges are range $\mathbf{342}A_{(c)}$ (which includes the range of about −5° to about −2.5°), range $\mathbf{342}B_{(c)}$ (which includes the range of about −2.5° to about 0°), range $\mathbf{342}C_{(c)}$ (which includes the range of about 0° to about +2.5°), range $\mathbf{342}D_{(c)}$ (which includes the range of about +2.5° to less than about)+5°, and range $\mathbf{342}E_{(c)}$ (which includes the range of about)+5°.

FIGS. 59 and 60 show light fixture $\mathbf{10}_{(c)}$ which in plan view has central and outward portions. The central portion includes housing $\mathbf{17}_{(c)}$ enclosing LED power circuitry, heat sink $\mathbf{42}_{(c)}$ secured with respect to housing $\mathbf{17}_{(c)}$ and supporting LED illuminator $\mathbf{40}_{(c)}$. The central portion also includes a mount adapted for securement to support member $\mathbf{11}_{(c)}$. As seen in FIGS. 59 and 60, the outward portion defines an outer plan-view shape of fixture $\mathbf{10}_{(c)}$ and is secured to the central portion with through-space(s) $\mathbf{12}_{(c)}$ between the central and outward portions.

As further seen in FIGS. 59, 60, 74 and 75, through-spaces $\mathbf{12}_{(c)}$ are along heat sink $\mathbf{42}_{(c)}$ on opposite sides thereof. Through-spaces are shown along opposite sides of the central portion. FIG. 76 shows through-spaces $\mathbf{12}_{(c)}$ being along housing $\mathbf{17}_{(c)}$.

The outward portion has an outer perimeter which in plan view may be substantially similar to the footprint of a cobrahead non-LED light fixture.

This invention gives great flexibility in providing LED light fixtures for a variety of particular roadway lighting and other similar outdoor lighting purposes. The desired light-output level determined by the particular application and/or determined by dimensional constraints (e.g., pole height, area to be illuminated, and desired foot-candles of illumination in the target area) can be varied substantially by selection of the particular appropriate LED illuminator and chosen power level, with or without modification of heat-sink size, without departing from a particular desired form factor, such as the above-mentioned "cobrahead" form. The open "footprint" of the fixture of this invention allows such flexibility in a light fixture with advantageous performance characteristics, both in light output and in heat dissipation.

One example of such light fixture is the fixture referred to as the first embodiment. Such particular fixture with a chosen four LED emitters and a heat sink as shown at power level of twenty-four watt gives an output of about 2411-2574 lumens, depending on LED correlated color temperature (CCT). The same fixture with applied power of 42 watt gives an output of about 3631-3884 lumens, again depending on LED CCT. Higher lumen outputs can be achieved by corresponding adjustments in the number and nature of LED emitters, with or without corresponding adjustment of the heat sink. These changes can be made with or without change in the "footprint" of the fixture.

While the principles of the invention have been shown and described in connection with specific embodiments, it is to be understood that such embodiments are by way of example and are not limiting.

The invention claimed is:

1. An LED light fixture comprising:

a housing portion forming a chamber enclosing at least one driver; and a base extending from the housing portion and supporting at least one LED illuminator outside the chamber, the housing portion and the base defining an open space therebetween permitting air/water-flow therethrough.

2. The LED light fixture of claim 1 wherein the housing portion and the base are each formed as part of a one piece comprising at least one frame member supporting the base with respect to the housing portion and including forward and rearward regions.

3. The LED light fixture of claim 2 wherein:

the rearward region includes the chamber and a rearmost portion adapted for securement to a support member; and the base is within the forward region defining the open space along at least three sides of the base.

4. The light fixture of claim 2 wherein:

the at least one LED illuminator is in thermal contact with an illuminator-supporting region of the base, the at least one LED illuminator comprising an optical member disposed over at least one LED emitter and configured for directing emitter light predominantly forward; and a rearward shield member extends downwardly at the rearward side of the base, the rearward shield member extending lower than a lowermost outer-surface portion of the optical member to block rearward illumination therefrom.

5. The light fixture of claim 1 wherein the base is a separate structure secured with respect to the housing.

6. The light fixture of claim 5 wherein the base comprises a pair of extruded side portions each forming a channel along the base, the side portions and the base being of a single-piece extrusion secured with respect to the housing.

7. The light fixture of claim 5 wherein:

the base is a single-piece extrusion having an illuminator-supporting region; and the at least one LED illuminator comprises a plurality of LED modules in thermal contact with the illuminator-supporting region of the single-piece extrusion.

8. The LED light fixture of claim 7 wherein:

the LED-array modules are substantially rectangular having predetermined module-lengths; and the illuminator-supporting region has a length which is selected from one module-length and a multiple thereof.

9. The LED light fixture of claim 8 wherein at least one of the plurality of modules has a module-length different than the module-length of at least another of the plurality of modules.

10. The light fixture of claim 5 wherein the base comprises a plurality of extruded heat sinks.

11. The light fixture of claim 10 wherein the at least one LED illuminator comprises a plurality of LED modules each in thermal contact with a respective one of the extruded heat sinks.

12. The light fixture of claim 11 wherein each heat sink supports one of the LED modules.

13. The light fixture of claim 5 wherein the open space is along at least three sides of the base.

14. The light fixture of claim 13 wherein the base comprises a plurality of extruded heat sinks.

15. The light fixture of claim 14 wherein the at least one LED illuminator comprises a plurality of LED modules each in thermal contact with a respective one of the extruded heat sinks.

16. The light fixture of claim 1 comprising at least one wall extending within the open space and open for air/water-flow along at least two sides thereof.

17. The LED lighting fixture of claim 16 wherein the at least one wall extends within the open space substantially along the base.

18. The LED lighting fixture of claim 17 wherein the at least one wall divides the open space into an illuminator-adjacent flow region and a chamber-adjacent flow region.

* * * * *